US007571746B2

(12) United States Patent
Hay et al.

(10) Patent No.: US 7,571,746 B2
(45) Date of Patent: Aug. 11, 2009

(54) HIGH SHAFT FORMING FABRICS

(75) Inventors: Stewart Lister Hay, Bury (GB); Arved Westerkamp, Dettingen/Ems (DE)

(73) Assignee: Voith Patent GmbH, Heidenheim (DE)

( * ) Notice: Subject to any disclaimer, the term of this patent is extended or adjusted under 35 U.S.C. 154(b) by 192 days.

(21) Appl. No.: 10/557,266

(22) PCT Filed: May 18, 2004

(86) PCT No.: PCT/EP2004/050829

§ 371 (c)(1),
(2), (4) Date: Dec. 4, 2006

(87) PCT Pub. No.: WO2004/104294

PCT Pub. Date: Dec. 2, 2004

(65) Prior Publication Data

US 2008/0035231 A1 Feb. 14, 2008

(51) Int. Cl.
*D21F 1/10* (2006.01)
*D21F 7/08* (2006.01)
*D03D 25/00* (2006.01)

(52) U.S. Cl. ..... 139/383 A; 139/383 AA; 139/383 R; 162/358.2

(58) Field of Classification Search ..... None
See application file for complete search history.

(56) References Cited

U.S. PATENT DOCUMENTS 1,111,987 A * 9/1914 Avis ..... 112/245
4,356,225 A * 10/1982 Dufour ..... 442/206
4,379,735 A * 4/1983 MacBean ..... 162/348
4,501,303 A * 2/1985 Osterberg ..... 139/425 A
4,592,396 A * 6/1986 Borel et al. ..... 139/425 A
4,832,090 A * 5/1989 Krenkel et al. ..... 139/383 A
5,114,777 A * 5/1992 Gaisser ..... 428/137
5,544,678 A * 8/1996 Barrett ..... 139/383 A
5,826,627 A * 10/1998 Seabrook et al. ..... 139/383 A
5,839,479 A * 11/1998 Gulya et al. ..... 139/383 A
5,944,062 A * 8/1999 Gampe ..... 139/383 A
5,967,195 A * 10/1999 Ward ..... 139/383 A
6,123,116 A * 9/2000 Ward et al. ..... 139/383 A
6,145,550 A 11/2000 Ward ..... 139/383
6,240,973 B1 6/2001 Stone et al. ..... 139/383
6,244,306 B1 6/2001 Troughton ..... 139/383
6,334,467 B1 * 1/2002 Barrett et al. ..... 139/383 A
6,581,645 B1 * 6/2003 Johnson et al. ..... 139/383 A
6,745,797 B2 * 6/2004 Troughton ..... 139/383 A
6,810,917 B2 * 11/2004 Stone ..... 139/383 A
6,827,821 B2 * 12/2004 Brewster et al. ..... 162/358.2
6,926,043 B2 * 8/2005 Quigley et al. ..... 139/383 A
6,989,079 B2 * 1/2006 Johnson et al. ..... 162/348

(Continued)

FOREIGN PATENT DOCUMENTS

EP 0 269 070 11/1987
WO WO 02/014601 8/2001

*Primary Examiner*—Bobby H Muromoto, Jr.
(74) *Attorney, Agent, or Firm*—Taylor & Aust, P.C.

(57) ABSTRACT

A paper making composite forming fabric including paper side weft and warp yarns and wear side warp yarns and bindery yarns. The paper side wefts and the binder yarns being interwoven with the paper side warp yarns. The binder yarns being interwoven with the wear side warps. A total number of paper side and wear side warp yarns per weave repeat is greater than 24. An internal binder float length is between 2 and 4. The fabric has an interchange points percentage value of less than 20 and a binder interchange points as a percentage of total machine direction yarns value of less than 10.

16 Claims, 33 Drawing Sheets

U.S. PATENT DOCUMENTS

| | | | | |
|---|---|---|---|---|
| 7,007,722 | B2 * | 3/2006 | Quigley et al. | 139/383 A |
| 7,108,020 | B2 * | 9/2006 | Stone | 139/383 A |
| 2004/0104005 | A1 * | 6/2004 | Brewster et al. | 162/358.2 |
| 2004/0118473 | A1 * | 6/2004 | Hay et al. | 139/383 R |
| 2004/0238062 | A1 * | 12/2004 | Quigley et al. | 139/383 A |
| 2004/0238063 | A1 * | 12/2004 | Stone | 139/383 A |
| 2005/0103397 | A1 * | 5/2005 | Quigley et al. | 139/383 A |
| 2006/0231154 | A1 * | 10/2006 | Hay | 139/383 A |

* cited by examiner

| | | |
|---|---|---|
| | T1 | 30 29 28 27 26 25 24 23 22 21 |
| | B1 | 50 49 48 47 46 45 44 43 42 41 |
| 2B | 62a/b | 30 29 28 27 26 25 24 23 22 21 |
| | | 50 49 48 47 46 45 44 43 42 41 |
| | T2 | 30 29 28 27 26 25 24 23 22 21 |
| | B2 | 50 49 48 47 46 45 44 43 42 41 |
| 2A | 61a/b | 30 29 28 27 26 25 24 23 22 21 |
| | | 50 49 48 47 46 45 44 43 42 41 |
| | T3 | 30 29 28 27 26 25 24 23 22 21 |
| | B3 | 50 49 48 47 46 45 44 43 42 41 |
| 2J | 70a/b | 30 29 28 27 26 25 24 23 22 21 |
| | | 50 49 48 47 46 45 44 43 42 41 |
| | T4 | 30 29 28 27 26 25 24 23 22 21 |
| | B4 | 50 49 48 47 46 45 44 43 42 41 |
| 2I | 69a/b | 30 29 28 27 26 25 24 23 22 21 |
| | | 50 49 48 47 46 45 44 43 42 41 |
| | T5 | 30 29 28 27 26 25 24 23 22 21 |
| | B5 | 50 49 48 47 46 45 44 43 42 41 |
| 2H | 68a/b | 30 29 28 27 26 25 24 23 22 21 |
| | | 50 49 48 47 46 45 44 43 42 41 |
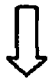
Fig.1 page 2
Fig.1 page 1

| | | |
|---|---|---|
| | T6 | 30 29 28 27 26 25 24 23 22 21 |
| | B6 | 50 49 48 47 46 45 44 43 42 41 |
| 2G | 67a/b | 30 29 28 27 26 25 24 23 22 21 |
| | | 50 49 48 47 46 45 44 43 42 41 |
| | T7 | 30 29 28 27 26 25 24 23 22 21 |
| | B7 | 50 49 48 47 46 45 44 43 42 41 |
| 2F | 66a/b | 30 29 28 27 26 25 24 23 22 21 |
| | | 50 49 48 47 46 45 44 43 42 41 |
| | T8 | 30 29 28 27 26 25 24 23 22 21 |
| | B8 | 50 49 48 47 46 45 44 43 42 41 |
| 2E | 65a/b | 30 29 28 27 26 25 24 23 22 21 |
| | | 50 49 48 47 46 45 44 43 42 41 |
| | T9 | 30 29 28 27 26 25 24 23 22 21 |
| | B9 | 50 49 48 47 46 45 44 43 42 41 |
| 2D | 64a/b | 30 29 28 27 26 25 24 23 22 21 |
| | | 50 49 48 47 46 45 44 43 42 41 |
| | T10 | 30 29 28 27 26 25 24 23 22 21 |
| | B10 | 50 49 48 47 46 45 44 43 42 41 |
| 2C | 63a/b | 30 29 28 27 26 25 24 23 22 21 |
| | | 50 49 48 47 46 45 44 43 42 41 |

Fig.1 page 2 a)
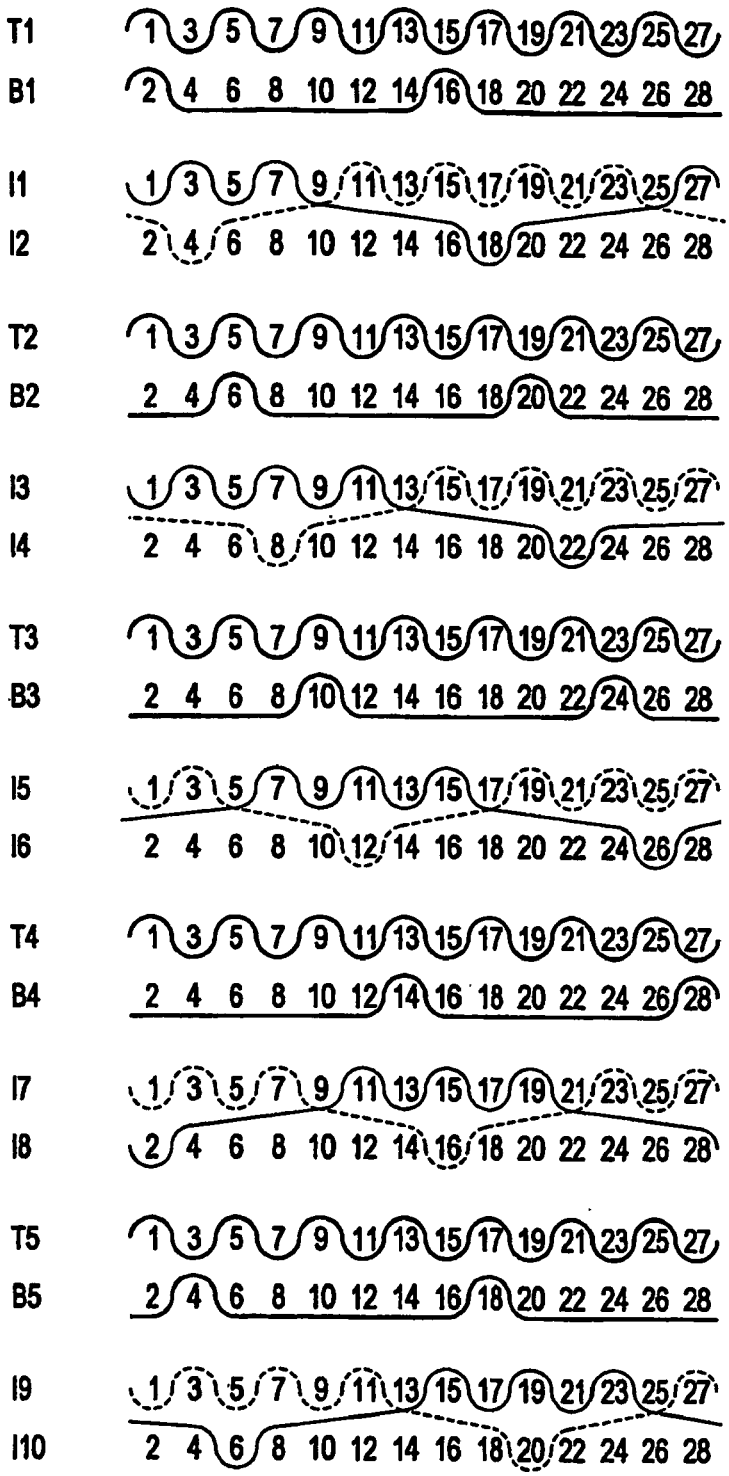
Fig.2 page 2
Fig.2 page 1

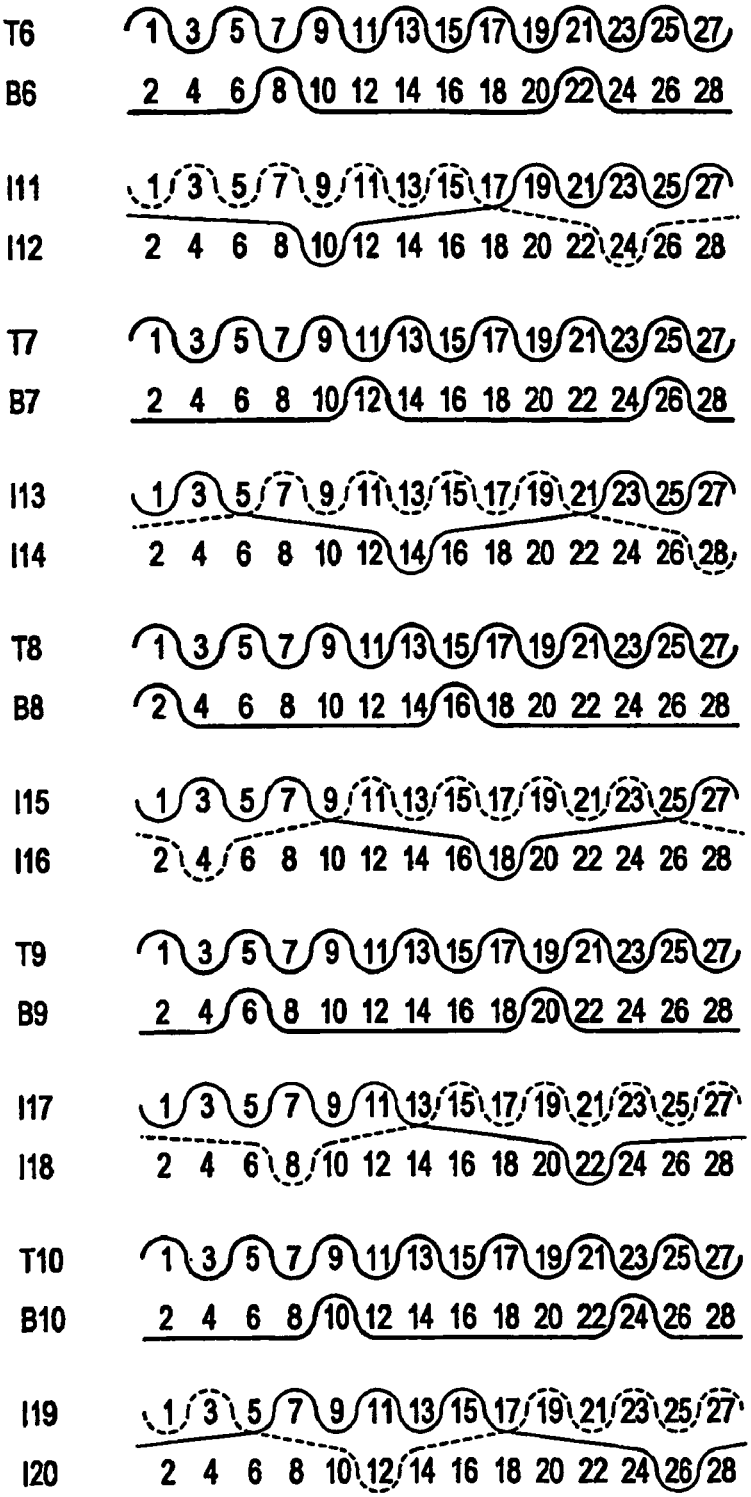
Fig.2 page 3
Fig.2 page 2

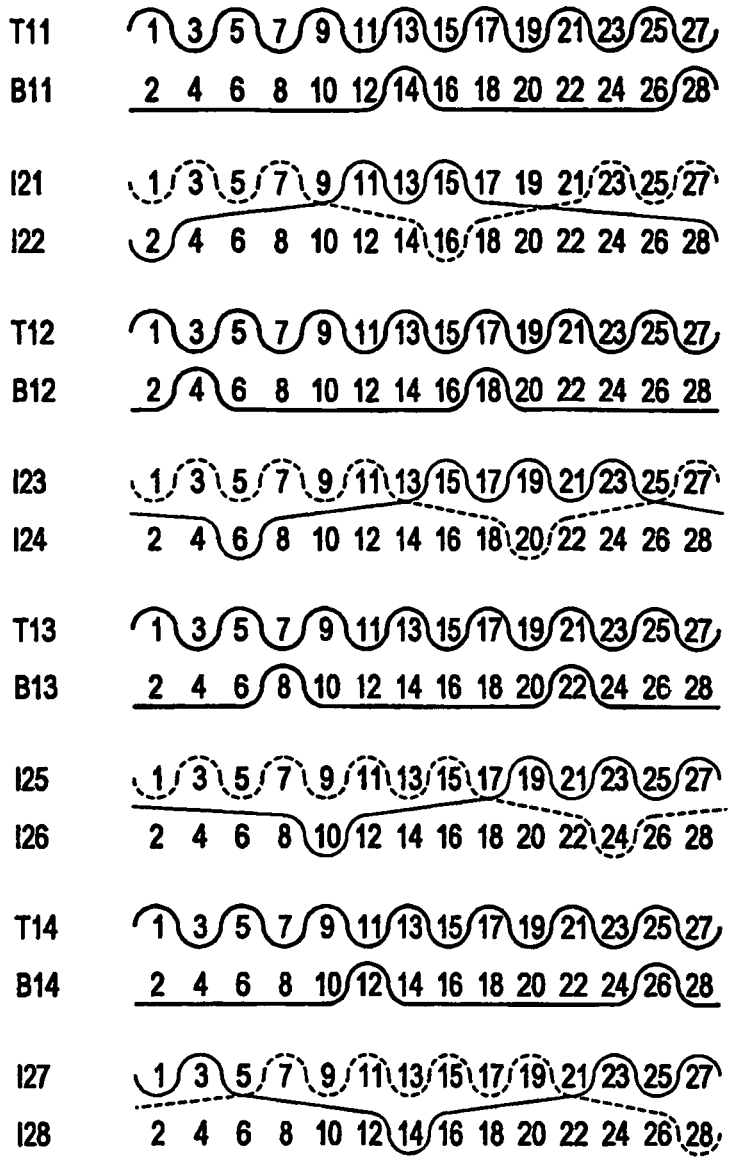
b)
| | 1 | 3 | 5 | 7 | 9 | 11 | 13 | 15 | 17 | 19 | 21 | 23 | 25 | 27 |
|---|---|---|---|---|---|---|---|---|---|---|---|---|---|---|
| I1/2 | | | | | X | | | | | | | | X | |
| I3/4 | X | | | | | | X | | | | | | | |
| I5/6 | | | X | | | | | | X | | | | | |
| I7/8 | | | | | X | | | | | | X | | | |
| I9/10 | | | | | | | X | | | | | | X | |
| I11/12 | X | | | | | | | | X | | | | | |
| I13/14 | | | X | | | | | | | | X | | | |
| I15/16 | | | | | X | | | | | | | | X | |
| I17/18 | X | | | | | | X | | | | | | | |
| I19/20 | | | X | | | | | | X | | | | | |
| I21/22 | | | | | X | | | | | | X | | | |
| I23/24 | | | | | | | X | | | | | | X | |
| I25/26 | X | | | | | | | | X | | | | | |
| I27/28 | | | X | | | | | | | | X | | | |
Interchange points - paperside
Fig.2 page 3 a)
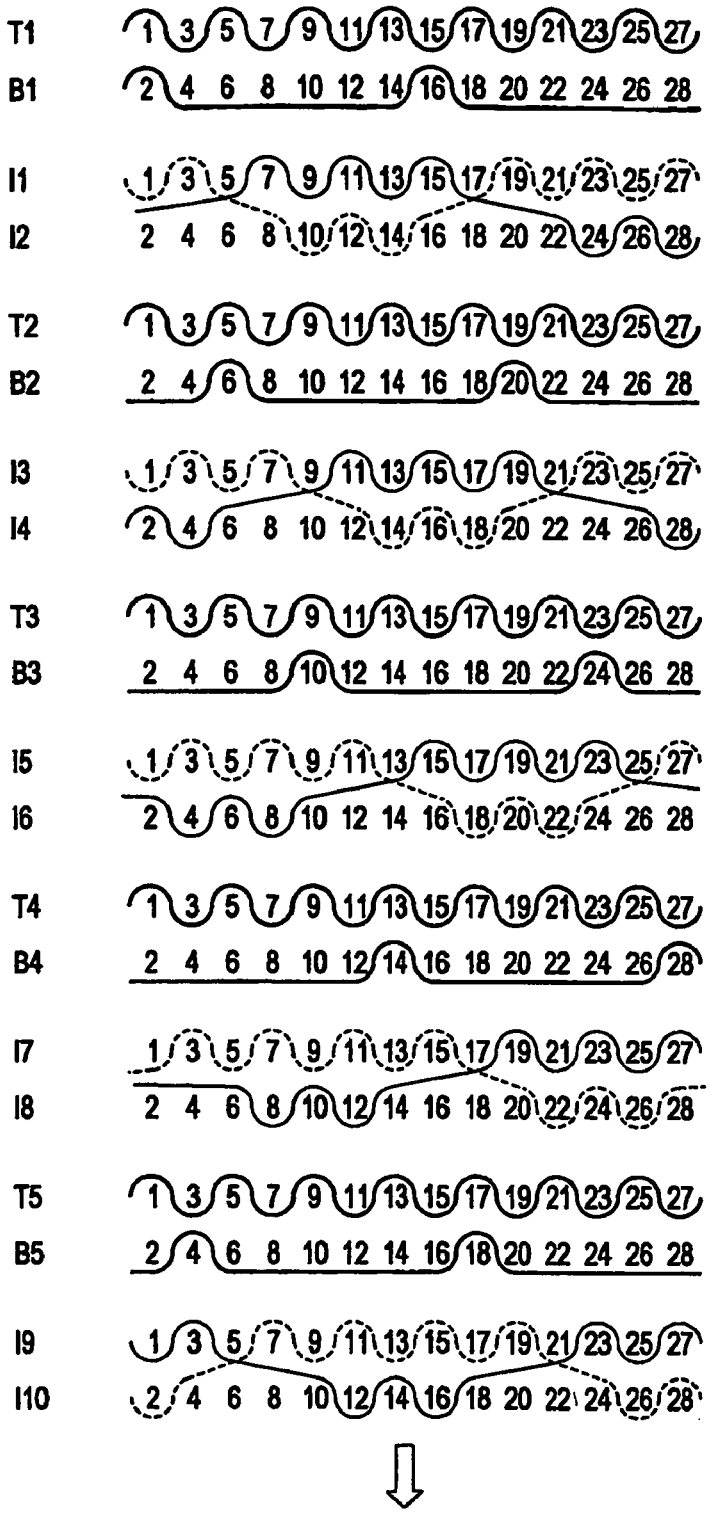
Fig.3 page 2
Fig.3 page 1

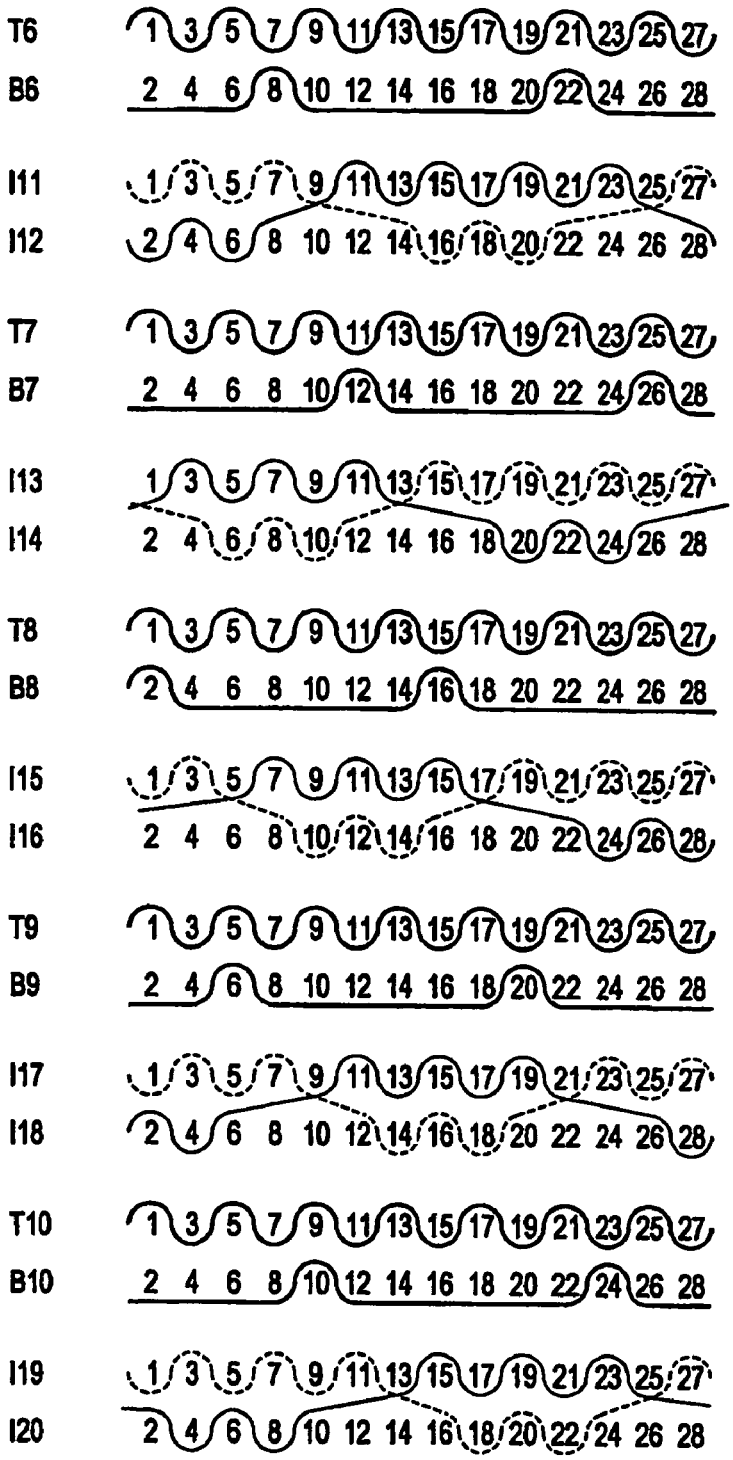
Fig.3 page 3
Fig.3 page 2

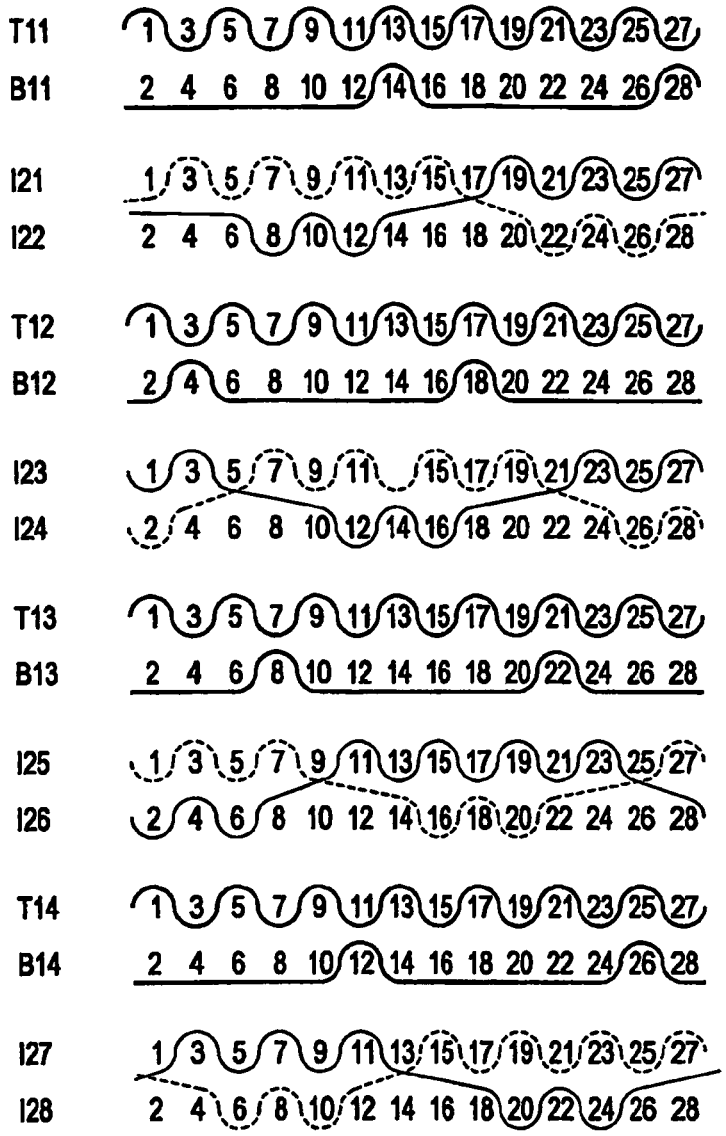
b)
| | 1 | 3 | 5 | 7 | 9 | 11 | 13 | 15 | 17 | 19 | 21 | 23 | 25 | 27 |
|---|---|---|---|---|---|---|---|---|---|---|---|---|---|---|
| I1/2 | | | X | | | | | | X | | | | | |
| I3/4 | | | | | X | | | | | | X | | | |
| I5/6 | | | | | | | X | | | | | | X | |
| I7/8 | X | | | | | | | | X | | | | | |
| I9/10 | | | X | | | | | | | | X | | | |
| I11/12 | | | | | X | | | | | | | | X | |
| I13/14 | X | | | | | | X | | | | | | | |
| I15/16 | | | X | | | | | | X | | | | | |
| I17/18 | | | | | X | | | | | | X | | | |
| I19/20 | | | | | | | X | | | | | | X | |
| I21/22 | X | | | | | | | | X | | | | | |
| I23/24 | | | X | | | | | | | | X | | | |
| I25/26 | | | | | X | | | | | | | | X | |
| I27/28 | | | | | | | X | | | | | | | |
Interchange points - paperside
Fig.3 page 3 a)
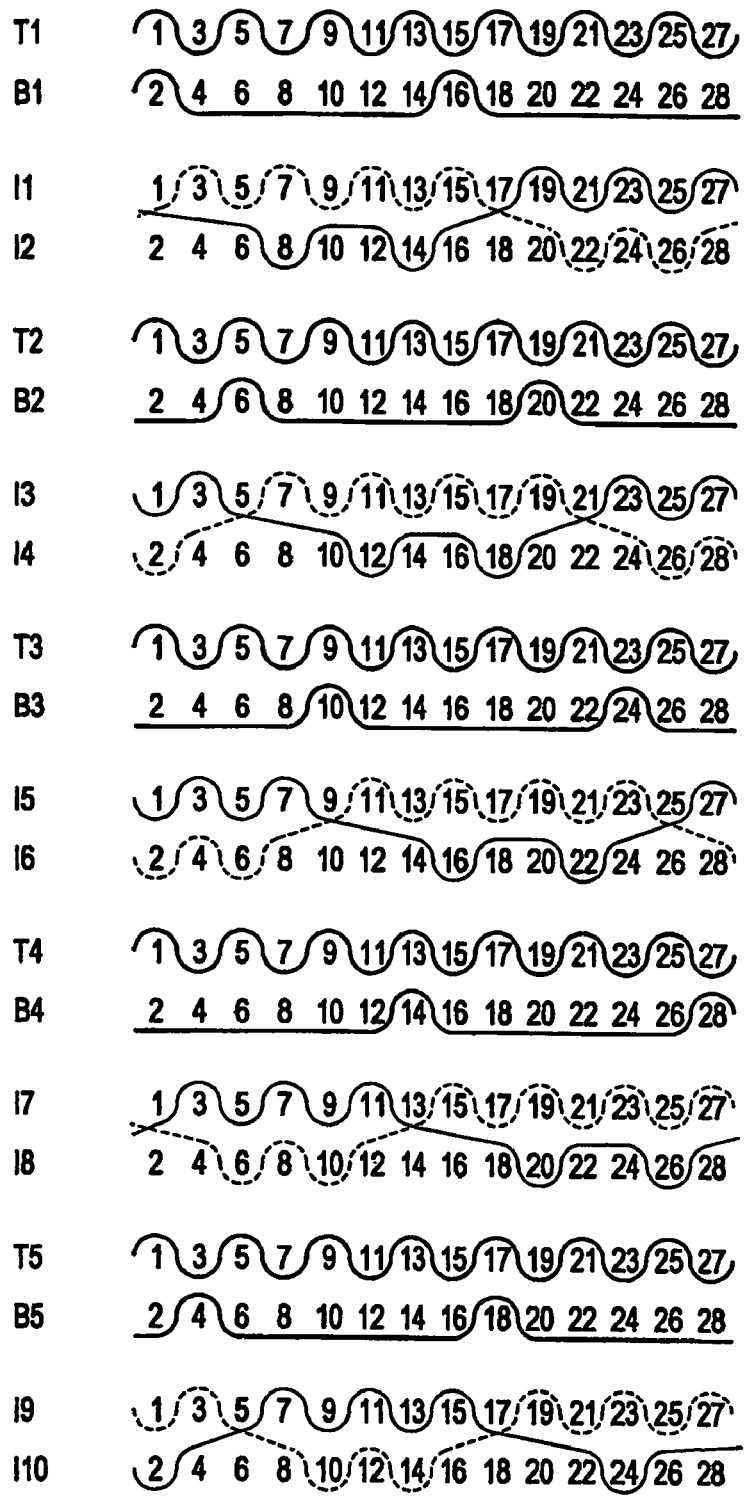
Fig.4 page 2
Fig.4 page 1

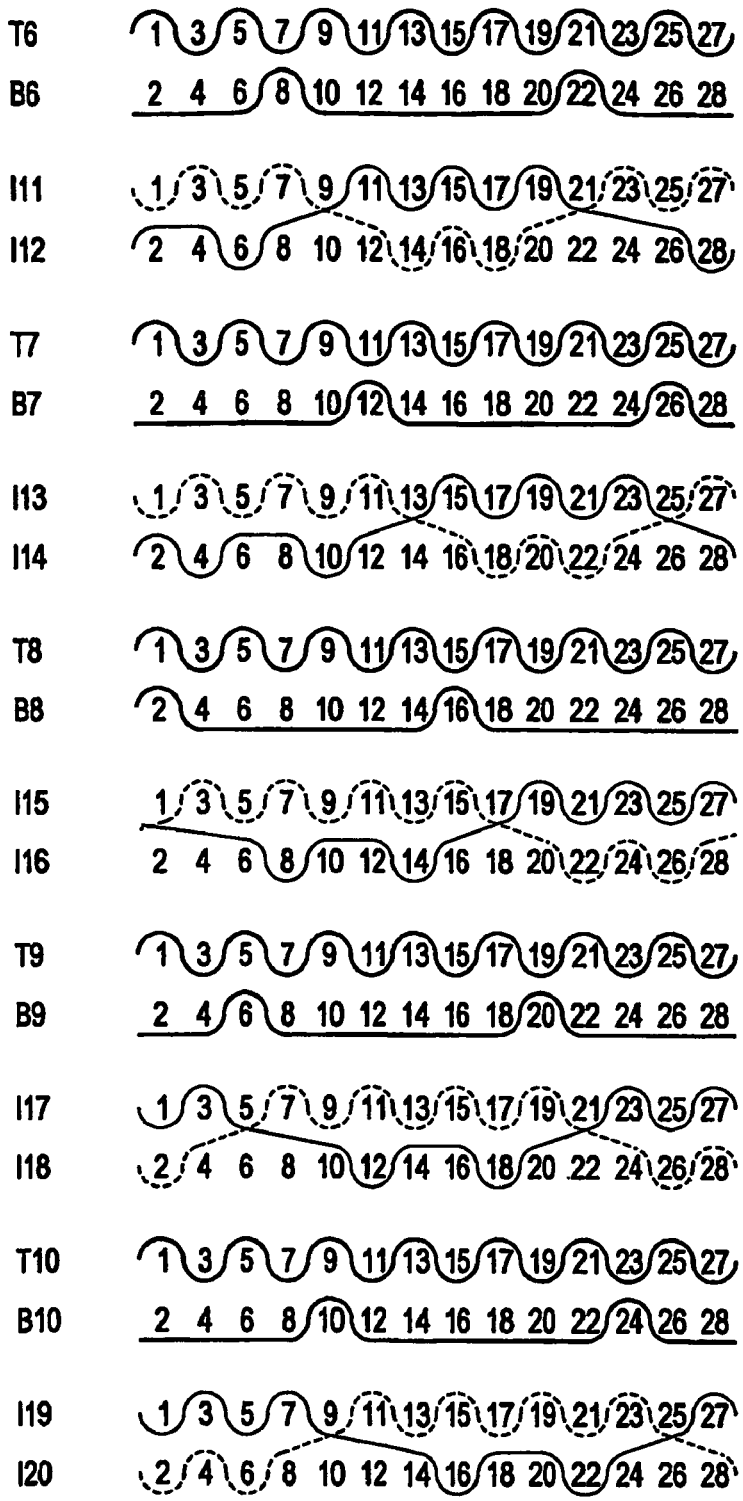
Fig.4 page 3
Fig.4 page 2

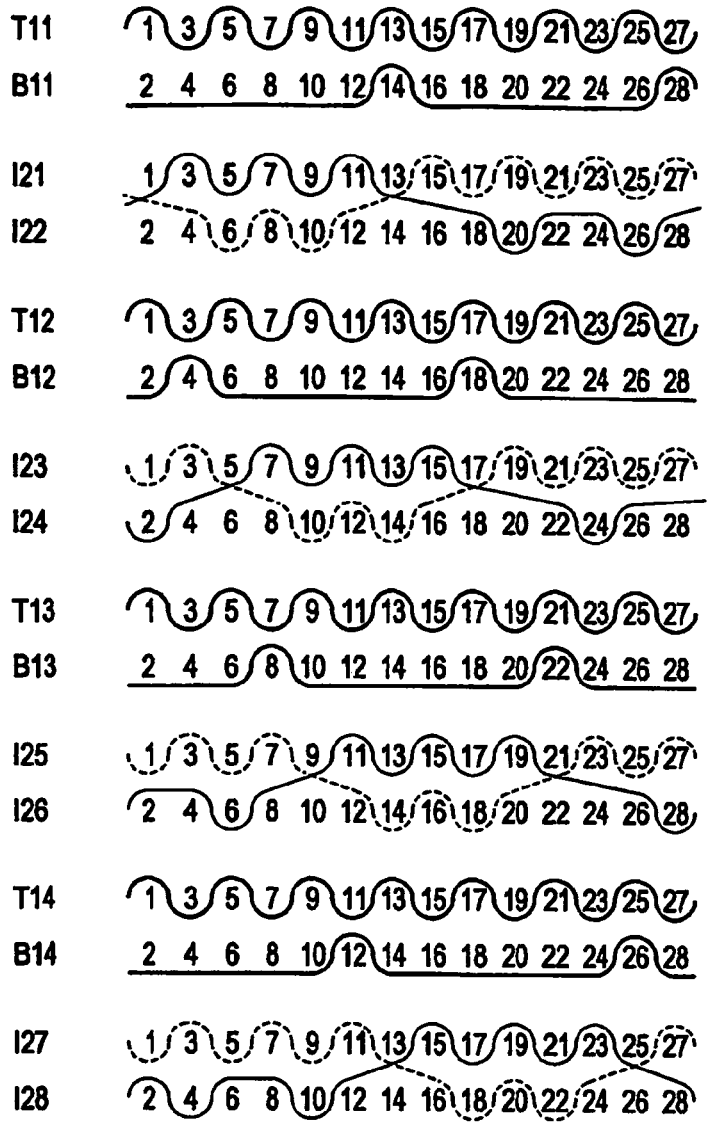
b)
| | 1 | 3 | 5 | 7 | 9 | 11 | 13 | 15 | 17 | 19 | 21 | 23 | 25 | 27 |
|---|---|---|---|---|---|---|---|---|---|---|---|---|---|---|
| I1/2 | | | X | | | | | | X | | | | | |
| I3/4 | | | | | X | | | | | | X | | | |
| I5/6 | | | | | | | X | | | | | | X | |
| I7/8 | X | | | | | | | | X | | | | | |
| I9/10 | | | X | | | | | | | | X | | | |
| I11/12 | | | | | X | | | | | | | | X | |
| I13/14 | X | | | | | | X | | | | | | | |
| I15/16 | | | X | | | | | | X | | | | | |
| I17/18 | | | | | X | | | | | | X | | | |
| I19/20 | | | | | | | X | | | | | | X | |
| I21/22 | X | | | | | | | | X | | | | | |
| I23/24 | | | X | | | | | | | | X | | | |
| I25/26 | | | | | X | | | | | | | | X | |
| I27/28 | | | | | | | X | | | | | | | |
Interchange points - paperside
Fig.4 page 3 a)
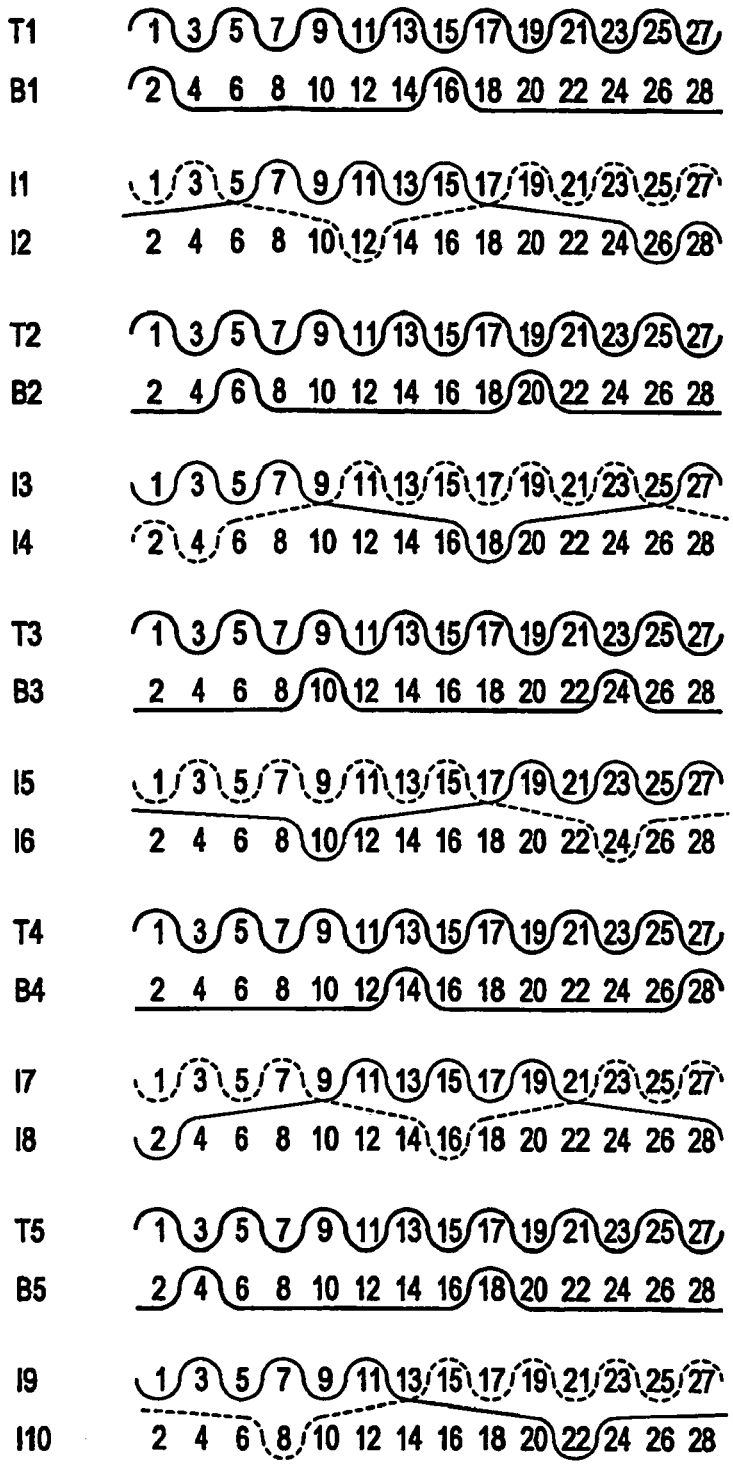
Fig.5 page 2
Fig.5 page 1

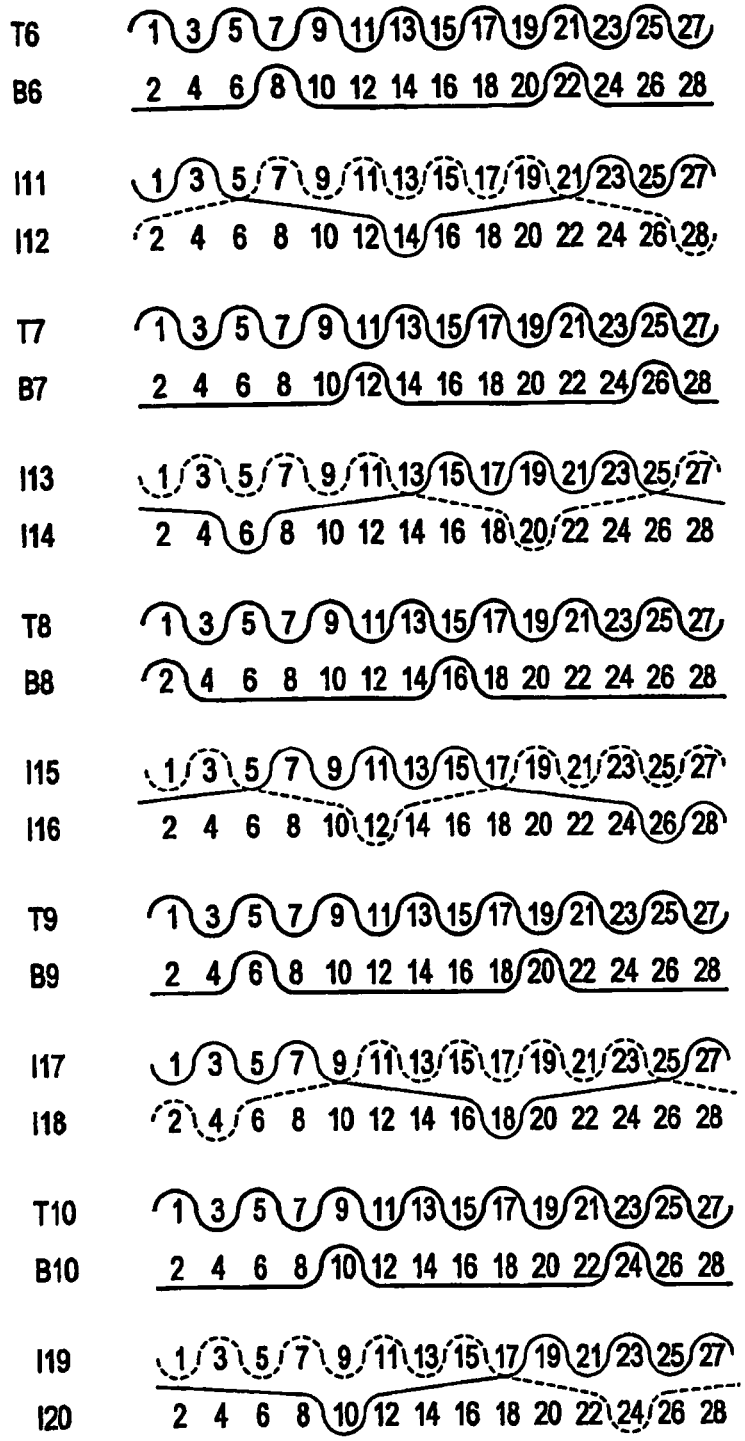
Fig.5 page 3
Fig.5 page 2

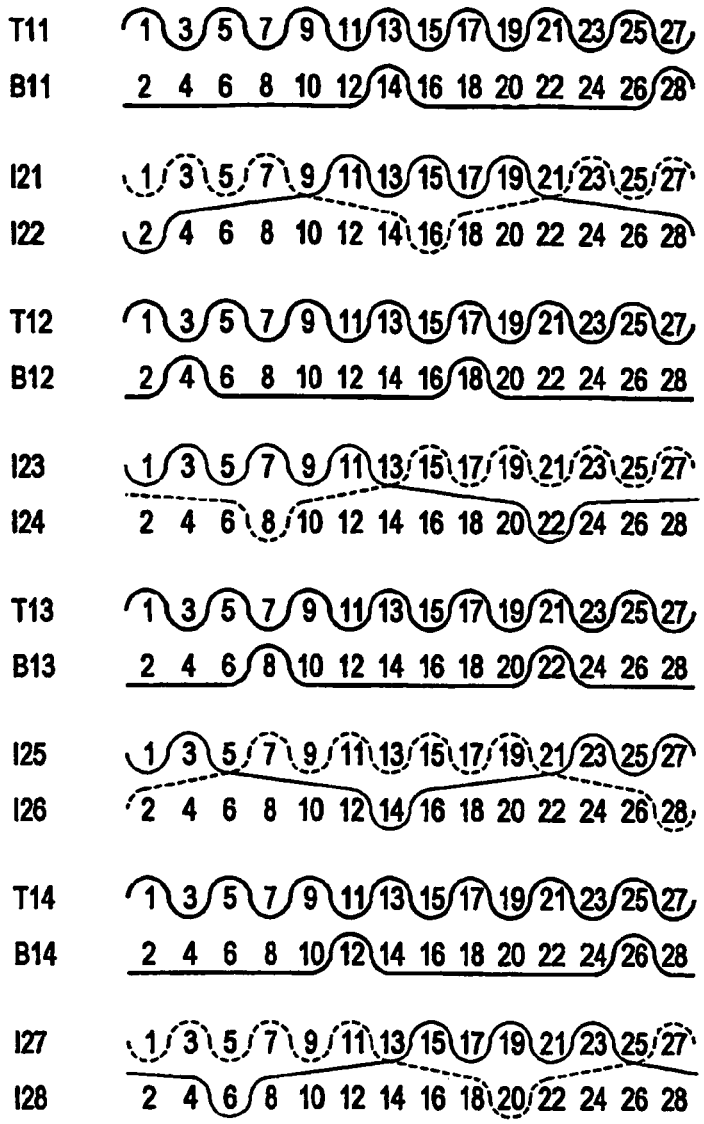
b)
| | 1 | 3 | 5 | 7 | 9 | 11 | 13 | 15 | 17 | 19 | 21 | 23 | 25 | 27 |
|---|---|---|---|---|---|---|---|---|---|---|---|---|---|---|
| I1/2 | | | X | | | | | | X | | | | | |
| I3/4 | | | | | X | | | | | | | | X | |
| I5/6 | X | | | | | | | | X | | | | | |
| I7/8 | | | | | X | | | | | | X | | | |
| I9/10 | X | | | | | | X | | | | | | | |
| I11/12 | | | X | | | | | | | | X | | | |
| I13/14 | | | | | | | X | | | | | | X | |
| I15/16 | | | X | | | | | | | | | | | |
| I17/18 | | | | | X | | | | X | | | | X | |
| I19/20 | X | | | | | | | | | | | | | |
| I21/22 | | | | | X | | | | X | | X | | | |
| I23/24 | X | | | | | | X | | | | | | | |
| I25/26 | | | X | | | | | | | | X | | | |
| I27/28 | | | | | | | X | | | | | | X | |
Interchange points - paperside
Fig.5 page 3 a)
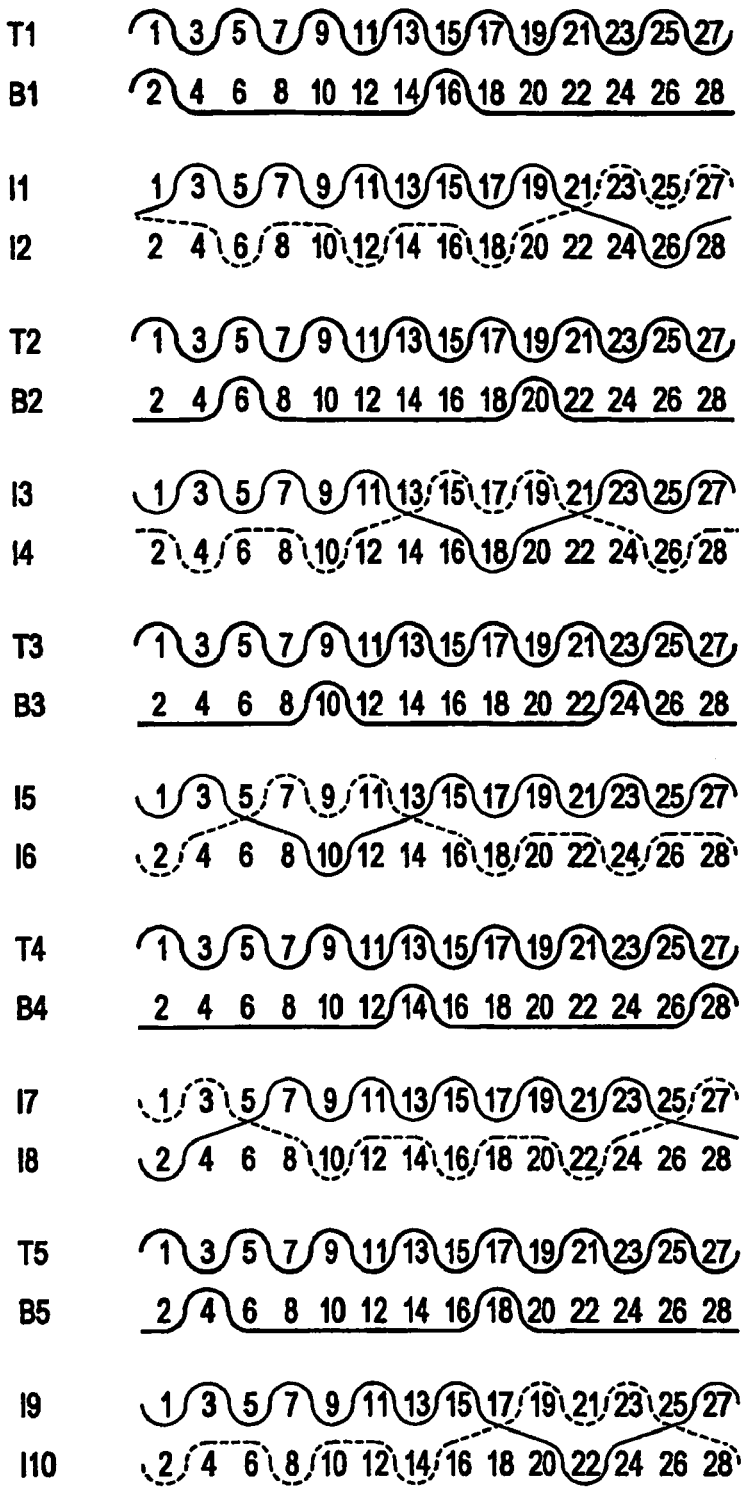
Fig.6 page 2
Fig.6 page 1

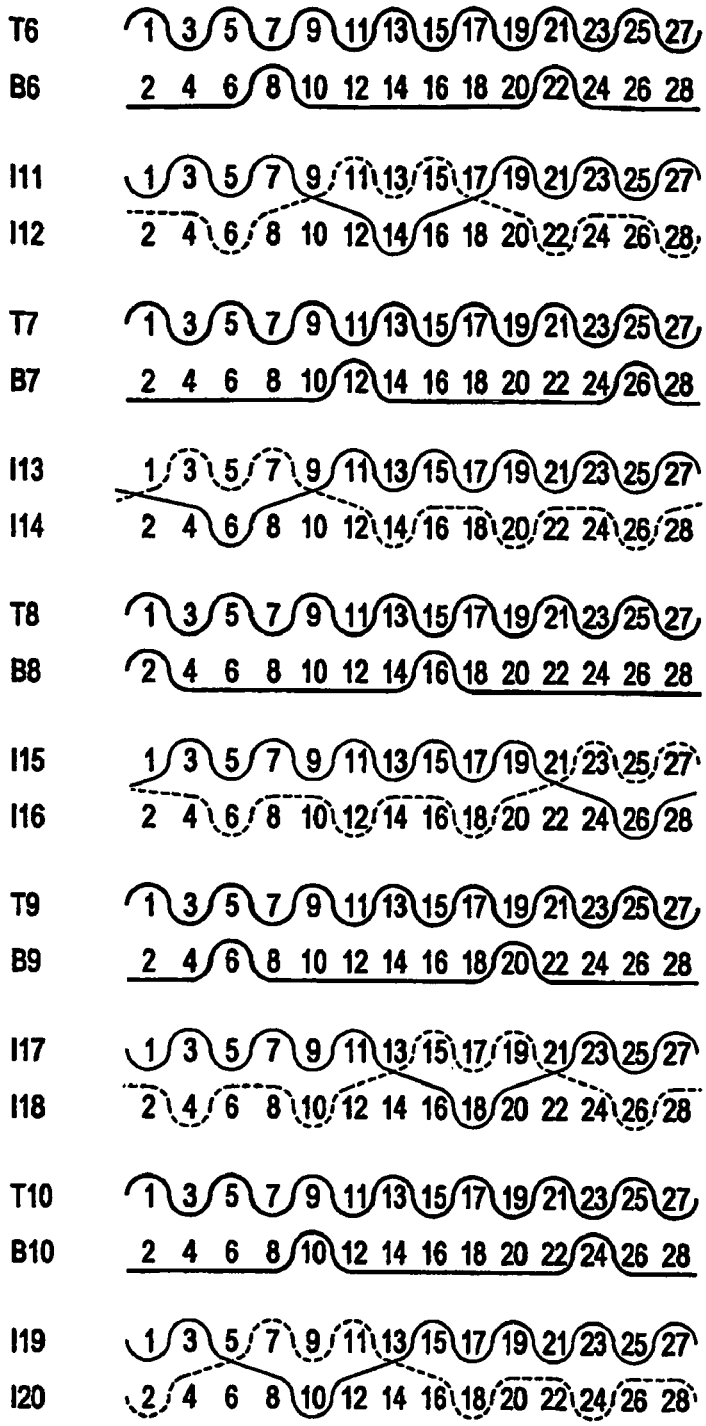
Fig.6 page 3
Fig.6 page 2

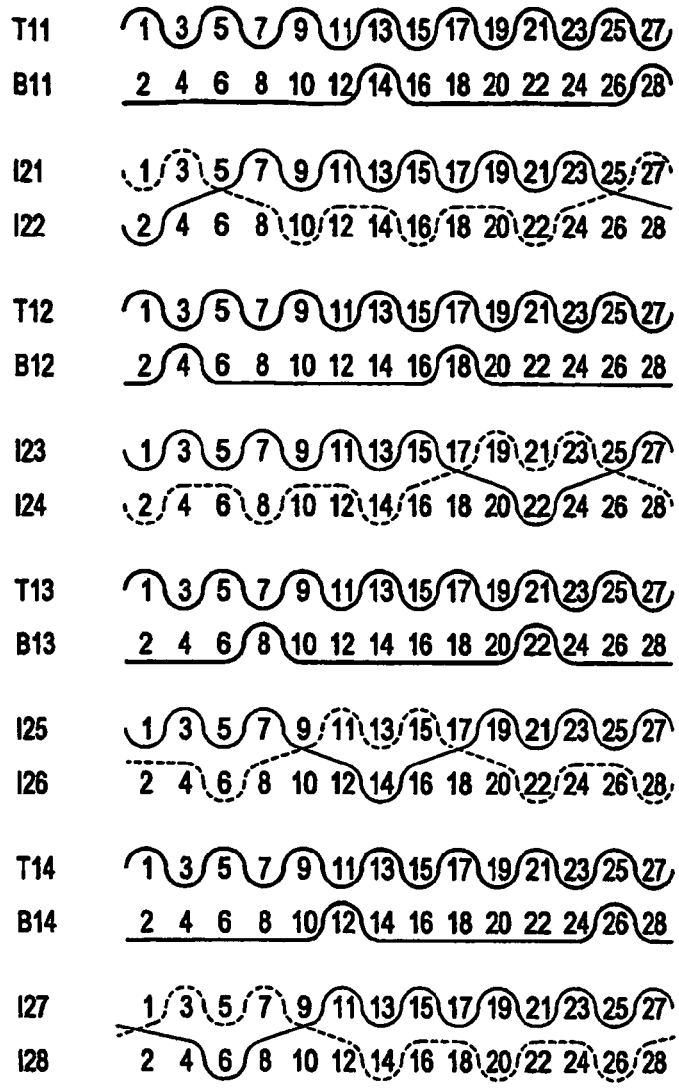
b)
| | 1 | 3 | 5 | 7 | 9 | 11 | 13 | 15 | 17 | 19 | 21 | 23 | 25 | 27 |
|---|---|---|---|---|---|---|---|---|---|---|---|---|---|---|
| I1/2 | X | | | | | | | | | | X | | | |
| I3/4 | | | | | | | X | | | | X | | | |
| I5/6 | | | X | | | | X | | | | | | | |
| I7/8 | | | X | | | | | | | | | | X | |
| I9/10 | | | | | | | | | X | | | | X | |
| I11/12 | | | | | X | | | | X | | | | | |
| I13/14 | X | | | | X | | | | | | | | | |
| I15/16 | X | | | | | | | | | | X | | | |
| I17/18 | | | | | | | X | | | | X | | | |
| I19/20 | | | X | | | | X | | | | | | | |
| I21/22 | | | X | | | | | | | | | | X | |
| I23/24 | | | | | | | | | X | | | | X | |
| I25/26 | | | | | X | | | | X | | | | | |
| I27/28 | X | | | | X | | | | | | | | | |
Interchange points - paperside
Fig.6 page 3 a)
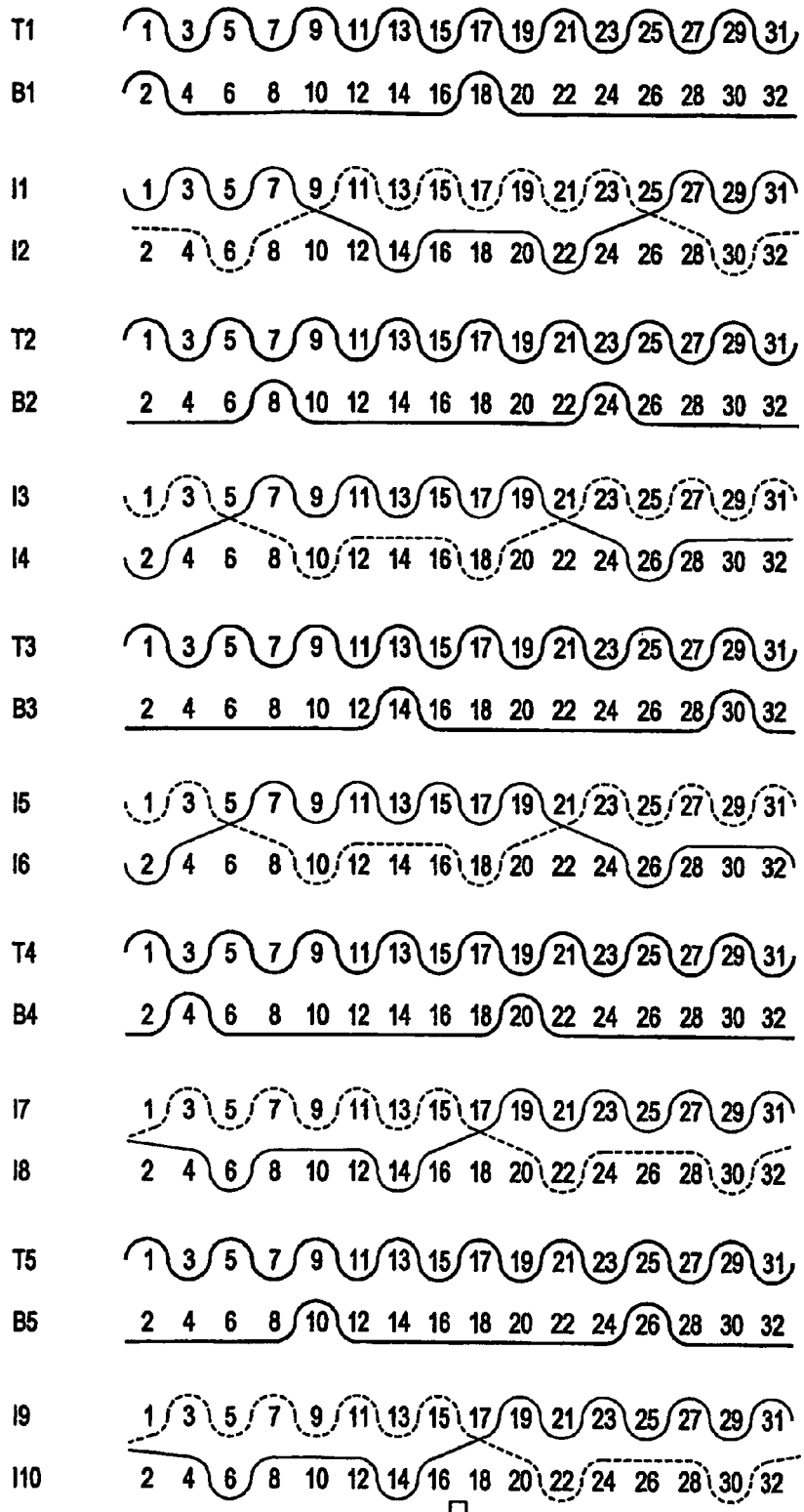
Fig.7 page 2
Fig.7 page 1

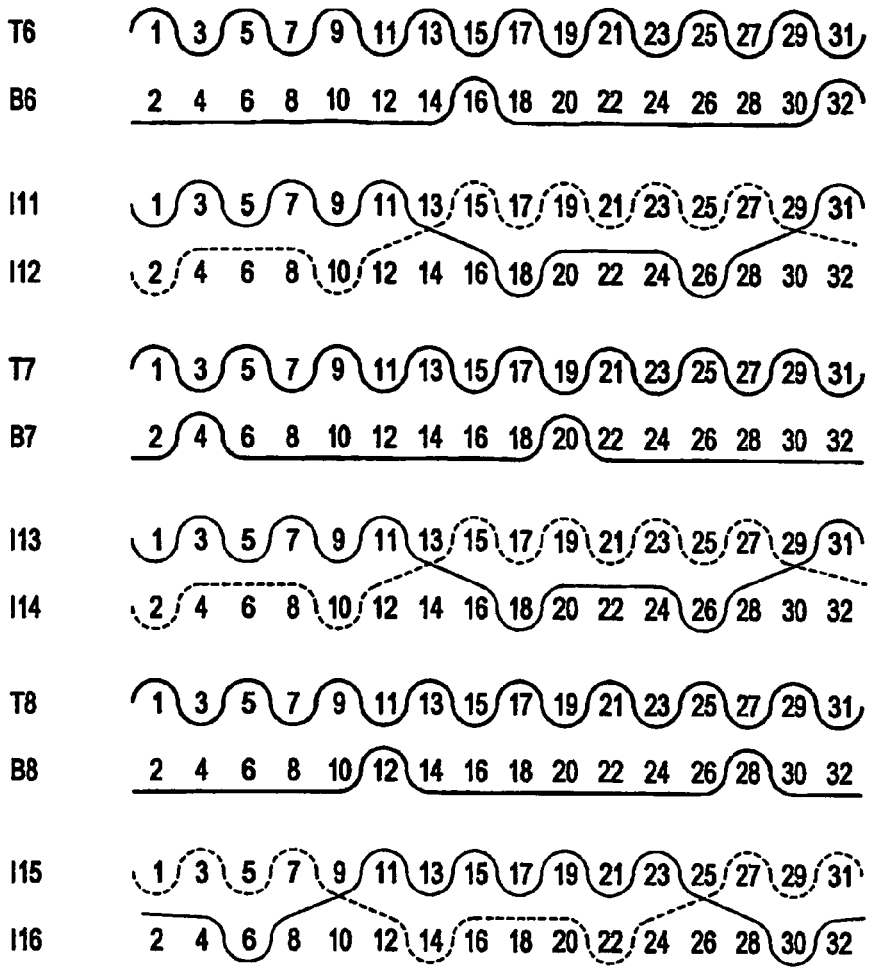
b)
| | 1 | 3 | 5 | 7 | 9 | 11 | 13 | 15 | 17 | 19 | 21 | 23 | 25 | 27 | 29 | 31 |
|---|---|---|---|---|---|---|---|---|---|---|---|---|---|---|---|---|
| I1/2 | | | | | X | | | | | | | | X | | | |
| I3/4 | | | X | | | | | | | | X | | | | | |
| I5/6 | | | X | | | | | | | | X | | | | | |
| I7/8 | X | | | | | | | | X | | | | | | | |
| I9/10 | X | | | | | | | | X | | | | | | | |
| I11/12 | | | | | | | X | | | | | | | | X | |
| I13/14 | | | | | | | X | | | | | | | | X | |
| I15/16 | | | | | X | | | | | | | | X | | | |
| I17/18 | | | | | | | | | | | | | X | | | |
| I19/20 | | | X | | | | | | | | X | | | | | |
| I21/22 | | | X | | | | | | | | X | | | | | |
| I23/24 | X | | | | | | | | X | | | | | | | |
| I25/26 | X | | | | | | | | X | | | | | | | |
| I27/28 | | | | | | | X | | | | | | | | X | |
| I29/30 | | | | | | | X | | | | | | | | X | |
| I31/32 | | | | | X | | | | | | | | X | | | |
Interchange points - paperside
Fig.7 page 2 a)

| | |
|---|---|
| T1 | 1 3 5 7 9 11 13 15 17 19 21 23 25 27 29 31 33 35 37 39 |
| B1 | 2 4 6 8 10 12 14 16 18 20 22 24 26 28 30 32 34 36 38 40 |
| I1 | 1 3 5 7 9 11 13 15 17 19 21 23 25 27 29 31 33 35 37 39 |
| I2 | 2 4 6 8 10 12 14 16 18 20 22 24 26 28 30 32 34 36 38 40 |
| T2 | 1 3 5 7 9 11 13 15 17 19 21 23 25 27 29 31 33 35 37 39 |
| B2 | 2 4 6 8 10 12 14 16 18 20 22 24 26 28 30 32 34 36 38 40 |
| I3 | 1 3 5 7 9 11 13 15 17 19 21 23 25 27 29 31 33 35 37 39 |
| I4 | 2 4 6 8 10 12 14 16 18 20 22 24 26 28 30 32 34 36 38 40 |
| T3 | 1 3 5 7 9 11 13 15 17 19 21 23 25 27 29 31 33 35 37 39 |
| B3 | 2 4 6 8 10 12 14 16 18 20 22 24 26 28 30 32 34 36 38 40 |
| I5 | 1 3 5 7 9 11 13 15 17 19 21 23 25 27 29 31 33 35 37 39 |
| I6 | 2 4 6 8 10 12 14 16 18 20 22 24 26 28 30 32 34 36 38 40 |
| T4 | 1 3 5 7 9 11 13 15 17 19 21 23 25 27 29 31 33 35 37 39 |
| B4 | 2 4 6 8 10 12 14 16 18 20 22 24 26 28 30 32 34 36 38 40 |
| I8 | 1 3 5 7 9 11 13 15 17 19 21 23 25 27 29 31 33 35 37 39 |
| I7 | 2 4 6 8 10 12 14 16 18 20 22 24 26 28 30 32 34 36 38 40 |
| T5 | 1 3 5 7 9 11 13 15 17 19 21 23 25 27 29 31 33 35 37 39 |
| B5 | 2 4 6 8 10 12 14 16 18 20 22 24 26 28 30 32 34 36 38 40 |
| I10 | 1 3 5 7 9 11 13 15 17 19 21 23 25 27 29 31 33 35 37 39 |
| I9 | 2 4 6 8 10 12 14 16 18 20 22 24 26 28 30 32 34 36 38 40 |
| T6 | 1 3 5 7 9 11 13 15 17 19 21 23 25 27 29 31 33 35 37 39 |
| B6 | 2 4 6 8 10 12 14 16 18 20 22 24 26 28 30 32 34 36 38 40 |
| I12 | 1 3 5 7 9 11 13 15 17 19 21 23 25 27 29 31 33 35 37 39 |
| I11 | 2 4 6 8 10 12 14 16 18 20 22 24 26 28 30 32 34 36 38 40 |

Fig.8 page 2

Fig.8 page 1

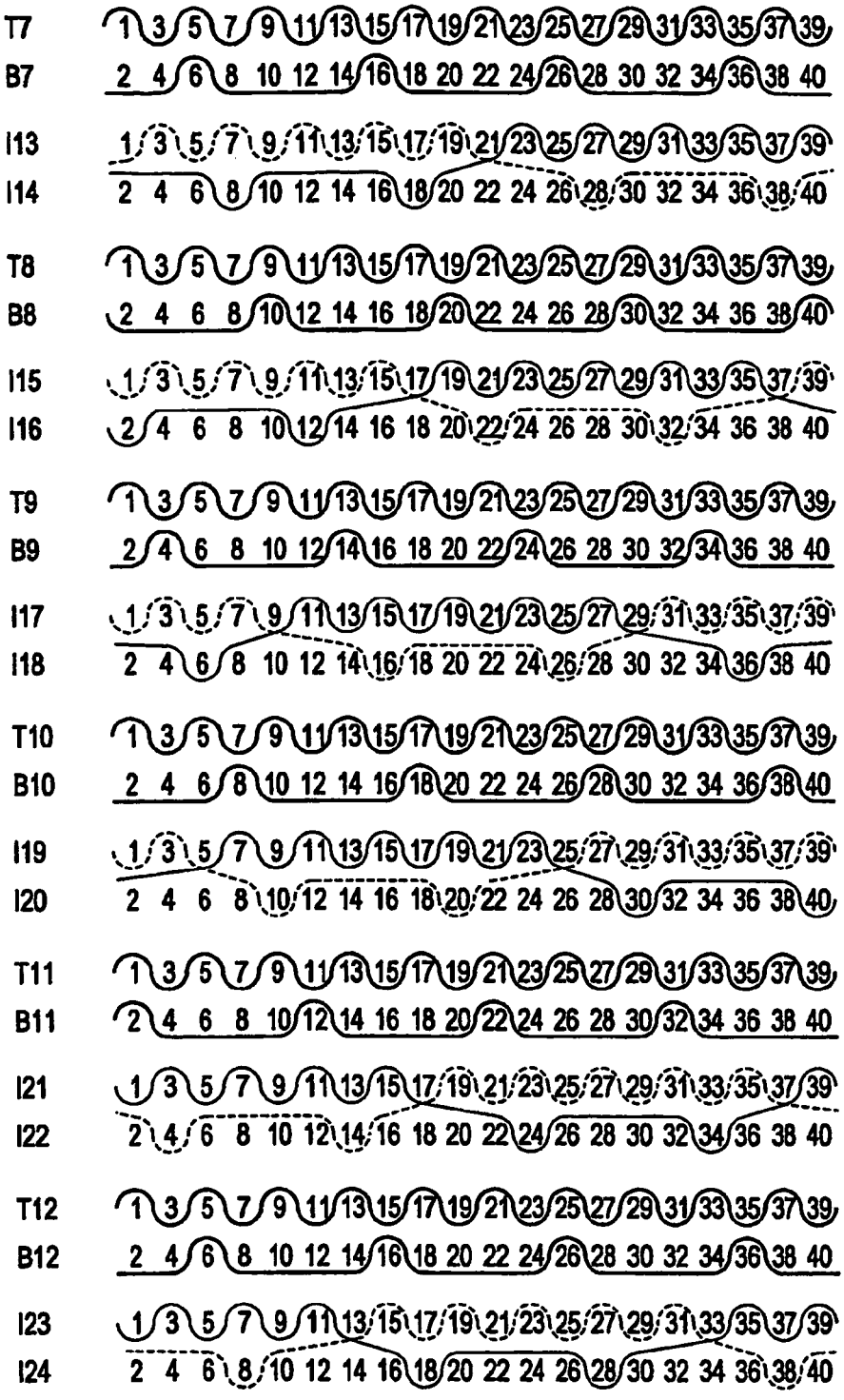
Fig.8 page 3
Fig.8 page 2

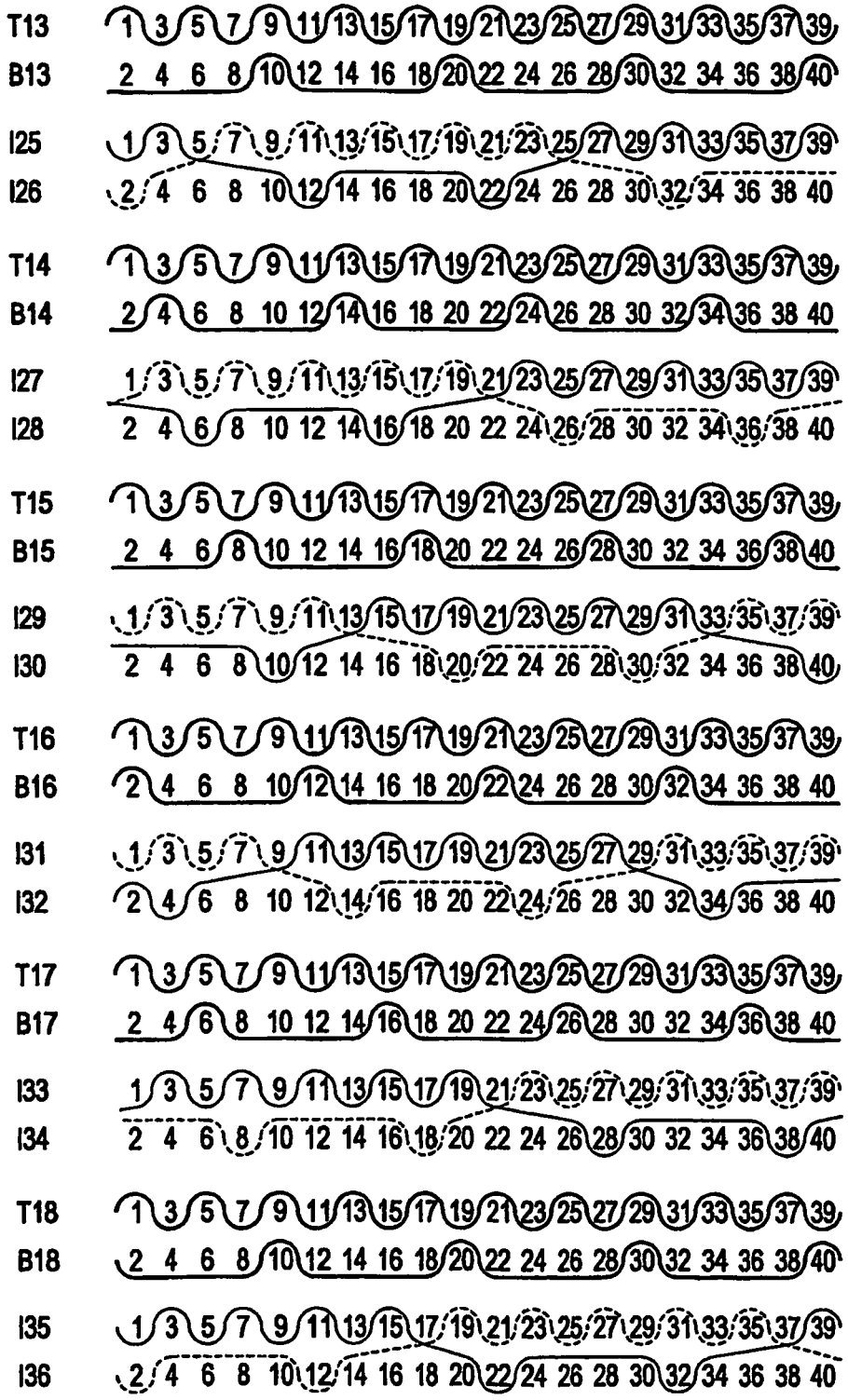
Fig.8 page 4
Fig.8 page 3

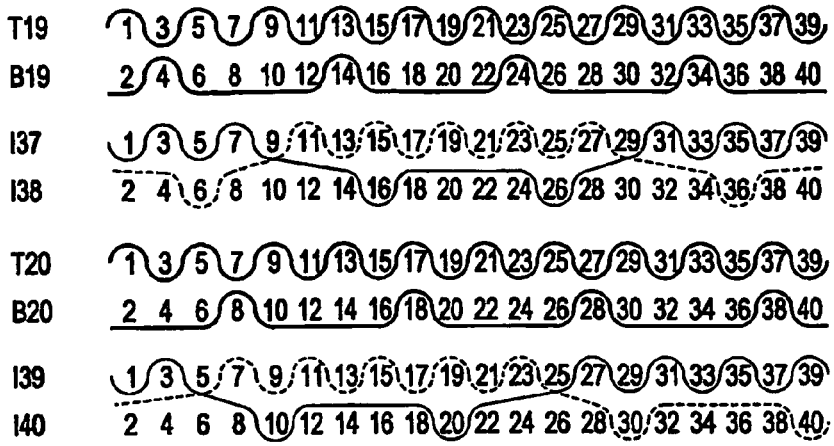
b)
| | 1 | 3 | 5 | 7 | 9 | 11 | 13 | 15 | 17 | 19 | 21 | 23 | 25 | 27 | 29 | 31 | 33 | 35 | 37 | 39 |
|---|---|---|---|---|---|---|---|---|---|---|---|---|---|---|---|---|---|---|---|---|
| I1/2 | | | | | | | | | X | | | | | | | | | | X | |
| I3/4 | | | | | | | X | | | | | | | | | | X | | | |
| I5/6 | | | X | | | | | | | | | | X | | | | | | | |
| I7/8 | X | | | | | | | | | | X | | | | | | | | | |
| I9/10 | | | | | | | X | | | | | | | | | | X | | | |
| I11/12 | | | | | X | | | | | | | | | | X | | | | | |
| I13/14 | X | | | | | | | | | | X | | | | | | | | | |
| I15/16 | | | | | | | | | X | | | | | | | | | X | | |
| I17/18 | | | | | X | | | | | | | | | | X | | | | | |
| I19/20 | | | X | | | | | | | | | | X | | | | | | | |
| I21/22 | | | | | | | | | X | | | | | | | | | | X | |
| I23/24 | | | | | | | X | | | | | | | | | | X | | | |
| I25/26 | | | X | | | | | | | | | | X | | | | | | | |
| I27/28 | X | | | | | | | | | | X | | | | | | | | | |
| I29/30 | | | | | | | X | | | | | | | | | | X | | | |
| I31/32 | | | | | X | | | | | | | | | | X | | | | | |
| I33/34 | X | | | | | | | | | | X | | | | | | | | | |
| I35/36 | | | | | | | | | X | | | | | | | | | X | | |
| I37/38 | | | | | X | | | | | | | | | | | | | | | |
| I39/40 | | | X | | | | | | | | | | X | | | | | | | |
Interchange points - paperside
Fig.8 page 4

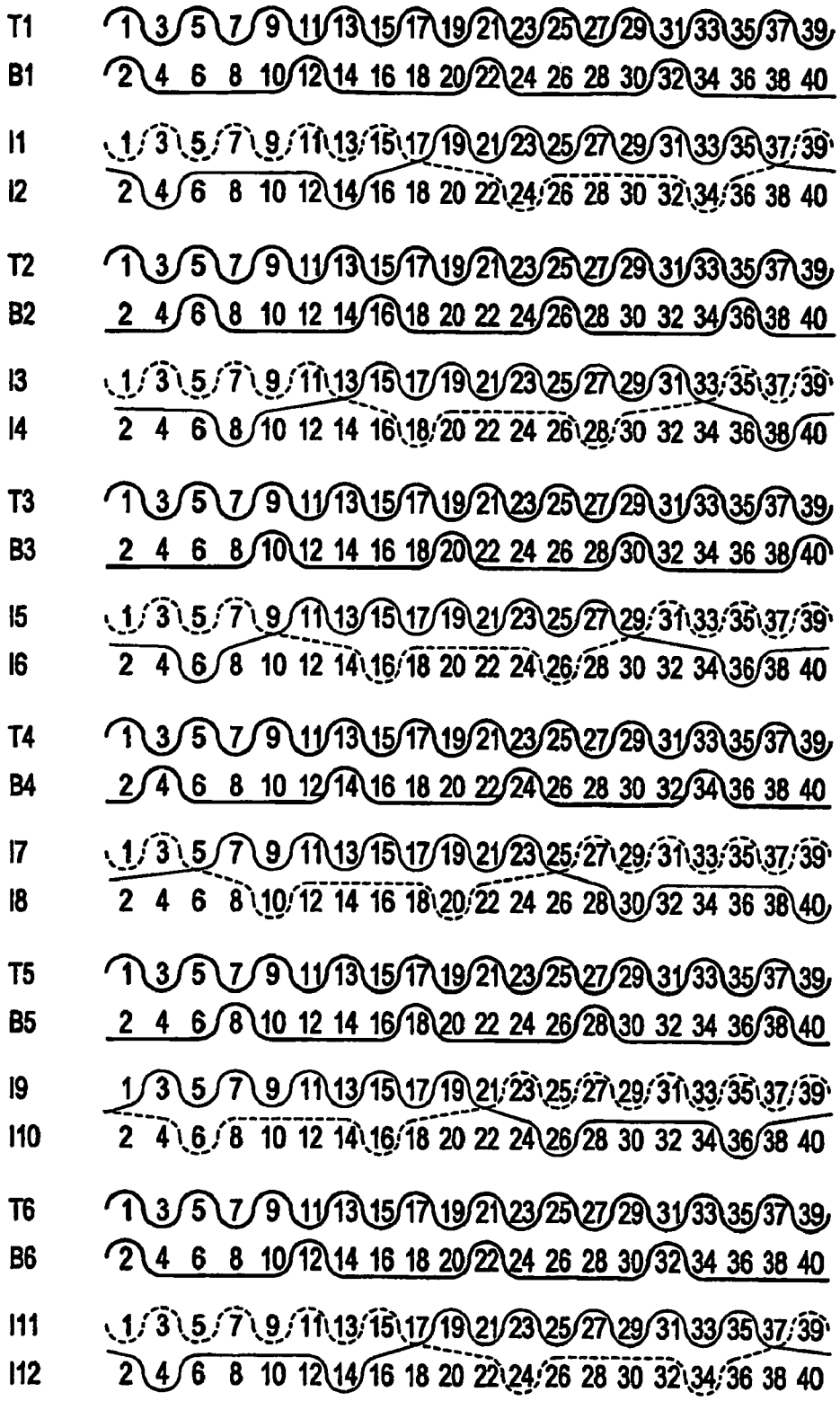
Fig.9 page 2
Fig.9 page 1

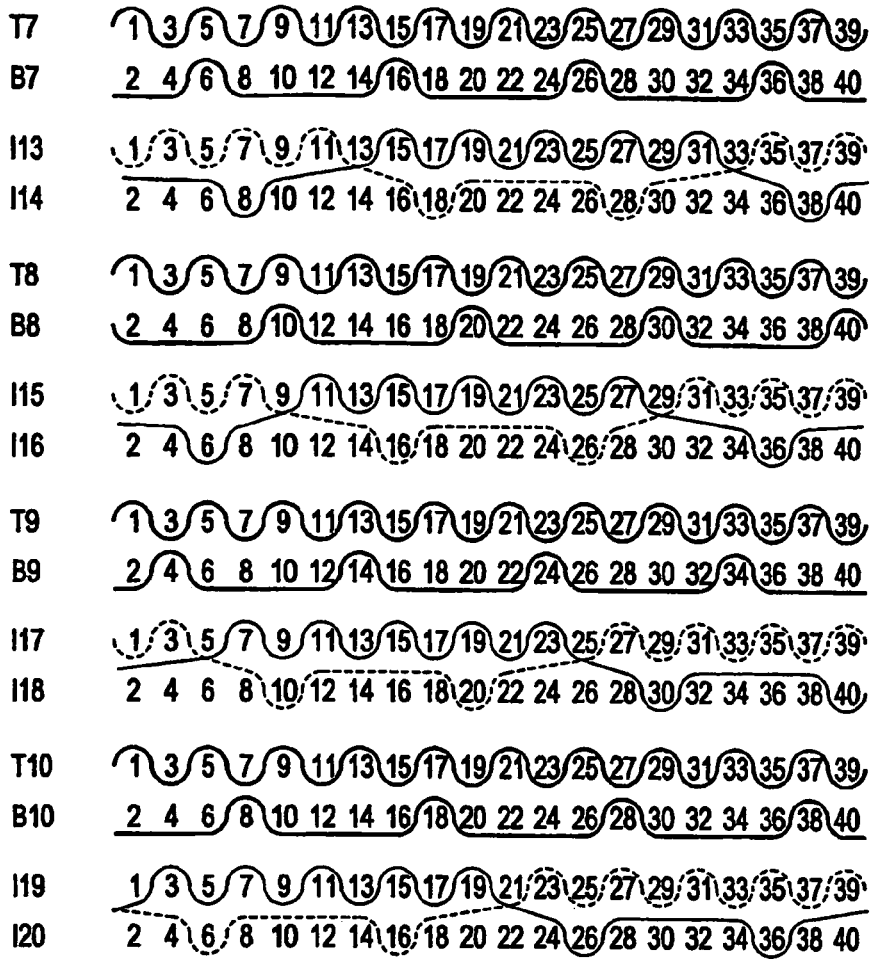
| | 1 | 3 | 5 | 7 | 9 | 11 | 13 | 15 | 17 | 19 | 21 | 23 | 25 | 27 | 29 | 31 | 33 | 35 | 37 | 39 |
|---|---|---|---|---|---|---|---|---|---|---|---|---|---|---|---|---|---|---|---|---|
| I1/2 | | | | | | | | | X | | | | | | | | | | X | |
| I3/4 | | | | | | | X | | | | | | | | | | X | | | |
| I5/6 | | | | | X | | | | | | | | | | X | | | | | |
| I7/8 | | | X | | | | | | | | | | X | | | | | | | |
| I9/10 | X | | | | | | | | | | X | | | | | | | | | |
| I11/12 | | | | | | | | | X | | | | | | | | | | X | |
| I13/14 | | | | | | | X | | | | | | | | | | X | | | |
| I15/16 | | | | | X | | | | | | | | | | X | | | | | |
| I17/18 | | | X | | | | | | | | | | X | | | | | | | |
| I19/20 | X | | | | | | | | | | X | | | | | | | | | |
Interchange points - paperside
Fig.9 page 2 a)

| | |
|---|---|
| T1 | 1 3 5 7 9 11 13 15 17 19 21 23 25 27 29 31 33 35 37 39 |
| B1 | 2 4 6 8 10 12 14 16 18 20 22 24 26 28 30 32 34 36 38 40 |
| I1 | 1 3 5 7 9 11 13 15 17 19 21 23 25 27 29 31 33 35 37 39 |
| I2 | 2 4 6 8 10 12 14 16 18 20 22 24 26 28 30 32 34 36 38 40 |
| T2 | 1 3 5 7 9 11 13 15 17 19 21 23 25 27 29 31 33 35 37 39 |
| B2 | 2 4 6 8 10 12 14 16 18 20 22 24 26 28 30 32 34 36 38 40 |
| I3 | 1 3 5 7 9 11 13 15 17 19 21 23 25 27 29 31 33 35 37 39 |
| I4 | 2 4 6 8 10 12 14 16 18 20 22 24 26 28 30 32 34 36 38 40 |
| T3 | 1 3 5 7 9 11 13 15 17 19 21 23 25 27 29 31 33 35 37 39 |
| B3 | 2 4 6 8 10 12 14 16 18 20 22 24 26 28 30 32 34 36 38 40 |
| I5 | 1 3 5 7 9 11 13 15 17 19 21 23 25 27 29 31 33 35 37 39 |
| I6 | 2 4 6 8 10 12 14 16 18 20 22 24 26 28 30 32 34 36 38 40 |
| T4 | 1 3 5 7 9 11 13 15 17 19 21 23 25 27 29 31 33 35 37 39 |
| B4 | 2 4 6 8 10 12 14 16 18 20 22 24 26 28 30 32 34 36 38 40 |
| I7 | 1 3 5 7 9 11 13 15 17 19 21 23 25 27 29 31 33 35 37 39 |
| I8 | 2 4 6 8 10 12 14 16 18 20 22 24 26 28 30 32 34 36 38 40 |
| T5 | 1 3 5 7 9 11 13 15 17 19 21 23 25 27 29 31 33 35 37 39 |
| B5 | 2 4 6 8 10 12 14 16 18 20 22 24 26 28 30 32 34 36 38 40 |
| I9 | 1 3 5 7 9 11 13 15 17 19 21 23 25 27 29 31 33 35 37 39 |
| I10 | 2 4 6 8 10 12 14 16 18 20 22 24 26 28 30 32 34 36 38 40 |
| T6 | 1 3 5 7 9 11 13 15 17 19 21 23 25 27 29 31 33 35 37 39 |
| B6 | 2 4 6 8 10 12 14 16 18 20 22 24 26 28 30 32 34 36 38 40 |
| I11 | 1 3 5 7 9 11 13 15 17 19 21 23 25 27 29 31 33 35 37 39 |
| I12 | 2 4 6 8 10 12 14 16 18 20 22 24 26 28 30 32 34 36 38 40 |

Fig.10 page 2

Fig.10 page 1

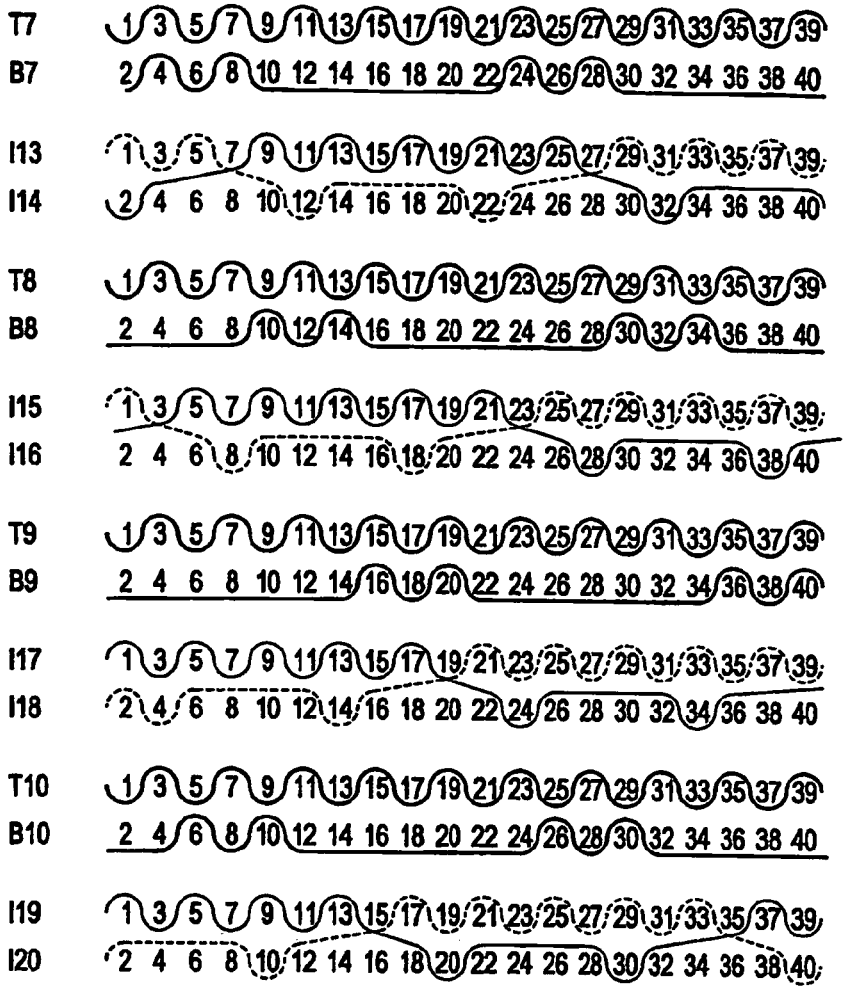
b)
| | 1 | 3 | 5 | 7 | 9 | 11 | 13 | 15 | 17 | 19 | 21 | 23 | 25 | 27 | 29 | 31 | 33 | 35 | 37 | 39 |
|---|---|---|---|---|---|---|---|---|---|---|---|---|---|---|---|---|---|---|---|---|
| I1/2 | | | | | | X | | | | | | | | | | X | | | | |
| I3/4 | | | | X | | | | | | | | | | X | | | | | | |
| I5/6 | | X | | | | | | | | | | X | | | | | | | | |
| I7/8 | | | | | | | | | | X | | | | | | | | | | X |
| I9/10 | | | | | | | | X | | | | | | | | | | X | | |
| I11/12 | | | | | | X | | | | | | | | | | X | | | | |
| I13/14 | | | | X | | | | | | | | | | X | | | | | | |
| I15/16 | | X | | | | | | | | | | X | | | | | | | | |
| I17/18 | | | | | | | | | | X | | | | | | | | | | X |
| I19/20 | | | | | | | | X | | | | | | | | | | X | | |
Interchange points - paperside
Fig.10 page 2 a)

| | |
|---|---|
| T1 | 1 3 5 7 9 11 13 15 17 19 21 23 25 27 29 31 33 35 37 39 41 43 45 47 |
| B1 | 2 4 6 8 10 12 14 16 18 20 22 24 26 28 30 32 34 36 38 40 42 44 46 48 |
| T2 | 1 3 5 7 9 11 13 15 17 19 21 23 25 27 29 31 33 35 37 39 41 43 45 47 |
| B2 | 2 4 6 8 10 12 14 16 18 20 22 24 26 28 30 32 34 36 38 40 42 44 46 48 |
| I1 | 1 3 5 7 9 11 13 15 17 19 21 23 25 27 29 31 33 35 37 39 41 43 45 47 |
| I2 | 2 4 6 8 10 12 14 16 18 20 22 24 26 28 30 32 34 36 38 40 42 44 46 48 |
| T3 | 1 3 5 7 9 11 13 15 17 19 21 23 25 27 29 31 33 35 37 39 41 43 45 47 |
| B3 | 2 4 6 8 10 12 14 16 18 20 22 24 26 28 30 32 34 36 38 40 42 44 46 48 |
| T4 | 1 3 5 7 9 11 13 15 17 19 21 23 25 27 29 31 33 35 37 39 41 43 45 47 |
| B4 | 2 4 6 8 10 12 14 16 18 20 22 24 26 28 30 32 34 36 38 40 42 44 46 48 |
| I3 | 1 3 5 7 9 11 13 15 17 19 21 23 25 27 29 31 33 35 37 39 41 43 45 47 |
| I4 | 2 4 6 8 10 12 14 16 18 20 22 24 26 28 30 32 34 36 38 40 42 44 46 48 |
| T5 | 1 3 5 7 9 11 13 15 17 19 21 23 25 27 29 31 33 35 37 39 41 43 45 47 |
| B5 | 2 4 6 8 10 12 14 16 18 20 22 24 26 28 30 32 34 36 38 40 42 44 46 48 |
| T6 | 1 3 5 7 9 11 13 15 17 19 21 23 25 27 29 31 33 35 37 39 41 43 45 47 |
| B6 | 2 4 6 8 10 12 14 16 18 20 22 24 26 28 30 32 34 36 38 40 42 44 46 48 |
| I5 | 1 3 5 7 9 11 13 15 17 19 21 23 25 27 29 31 33 35 37 39 41 43 45 47 |
| I6 | 2 4 6 8 10 12 14 16 18 20 22 24 26 28 30 32 34 36 38 40 42 44 46 48 |
| T7 | 1 3 5 7 9 11 13 15 17 19 21 23 25 27 29 31 33 35 37 39 41 43 45 47 |
| B7 | 2 4 6 8 10 12 14 16 18 20 22 24 26 28 30 32 34 36 38 40 42 44 46 48 |
| T8 | 1 3 5 7 9 11 13 15 17 19 21 23 25 27 29 31 33 35 37 39 41 43 45 47 |
| B8 | 2 4 6 8 10 12 14 16 18 20 22 24 26 28 30 32 34 36 38 40 42 44 46 48 |
| I7 | 1 3 5 7 9 11 13 15 17 19 21 23 25 27 29 31 33 35 37 39 41 43 45 47 |
| I8 | 2 4 6 8 10 12 14 16 18 20 22 24 26 28 30 32 34 36 38 40 42 44 46 48 |

Fig.11 page 2

Fig.11 page 1

| | |
|---|---|
| T9 | 1 3 5 7 9 11 13 15 17 19 21 23 25 27 29 31 33 35 37 39 41 43 45 47 |
| B9 | 2 4 6 8 10 12 14 16 18 20 22 24 26 28 30 32 34 36 38 40 42 44 46 48 |
| T10 | 1 3 5 7 9 11 13 15 17 19 21 23 25 27 29 31 33 35 37 39 41 43 45 47 |
| B10 | 2 4 6 8 10 12 14 16 18 20 22 24 26 28 30 32 34 36 38 40 42 44 46 48 |
| I9 | 1 3 5 7 9 11 13 15 17 19 21 23 25 27 29 31 33 35 37 39 41 43 45 47 |
| I10 | 2 4 6 8 10 12 14 16 18 20 22 24 26 28 30 32 34 36 38 40 42 44 46 48 |
| T11 | 1 3 5 7 9 11 13 15 17 19 21 23 25 27 29 31 33 35 37 39 41 43 45 47 |
| B11 | 2 4 6 8 10 12 14 16 18 20 22 24 26 28 30 32 34 36 38 40 42 44 46 48 |
| T12 | 1 3 5 7 9 11 13 15 17 19 21 23 25 27 29 31 33 35 37 39 41 43 45 47 |
| B12 | 2 4 6 8 10 12 14 16 18 20 22 24 26 28 30 32 34 36 38 40 42 44 46 48 |
| I11 | 1 3 5 7 9 11 13 15 17 19 21 23 25 27 29 31 33 35 37 39 41 43 45 47 |
| I12 | 2 4 6 8 10 12 14 16 18 20 22 24 26 28 30 32 34 36 38 40 42 44 46 48 |
| T13 | 1 3 5 7 9 11 13 15 17 19 21 23 25 27 29 31 33 35 37 39 41 43 45 47 |
| B13 | 2 4 6 8 10 12 14 16 18 20 22 24 26 28 30 32 34 36 38 40 42 44 46 48 |
| T14 | 1 3 5 7 9 11 13 15 17 19 21 23 25 27 29 31 33 35 37 39 41 43 45 47 |
| B14 | 2 4 6 8 10 12 14 16 18 20 22 24 26 28 30 32 34 36 38 40 42 44 46 48 |
| I13 | 1 3 5 7 9 11 13 15 17 19 21 23 25 27 29 31 33 35 37 39 41 43 45 47 |
| I14 | 2 4 6 8 10 12 14 16 18 20 22 24 26 28 30 32 34 36 38 40 42 44 46 48 |
| T15 | 1 3 5 7 9 11 13 15 17 19 21 23 25 27 29 31 33 35 37 39 41 43 45 47 |
| B15 | 2 4 6 8 10 12 14 16 18 20 22 24 26 28 30 32 34 36 38 40 42 44 46 48 |
| T16 | 1 3 5 7 9 11 13 15 17 19 21 23 25 27 29 31 33 35 37 39 41 43 45 47 |
| B16 | 2 4 6 8 10 12 14 16 18 20 22 24 26 28 30 32 34 36 38 40 42 44 46 48 |
| I15 | 1 3 5 7 9 11 13 15 17 19 21 23 25 27 29 31 33 35 37 39 41 43 45 47 |
| I16 | 2 4 6 8 10 12 14 16 18 20 22 24 26 28 30 32 34 36 38 40 42 44 46 48 |

Fig.11 page 3

Fig.11 page 2

| | |
|---|---|
| T17 | 1 3 5 7 9 11 13 15 17 19 21 23 25 27 29 31 33 35 37 39 41 43 45 47 |
| B17 | 2 4 6 8 10 12 14 16 18 20 22 24 26 28 30 32 34 36 38 40 42 44 46 48 |
| T18 | 1 3 5 7 9 11 13 15 17 19 21 23 25 27 29 31 33 35 37 39 41 43 45 47 |
| B18 | 2 4 6 8 10 12 14 16 18 20 22 24 26 28 30 32 34 36 38 40 42 44 46 48 |
| I17 | 1 3 5 7 9 11 13 15 17 19 21 23 25 27 29 31 33 35 37 39 41 43 45 47 |
| I18 | 2 4 6 8 10 12 14 16 18 20 22 24 26 28 30 32 34 36 38 40 42 44 46 48 |
| T19 | 1 3 5 7 9 11 13 15 17 19 21 23 25 27 29 31 33 35 37 39 41 43 45 47 |
| B19 | 2 4 6 8 10 12 14 16 18 20 22 24 26 28 30 32 34 36 38 40 42 44 46 48 |
| T20 | 1 3 5 7 9 11 13 15 17 19 21 23 25 27 29 31 33 35 37 39 41 43 45 47 |
| B20 | 2 4 6 8 10 12 14 16 18 20 22 24 26 28 30 32 34 36 38 40 42 44 46 48 |
| I19 | 1 3 5 7 9 11 13 15 17 19 21 23 25 27 29 31 33 35 37 39 41 43 45 47 |
| I20 | 2 4 6 8 10 12 14 16 18 20 22 24 26 28 30 32 34 36 38 40 42 44 46 48 |
| T21 | 1 3 5 7 9 11 13 15 17 19 21 23 25 27 29 31 33 35 37 39 41 43 45 47 |
| B21 | 2 4 6 8 10 12 14 16 18 20 22 24 26 28 30 32 34 36 38 40 42 44 46 48 |
| T22 | 1 3 5 7 9 11 13 15 17 19 21 23 25 27 29 31 33 35 37 39 41 43 45 47 |
| B22 | 2 4 6 8 10 12 14 16 18 20 22 24 26 28 30 32 34 36 38 40 42 44 46 48 |
| I21 | 1 3 5 7 9 11 13 15 17 19 21 23 25 27 29 31 33 35 37 39 41 43 45 47 |
| I22 | 2 4 6 8 10 12 14 16 18 20 22 24 26 28 30 32 34 36 38 40 42 44 46 48 |
| T23 | 1 3 5 7 9 11 13 15 17 19 21 23 25 27 29 31 33 35 37 39 41 43 45 47 |
| B23 | 2 4 6 8 10 12 14 16 18 20 22 24 26 28 30 32 34 36 38 40 42 44 46 48 |
| T24 | 1 3 5 7 9 11 13 15 17 19 21 23 25 27 29 31 33 35 37 39 41 43 45 47 |
| B24 | 2 4 6 8 10 12 14 16 18 20 22 24 26 28 30 32 34 36 38 40 42 44 46 48 |
| I23 | 1 3 5 7 9 11 13 15 17 19 21 23 25 27 29 31 33 35 37 39 41 43 45 47 |
| I24 | 2 4 6 8 10 12 14 16 18 20 22 24 26 28 30 32 34 36 38 40 42 44 46 48 |

Fig.11 page 3 b)

| | 1 | 3 | 5 | 7 | 9 | 11 | 13 | 15 | 17 | 19 | 21 | 23 | 25 | 27 | 29 | 31 | 33 | 35 | 37 | 39 | 41 | 43 | 45 | 47 |
|---|---|---|---|---|---|---|---|---|---|---|---|---|---|---|---|---|---|---|---|---|---|---|---|---|
| I1/2 | | X | | | | | | | | | | | | X | | | | | | | | | | |
| I3/4 | | | | | | | X | | | | | | | | | | | | X | | | | | |
| I5/6 | | | | | | | | | | | | X | | | | | | | | | | | | X |
| I7/8 | | | | | X | | | | | | | | | | | | X | | | | | | | |
| I9/10 | | | | | | | | | | X | | | | | | | | | | | | X | | |
| I11/12 | | | X | | | | | | | | | | | | X | | | | | | | | | |
| I13/14 | | | | | | | | | | | | | | | | | | | | | | | | |
| I15/16 | | | | | | | | | | | | | | | | | | | | | | | | |
| I17/18 | | | | | | | | | | | | | | | | | | | | | | | | |
| I19/20 | | | | | | | | | | | | | | | | | | | | | | | | |
| I21/22 | | | | | | | | | | | | | | | | | | | | | | | | |
| I23/24 | | | | | | | | | | | | | | | | | | | | | | | | |

Interchange points - paperside

Fig.11 page 4

HIGH SHAFT FORMING FABRICS

FIELD OF THE INVENTION

The present invention relates to fabrics, and more particularly to fabrics made with a high weave repeat number and employed in web forming equipment, such as papermaking and non-woven web-forming equipment. More particularly, the preferred fabrics of this invention are employed as forming fabrics in web forming equipment; most preferably in papermaking machines employed to make graphical paper having desired properties suitable for effectively receiving printing ink thereon.

BACKGROUND OF THE INVENTION

Papermaking involves the forming, pressing and drying of cellulosic fiber sheets. The forming process includes the step of depositing an aqueous stock solution of the fibers, and possibly other additives, onto the forming fabric upon which the initial paper web is formed. The forming fabric may run on a so-called Gap Former machine in which the aqueous stock initially is de-watered, and the initial paper sheet is formed between two forming fabrics.

An effective forming process typically produces a sheet with a very regular distribution of fibers and with a relatively high solids content, i.e., a high fiber-to-water weight ratio. In order to form a fibrous web with a desired uniform, regular distribution and high fiber-to-water weight ratio, the forming fabric must possess a number of properties. First, the papermaking surface should be relatively planar; resulting from the yarn floats in both the machine direction (MD) and cross-machine-direction (CD) lying at substantially the same height, to thereby prevent localized penetration of the fibers into the fabric. Such localized penetration results in "wire marks," which actually are the result of basis weight variations throughout the sheet area. In addition, the MD and CD floats need to be distributed in a regular manner to avoid introducing undesired wire marks into the formed sheet. Moreover, these basis weight variations can result in undesired variations in sheet absorption properties; a property very relevant to the functionality of quality graphical papers where a consistent uptake of print ink is necessary to produce a clear sharp image.

Other factors also cause the formation of undesired wire marks. For example, wire marks can be introduced into the sheet by the flow of water around yarns positioned below the fabric's papermaking surface. This phenomena, referred to as "strike through," needs to be taken into account in designing the fabric construction.

Importantly, the forming fabric must also possess a high degree of dimensional stability. This high stability is necessary, for example, to minimize cyclic variations in fabric width, which can result in MD wrinkles in the fabric. This, in turn, contributes to the so-called, streaky sheet, i.e., a sheet with machine direction streaks created by variations in fiber basis weight.

Dimensional stability of a fabric typically is obtained by manufacturing the forming fabric with a relatively high mass of material. However, the use of thick yarns to establish such a high mass often causes undesirable wire marks. Consequently, there has been a trend to providing composite forming fabrics, that is, "multi-layer" structures, whereby a high number of relatively thin yarns are distributed throughout various fabric layers to enhance fabric stability.

One type of multi-layer structure is the so-called triple-layer, or composite, fabric made by joining two (2) distinct fabrics, each with its own MD (warp) yarns and CD (weft) yarns, by the use of additional and independent "binding yarns." These binding yarns can be employed in either the MD or CD directions, and in this system provide the sole function of binding the two separate fabrics together. In other words, these binding yarns are not intended to function as part of the warp or weft yarn system in either the top fabric or the bottom fabric of the multi-layer structure. Such a triple-layer fabric is illustrated in EP 0,269,070 (JWI Ltd.), the entire subject matter of which is incorporated herein by reference.

Where the two fabrics of the triple-layer structure are joined in either the machine direction or cross-machine-direction by binding yarns that also belong, or form part of the weave pattern of either, or both, of the paper side or wear side fabrics, the resulting structures are referred to more specifically as "self-stitched" triple-layer structures. Such binding yarns are referred to as intrinsic binding yarns. Self-stitched structures are taught in a number of prior art patents. For example, U.S. Pat. No. 4,501,303 (Nordiskafilt AB) discloses a triple-layer structure wherein paper side yarns are used to bind the paper side and wear side fabrics into one structure. The entire subject matter of this latter patent is incorporated herein, by reference.

Triple-layer structures, whether employing separate and distinct binding yarns or intrinsic binding yarns that form part of either the paper side or wear side weave structure, allow, to some extent, for the use of fine MD and CD yarns in the top, paper side fabric for improved papermaking quality and sheet release. Additionally, the use of significantly coarser yarns can be employed in the bottom, lower fabric, or wear side fabric, which contacts the paper machine elements, to thereby provide good stability and fabric life. Thus, these triple-layer structures have the capability of providing optimum papermaking properties in the paper side fabric and optimum strength properties in the wear side fabric.

In the triple-layer and self-stitched fabrics of the prior art the internal surface of the wear side fabric is dominated by floats of machine direction yarns. Where wear side fabric CD yarns interlace with wear side fabric MD yarns, such that the wear side CD yarns appear in the internal region between the paper side and wear side fabric layers, relatively prominent short weft knuckles are formed. The pressure of relatively stiff wear side MD yarns acting on the wear side CD yarns during the production of the fabric can cause so-called "knuckle spread," whereby the wear side CD yarn knuckles are distorted and their width increased to form a relatively large area. The location of such yarn mass areas within the fabric inner region reduces the ability of water to flow through the fabric in such yarn mass areas such that fabric dewatering may be adversely effected.

A further common feature of the known self-stitched and other triple-layer designs is that they are relatively thick structures with a high amount of void space distributed throughout their thickness. The relatively high "void volume" is typically associated with sheet re-wetting on the paper machine such that the sheet solids content at transfer to the press section may be undesirably low. That is, the fibrous web formed on the papermaking fabric has an undesirably low fiber-to-weight ratio. This can result in reduced machine performance through a higher amount of sheet breaks occasioned by the wetter sheet, reduced running speed and higher drying costs downstream of initial web formation on the papermaking fabric.

A variety of composite fabrics employing intrinsic interchanging yarn pairs have been disclosed to attempt to deal with the various problems of fabric stability e.g., fabric stiffness, desired papermaking side performance and desired wear side performance. In particular, various different composite fabric constructions are disclosed in U.S. Pat. No. 5,826,627 (Seabrook, et al.); U.S. Pat. No. 5,967,195 (Ward); U.S. Pat. No. 6,145,550 (Ward), and International Publication WO 02/14601 A1 (Andreas Kufferath GMBH & Co. KG). The entire subject matter of all these latter-identified patents and publications is incorporated herein, by reference.

In the above mentioned prior art composite fabrics employing intrinsic interchanging weft yarn pairs, each yarn of the pair forms part of the paperside weave pattern and, at least one yarn of the pair, also functions to bind the two fabric layers together. The two members of each pair of interchanging yarn pairs between them form a continuous weft path in the fabric paper side layer. Interchange, or transition, points occur where one yarn of the pair leaves the paperside surface, to bind on the lower fabric layer, and where the other yarn of the pair enters the paperside surface to continue the weave pattern initiated by the first member of the yarn pair. As disclosed in the previously identified Ward '195 and '550 patents, at each transition point the warp yarn around which the pair members transition is disturbed such that an irregularity occurs in the paperside surface. The disturbance can contribute to the formation of undesired sheet wire marks. In the prior art fabrics, on average, a paperside transition point occurs once in every four, five, or six warp yarns. In other words, between 25% and 16.7% of the paperside warp yarns interlacing with any interchanging yarn pair are transitional warp yarns with an inherent tendency to mark the sheet.

Furthermore, the weave patterns employed in the wear side layers of the above-mentioned prior art fabrics do not provide the desired wear resistance for enhanced fabric life. Specifically, these prior art wear side fabric weave patterns have been relatively small, e.g., five or six shaft repeats, such that fabric life potential may be restricted. Moreover, these small shaft repeats create an undesired high frequency of wear side weft knuckles located in the fabric interior, which interferes with the flow of water through the fabric.

Troughton U.S. Pat. No. 6,244,306 has more recently disclosed a self-stitched fabric including a wear side layer with either an eight or a ten shaft fabric repeat pattern. However, the wear side layer weaves disclosed in the Troughton '306 patent utilize multiple warp interlacings with each wearside weft yarn such that there is still an undesirably high amount of wearside weft knuckle material appearing in the fabric interior. Furthermore, the fabrics disclosed in the Troughton '306 patent all have a high frequency of paperside transition points (described in detail hereinafter) and so do not resolve the problem of wire marks stemming from the transitional regions.

For all embodiments of the above prior art structures there is typically a wearside weft passed above a respective wear side warp, on average, once in every four, five, or six adjacent warp yarns. In other words, for each wearside weft, between 25 and 16.7% of its interaction with the wearside warp yarns occurs with the wearside weft inside the fabric, thus restricting the wearside weft material available to provide wear resistant properties for the fabric. In addition, this interaction of the wear side warp yarns with the wear side weft yarns in the inside of the fabric creates a high tendency to interfere with, and create non-uniformity of water flow through the fabric. This can result in irregularities in the formed sheet.

Although the aforementioned composite papermaking fabrics employing intrinsic interchanging yarn pairs have provided improved structures, applicant believes that there still is a need for additional, improved composite structures of the type employing intrinsic interchanging yarn pairs, providing reduced transitional region marking of the paper sheet and reduced occurrences of wearside weft material within the fabric internal region to thereby reduce interference of water flow through the fabric and to increase weft material available for wear. It is to such structures that the present invention is directed.

SUMMARY OF THE INVENTION

The above and other objects of this invention are obtained in "high-shaft" composite fabrics. The composite fabrics fully disclosed in the prior art have a maximum weave repeat size of 24 warp yarns; with a 20 warp yarn repeat being most typical.

The high shaft fabrics of this invention have a paper side weave repeat which is greater than 12 warp yarns and preferably is either 14, 16, 20, 24 or even 50, although it is understood that these weave repeat sizes are illustrative of this invention and that this invention is not restricted to fabrics employing these weave repeat sizes. High-shaft fabrics are herein defined as possessing a paper side weave repeat pattern value wherein the paper side warp repeat pattern size "S" requires more than 12 warp yarns, i.e., S>12. When the wear side layer of the fabric has the same number of warp yarns as the paper side layer within each repeat, then the weave repeat in the fabrics of this invention is greater than 24 warp yarns (i.e., greater than 12 top warp yarns and 12 underlying bottom warp yarns) and preferably is either 28, 32, 40, 48 or even 100. However, it should be understood that these weave repeat sizes are illustrative of the embodiments of the invention wherein the fabrics have the same number of top warp yarns and bottom warp yarns in each repeat, and that this invention is not restricted to fabrics utilizing these weave repeat sizes, or for that matter to fabrics having the same number of top warp yarns and bottom warp yarns within each repeat.

The high-shaft fabrics of this invention may be produced in at least four different ways, as will be discussed hereinafter. Currently commercial forming fabrics are woven on a variety of weaving looms. The essential features of all such looms include:

- a "let-off" system which supplies the warp yarns to be woven into the fabric;
- a "shedding" system which controls (raise/lower) all warp yarns as required;
- a "weft insertion" system which places weft yarns into the "shed" between the raised and lowered warp yarns;
- a "beat-up" system which forces the weft into place between the warp yarns such that when the shed is changed, i.e. the warp yarns are lowered/raised, woven fabric will be formed; and
- a "take-up" system to move the formed fabric away from the weaving region.

The mechanical device typically used to control the up or down movement of warp yarns is called a "dobby." The dobby is equipped with a number of "frames." Each frame can be driven up or down independently of all other frames. Each frame is fitted with many individual heddles. A heddle is a strip of metal with an eyelet through which an individual warp yarn is threaded. All of the warp yarns to be woven into the fabric are typically controlled by an individual heddle, although in some cases more than one (1) yarn can be threaded onto an individual heddle.

In a 20 shaft, triple-layer fabric, such as that disclosed in FIG. 1 of the Ward '195 patent, a suitable heddle threading arrangement would be as follows:

first paperside warp yarn thread onto a 1$^{st}$ heddle on frame 1;

first wearside warp yarn thread onto a $1^{st}$ heddle on frame 2;

second paperside warp yarn thread onto a $1^{st}$ heddle on frame 3;

second wearside warp yarn thread onto a $1^{st}$ heddle on frame 4; and so on until tenth paperside warp yarn thread onto a $1^{st}$ heddle on frame 19; and tenth wearside warp yarn thread onto a $1^{st}$ heddle on frame 20.

After the above twenty (20) yarns are allocated to individual heddle frames the sequence would then start again:

eleventh paperside warp yarn thread onto a $2^{nd}$ heddle on frame 1;

eleventh wearside warp yarn thread onto a $2^{nd}$ heddle on frame 2, etc.

Thus, for the example, each of the 20 heddle frames controls 1 in every 20 MD yarns. The prior art fabrics utilize state of the art weaving looms which are equipped with dobbies of up to 24 frames or shafts. To produce the fabrics of the instant invention, therefore, four methods were considered viz:

i) Allocate a disproportionate amount of warp yarns to certain heddle frames. Where a number of warps are always raised or lowered in the same sequence in the weave they do not require their own heddle frame. This is the case with plain weave, which is typically used as the paper side surface in fabrics of the prior art and of this invention. This technique is restricted as to how many frames can be made available but also it also puts a disproportionate load and corresponding degree of wear onto the mechanisms associated with the frames onto which the higher number of warp yarns are allocated. Consistency of warp yarn tension, which is essential for forming fabric end-use conditions (where dewatering may be related to fabric tension thus any variation in fabric/yarn tension may result in undesired variations in dewatering of the formed sheet), can therefore be compromised.

ii) Augment the dobby capacity with individually controlled warp yarns utilizing, for example, a jacquard mechanism. This technique allows a more random distribution of binder interchange points than using a dobby on its own. However, tension variations between the yarns controlled respectively by the respective jacquard and dobby mechanisms are an undesirable possibility. It should be noted that Chiu U.S. Pat. No. 5,429,686 also proposed the combined use of jacquard mechanisms and heddle frames. However, the Chiu '686 patent is directed to through-air-drying (TAD) fabrics for use on the dryer section of paper machines. Contrary to the instant invention, which is directed to forming fabrics with low wire mark potential, Chiu actually seeks to introduce wire marks into the paper sheet by the use of a dryer fabric containing a "sculpture layer." The "sculpture layer" is woven to protrude above a "load bearing" fabric layer. Chiu proposed the utilization of the combined jacquard and dobby mechanism to obtain "an unlimited selection of fabric patterns in the sculpture layer of the fabric" for the purpose of introducing desired markings into the sheet.

iii) Use only a jacquard mechanism. This technique is very complex and involves high numbers of mechanism parts to facilitate the individual control of each warp yarn. Consequently, high maintenance costs may be generated and costly machine stops experienced in order to ensure that each of the warp yarns is maintained within required tension limits. However, using a jacquard mechanism does allow the production of fabric with extremely long binder segments to thereby minimize interchange points per unit fabric area and ensure that the potential to wiremark is reduced.

iv) Utilize a dobby with a higher shaft capacity than was previously available commercially. However, utilizing this approach creates a number of technical difficulties that need to be overcome. For example, to allow insertion of the weft yarn into the warp "shed", without potentially dangerous interference from lifted warp yarns drooping down into the path of the insertion media, the height that each frame is lifted progressively increases from the frame nearest the shed to the last frame (furthest away from the shed and nearest to the warp let-off system). As a result, warp yarn tension increases from frame to frame moving away from the warp shed. This tension range has proven to be within acceptable limits for prior art weave patterns which utilize only up to 24 frames. However, obtaining a consistent yarn tension for the weave patterns of this invention, i.e. weave patterns utilizing more than 24 frames, has proven problematic even with considerable development of the dobby construction.

Surprisingly, applicants have found that utilizing an irregular drawing-in sequence of the heddle frames can minimize the tension differences between adjacent warp yarns and thereby produce suitable fabric for high quality paper production. An irregular drawing-in sequence of the heddle frames means that the warps are not arranged sequentially from first frame to last frame, as is the custom in the manufacture of forming fabric, but instead the heddle allocation is rearranged such that adjacent warp yarns are less likely to be controlled by frames which will exert significantly different levels of tension on the respective yarns.

As previously described, a 20 shaft fabric according to the Ward '195 patent could be "drawn-in" on 20 frames using a straight arrangement from heddle frame 1 to the heddle frame 20 respectively. In this case the maximum difference for adjacent yarns, in terms of frames, is 19—from frame 1 to frame 20. However, a straight draw-in of a 40 shaft fabric of the invention would give a maximum frame difference of 39 frames for adjacent yarns. In this latter example the tension differential on adjacent yarns 1 and 40 could be such as to give an irregular fabric appearance.

The maximum number of frames between adjacent warp yarns in the fabrics of this invention can be reduced by use of a "fancy" or irregular draw-in. For example, in the above-described case of a 40 shaft fabric, an illustrative, but not limiting, fancy draw-in could involve drawing-in frame 1 to frame 20 in sequence as before. However, warps 21 to 40 would be drawn-in following a reversed order i.e. warp 21 allocated to frame 40 and warp 40 allocated to frame 21. In this way, a 40 shaft fabric of this invention can be made with the largest number of frames between adjacent yarns being reduced to the 19 of the prior art 20 shaft fabrics.

Regardless of which of the above four techniques are used to obtain the fabrics of this invention all such fabrics will be referred to as "high shaft fabrics" for ease of reference. Furthermore in describing the number of warps required to complete the fabric weave repeat pattern the terms "shaft" and "warp (pattern) repeat size" are used interchangeably. Use of the term shaft throughout the application does not limit the manufacturing method to weaving on a loom with the equivalent number of shafts but instead refers to a feature of the fabric which may be obtained in accordance with any of the preceding manufacturing techniques.

In detailing different embodiments of the invention reference may be made to any of a number of key features, which are stated and defined below. Their significance is also detailed.

a) Binder Segments

The two members, or yarns, of a binder pair interchange to bind to wear side fabric MD yarns and to provide one continuous weft path on the paper side fabric, or layer. Each part of the paper side weft path made by one of the binder pair members is defined as a segment. The segment length is defined as the number of paper side layer warps in an adjacent preceding transitional region plus the paper side warps with which the binder yarn weaves under or over before entering the next transitional region. Fabrics of the invention typically transition, or move in/out of the paper side layer alongside common paper side warp yarn(s) such that the two members of the binder pair actually cross each other beneath such warp yarn. Thus this latter warp yarn is referred to as a transitional (warp) yarn. The upper surface of each such transitional warp yarn is referred to as a transition point, even though the binder pair transition occurs under these yarns. These transition points on the sheet contacting side of the paper side fabric constitute potential regions of variation in fabric planarity on the paper side surface, resulting in variations in fluid and fiber flow in those areas to create undesired variations in the basis weight of the formed sheet. As with the weave repeat of the prior art fabrics, embodiments shown herein typically repeat after two binder segments. However, it will become apparent that the fabrics of this invention provide desirably longer segments and a corresponding decrease in interchange points and likelihood of sheet wire markings. It should also be noted that the further terms "interchange point(s)" and "interchange warp(s)" as used within this application have identical meanings to "transition point(s)" and "transitional warp(s)" respectively. It also should be noted that such interchanging points and interchanging warps are included in prior art structures, such as the structures disclosed in the earlier identified Seabrook et al. '627 patent, which already has been fully incorporated by reference herein.

b) Internal Binder Float Lengths.

The binder yarns in each interchanging pair of yarns employed in multi-layer fabrics move between one fabric layer and the other. Thus, at some stage, after binding with an MD yarn of a first fabric layer the binder yarn then floats between warp yarns of the respective fabric layers before entering the second fabric layer to bind with an MD yarn in that second layer. The distance between leaving the first fabric layer and entering the second fabric layer is specified in terms of pairs of MD yarns, e.g., for a binder float length of one, the binder passes below a warp of the upper fabric layer and above a warp of the lower fabric layer with both of said warp yarns being vertically aligned and constituting a pair of MD yarns. Embodiments of this invention illustrated herein are fabrics with 1:1 ratio of top-to-bottom MD yarns. However, within the broadest scope of this invention MD ratios other than 1:1 can be employed, for example, 3:2 or 2:1. In such cases the binder will float between full or partial groups of warp yarns instead of between pairs.

Excessively long binder float lengths are not preferred because they may create a relatively large vertical distance, or gap, inside the fabric, i.e. between the layers, such that the structure may carry and retain more water than desired during sheet formation. The carried water, in turn, may be discharged onto the sheet being formed at the end of the forming section, thus undesirably increasing the sheet moisture content Preferred embodiments of the invention have internal binder float lengths of between 2 and 4.

c) Binder Stiffening Section.

Each binder yarn may, after binding around a warp yarn on the outside of either fabric layer, return to and remain inside the fabric, i.e., between the two fabric layers, before making a further interlacing with another warp yarn of the same layer. In the paper side layer of fabrics of this invention the binder yarn typically weaves in a plain weave, i.e., it weaves over and under adjacent warp yarns of the paper side layer. However, a binder stiffening section within the fabrics of this invention require the binder yarn to remain inside the fabric for two or more adjacent warp yarns and to be bound on each end of the stiffening section with a warp yarn of the same fabric layer. By this means a straight section of yarn is provided to enhance fabric cross-machine-direction (CD) bending resistance. Furthermore, it may also be possible to reduce the internal float length of the binder yarn in this way to ensure a minimal "layer gap" between the respective fabric layers. These features of the invention are desirable to minimize undesired sheet moisture content and profiles therein, respectively, and will be described in detail hereinafter with respect to various embodiments of this invention.

d) Binder Yarn Knuckle Separation.

Where a binder does bind around a multitude of single, non-adjacent, spaced-apart MD yarns in one layer of the fabric to provide a stiffening section before returning to the other fabric layer, the distance between, or separation, of these binder knuckles is defined in terms of the number of MD yarns which lie between the MD yarns around which the binder yarn has formed respective, adjacent knuckles.

e) Binder Pair Knuckle Spacing.

This refers to the distance, on the wear side layer or fabric, between the adjacent binder knuckles of the members of a binder pair. It is specified in terms of the number of wear side fabric MD yarns positioned between the respective binder knuckles. Such spacing may be regular or irregular, and/or may vary from one binder pair to another in the fabrics of this invention.

f) Locked/Unlocked Binder.

This refers to the binder knuckle positions of the interchanging binder yarn pairs on the wear side layer in relation to the interlacings of adjacent wear side fabric warp and weft (non-interchanging) yarns. Where a binder knuckle of a yarn of an interchanging yarn pair on the wear side layer is bordered on both sides by the adjacent warp yarns of the wear side layer interlacing with non-interchanging bottom weft yarns on each side of the interchanging yarn pair then the binder knuckle is classified as "locked" into position because the adjacent yarns will not allow that binder knuckle to move from its established position, either in fabric manufacture or in end use of the fabric. Where the binder knuckle is not so bordered then it is classified as "unlocked." Both unlocked and locked binder knuckle positions are included in embodiments of this invention.

g) Interchange Points Percentage (IPP).

Every occurrence of an interchange point between the members of a binder pair on the paper side layer has the potential to cause an undesired sheet wire mark. IPP quantifies the wire mark risk numerically. Referring to FIG. 1 of the Ward '195 patent as an example, there are ten warps in the paper side layer weave repeat and each binder pair interchanges twice within the weave repeat. Therefore the IPP value is $(2/10)\times100=20$. The best, or lowest IPP value for prior art fabrics is 16.7 (e.g., the fabric illustrated in FIG. 3 of the '195 patent). Fabrics of this invention deliver significant reductions in IPP values; embodiments included herein having IPP values between 4 and 14.3. It should be noted that the number of non-interchanging paper side weft yarns is not factored into the equation—IPP assesses only the potential of a representative interchanging binder yarn pair to cause wire marks.

h) Paper Side to Wear Side Weave Repeat Ratio (PWR).

As stated, one objective of the invention is to remove, or reduce weft knuckle material from the internal region between the top and bottom fabric layers. PWR indicates the extent to which this objective has been met. PWR is a most useful measure for comparing fabrics made with: same frequency of warp/weft interlacings per weft yarn in the wear side fabric (e.g., one interlacing per weft weave repeat); identical paper side weave; and identical ratio of warps in each layer (e.g. both fabrics have 1:1 MD yarn ratio between paper side and wear side fabrics). Prior art fabrics having a plain weave paper side layer, a 1:1 MD yarn ratio between the paper side and wear side layers, and a single wear side warp yarn interlacing with each non-interchanging wear side weft yarn within each weave repeat have a typical PWR value of 2.5 (for a 5 shaft wear side fabric) or 3 (for a 6 shaft wear side fabric). Comparable fabrics of the present invention include embodiments wherein the PWR value is desirably increased to 3.5 or 4 thereby indicating a reduction in the instances, or frequency, of wear side fabric weft knuckles causing a disturbance to water flow through the fabric. It should be noted that although the preferred embodiments include either 2 or 4 weave repeats of the wear side fabric within the weave repeat of the total fabric it is certainly possible to obtain the benefits of the invention when using 3 or 5 or more wear side weave repeats.

Alternatively a larger wear side weave repeat can be used such that only one wear side fabric weave repeat occurs within the fabric. For example, a 28 shaft fabric with a 1:1 MD ratio of top and bottom warp yarns, respectively, a plain weave paper side and 14 warp wear side weave repeat (PWR value of 7), or a 30 shaft fabric with a 3 warp paper side weave repeat and 15 warp wear side weave repeat (PWR value of 5).

Conversely the PWR value can be decreased below prior art values and benefits can still be obtained. For example, in a 30 shaft fabric with 5 repeats of 3 shaft weave on the paper side and with 3 repeats of 5 shaft on the wear side, a PWR value of 1.67 is obtained (5/3). In this latter example there is no reduction in wear side fabric interlacing. However, there is still the potential to reduce IPP values to obtain sheet benefits.

Where the paper side and wear side weave repeat size is identical the PWR value obviously will be 1. An example is a 40 shaft structure containing four repeats of a five shaft sateen (weft under 1 warp and over 4 warp) on each 20 shaft layer. Such a structure would be desirable for Tissue grade formation, e.g., wherein a CD orientated paper side surface is desirable.

i) Binder Interchange Points to Wear Side Weave Repeat Ratio (IWR).

This ratio compares the number of binder pair interchange points in the paper side weave repeat, for a representative binder pair, with the wear side weave repeat size. This value can give some indication of the potential of a structure to allow spacing apart of the binder interchange points and the wear side weave knuckles. Weave structures which can avoid closely grouping such features may have a reduced wire mark risk.

Considering FIG. 1 of the Ward '195 patent, that prior art structure has two binder interchange points and two wear side weave repeats in the same fabric unit width. Thus the IWR value is 2:2=1. An embodiment of this invention utilizing the same paper side and wear side fabric weaves as in FIG. 1 of the Ward '195 patent has an IWR value reduced to as low as 0.2. Lower values are also possible. Care must be taken in interpreting the significance of the obtained IWR values as a value higher than 1, indicating a larger wear side weave repeat with the possibility of reduced wear side MD-CD interlacings, could also indicate an enhanced fabric.

j) Ratio of Binder Interchange Points to Wear Side Weave Warp Knuckles (WKR).

This further refines the ratio IWR by accounting for the actual number of wear side fabric MD-CD interlacings. By using WKR we can identify more accurately, for fabrics with comparable paper side weave types and number of binder yarn interchange points, the influence of the wear side weft knuckles. Again care must be taken in interpreting the significance of values obtained for WKR. A value of >1 for WKR indicates a structure with, on average, more paper side interchange points per binder pair than wear side fabric MD-CD interlacings per weft yarn. A WKR value of <1 indicates a structure with, on average, more wear side fabric MD-CD interlacings per weft yarn than interchange points per interchanging binder yarn pair. This knowledge is useful in determining the best fabric to supply to a customer.

k) Binder Interchange Points as Percentage of Total MD Yarns (ITP)

This percentage value gives us a further insight into the likely marking tendency from binder pair interchange points. Again taking FIG. 1 of the Ward '195 patent as an example, two binder interchange points occur for each binder pair in the total fabric repeat of 20 warp yarns. Thus the ITP value is (2/20)×100=10. However, a comparable fabric of this invention has only two interchange points per binder pair per 100 warp yarns. Thus the reduced ITP value of 2 is indicative of a fabric with reduced marking tendency.

l) Wear Side Fabric MD-CD Yarn Interlacings as Percentage of Number of Wear Side Warp Yarns in Weave Repeat (WIP).

Again taking the fabric illustrated in FIG. 1 of the Ward '195 patent as an example, the fabric weave repeat requires 10 wear side warp yarns woven to give two warp-weft interlacings per each non-interchanging wear side weft yarn. Accordingly the WIP value is 20, calculated as follows: (2/10)×100=20. Fabrics of this invention also can have comparably high WIP values for preferred embodiments but further preferred embodiments have WIP values of either 14.3 or 12.5. The decrease in WIP value is indicative of a fabric with a reduced number of internal regions wherein water throughflow is blocked by weft knuckles of the wear side fabric.

The composite forming fabrics of this invention have a top, paper side layer with a paper side surface, a machine side, or wear side, layer having a bottom wear side surface and a plurality of pairs of first and second intrinsic interchanging weft binder yarns. Reference throughout this application to "intrinsic interchanging weft binder yarns" or "interchanging weft binder yarns" means paired yarns, each of which forms a part of the weave structure in at least the paper side layer of the composite fabric and also binds the paper side layer and machine side layer together. Thus, each intrinsic weft binder yarn of each pair of first and second intrinsic weft binder yarns provides two functions within each repeat of the weave pattern. One function is to contribute to the weave structure of the paper side surface of the paper side layer, and the second function is to bind together the paper side layer and the machine side layer.

The fabrics in accordance with this invention have a paper side layer and a machine side layer, each typically comprising machine direction warp yarns and non-interchanging cross-machine-direction (CD) weft yarns woven together. Note that it is desirable, but not essential, that the fabrics of the invention have non-interchanging paper side CD yarns in addition to the interchanging yarn pairs that contribute to the paper side weave. However, suitable structures can be made without the inclusion of non-interchanging paper side CD yarns. The paper side layer and machine side layer each have a weave pattern in the cross-machine-direction with a predetermined repeat. These fabrics include a plurality of pairs of first and second interchanging weft binder yarns; preferably all of said pairs have two (2) segments in the paper side layer within each repeat of the weave pattern. These segments preferably provide an unbroken weft path in the paper side surface, with each succeeding segment being separated in the paper side surface of the paper side layer by at least one paper side layer transitional warp yarn.

The spacing of the transitional warp yarn(s) define(s) the length of each segment made in the paper side layer of the fabric by each individual yarn of an interchanging binder yarn pair. Specifically, one yarn of each pair forms a first segment of the paper side weft path and then drops out of the paper side surface adjacent one side of a transitional warp yarn, while the other yarn of the pair moves into the paper side layer adjacent the opposite side of that transitional warp yarn to begin forming a second segment of the paper side weft path.

When a pair of first and second intrinsic, interchanging weft binder yarns includes two segments in the paper side layer within each repeat of the weave pattern, each yarn of that pair interchanges positions into and out of the paper side layer two times within each such repeat. That is, a first yarn of the binder yarn pair is in the paper side layer in a first segment to form part of the continuous top weave pattern in each repeat; is in a machine side layer underlying a second segment of the paper side layer to bind to one or more bottom warp yarns in a region underlying such second segment, and then is in the paper side layer in a first segment of a new repeat of the weave pattern. The other, or second, yarn of the binder yarn pair is in the paper side layer in the second segment to cooperate with the first yarn of the pair to complete the continuous top weave pattern in each repeat of the weave pattern; is in the machine side layer underlying a first segment of the paper side layer to bind to one or more bottom warp yarns in a region underlying such first segment, and then is in the paper side layer in a second segment of an adjacent repeat of the weave pattern.

In one preferred embodiment of this invention, a 28 shaft, triple-layer fabric contains pairs of interchanging weft binder yarns which interchange to provide two paper side segments. The first yarn of the interchanging weft binder yarn pairs provides a first paper side segment of 6 paper side warp yarns, moves between the top and bottom layers to provide two internal binder float regions of 4 warp pairs each, and between said two binder float regions binds to a single bottom warp yarn in regions underlying said second segments. The second yarn of the interchanging weft binder yarn pairs provides a second paper side segment, but of 8 paper side warp yarns, moves between the top and bottom layers to provide two internal binder float regions but of 3 warp pairs each, and between said two binder float regions binds to a single bottom warp yarn in regions underlying said first segment.

In another embodiment of this invention, a 28 shaft triple-layer fabric contains pairs of interchanging weft binder yarns which interchange to provide two paper side segments. The first yarn of the interchanging weft binder yarn pairs provides a first paper side segment of 6 paper side warp yarns, moves between the top and bottom layers to provide two internal binder float regions of 3 warp pairs each, and between said internal float regions binds to two bottom warp yarns with a binder yarn knuckle separation of one warp yarn in regions underlying said second segment. The second yarn of the interchanging weft binder yarn pairs provides a second paper side segment of 8 paper side warp yarns, moves between the top and bottom layers to provide two internal binder float regions of 2 warp pairs each, and between said internal float regions binds to two bottom warp yarns with a binder yarn knuckle separation of one warp yarn in regions underlying said first segment.

In yet another embodiment, a 28 shaft triple-layer fabric contains pairs of interchanging weft binder yarns which interchange to provide two paper side segments. The first yarn of the interchanging weft binder yarn pairs provides a first paper side segment of 6 paper side warp yarns, moves between the top and bottom layers to provide two internal binder float regions of 3 and 2 warp pairs respectively, and between said internal float regions binds to two bottom warp yarns with a binder yarn knuckle separation of two warp yarns to provide a binder stiffening section in regions underlying said second segment. The second yarn of the interchanging weft binder yarn pairs provides a second paper side segment of 8 paper side warp yarns, moves between the top and bottom layers to provide two internal binder float regions of 2 warp pairs each, and between said internal float regions binds to two bottom warp yarns with a binder yarn knuckle separation of one warp yarn in regions underlying said first segment.

In a further embodiment, a 28 shaft triple-layer fabric contains pairs of interchanging weft binder yarns which interchange to provide two paper side segments. The first yarn of the interchanging weft binder yarn pairs provides a first paper side segment of 6 paper side warp yarns, moves between the top and bottom layers to provide two internal binder float regions of 4 warp pairs each, and between said internal float regions binds to a single bottom warp yarn in regions underlying said second segment. The second yarn of the interchanging weft binder yarn pairs provides a second paper side segment, but of 8 paper side warp yarns, moves between the top and bottom layers to provide two internal binder float regions of 3 warp pairs each, and between said internal float regions binds to a single bottom warp yarn in regions underlying said first segment. This embodiment utilizes a different arrangement of MD-CD interlacings in the wear side fabric layer in comparison to the first three 28 shaft embodiments described above.

In yet a further embodiment of this invention, a 28 shaft triple-layer fabric with the same arrangement of MD-CD interlacings in the wear side fabric as the embodiment described in the preceding paragraph, contains pairs of interchanging weft binder yarns which interchange to provide two paper side segments. The first yarn of the interchanging weft binder yarn pairs provides a first paper side segment of 10 paper side warp yarns, moves between the top and bottom layers to provide two internal binder float regions each of 2 warp pairs, and between said internal float regions binds to a single bottom warp yarn in regions underlying said second segment. The second yarn of the interchanging weft binder yarn pairs provides a second paper side segment of 4 paper side warp yarns, moves between the top and bottom layers to provide two internal binder float regions of 2 warp pairs each, and between said internal float regions binds to three bottom warp yarns with a binder yarn knuckle separation of two warp yarns between the first and second of the bound warps and between the second and the third of the bound warps to provide two binder stiffening sections in regions underlying said first segment.

In yet another embodiment of this invention, a 32 shaft triple-layer fabric contains pairs of interchanging weft binder yarns which interchange to provide two paper side segments. The first yarn of the interchanging weft binder yarn pairs provides a first paper side segment of 8 paper side warp yarns, moves between the top and bottom layers to provide two internal binder float regions each of 2 warp pairs, and between said internal float regions binds to two bottom warp yarns with a binder yarn knuckle separation of three warp yarns to provide a binder stiffening section in regions underlying said second segment. The second yarn of the interchanging weft binder yarn pairs provides a second paper side segment of 8 paper side warp yarns, moves between the top and bottom layers to provide two internal binder float regions of 2 warp pairs each, and between said internal float regions binds to two bottom warp yarns with a binder yarn knuckle separation of three warp yarns to provide a binder stiffening section in regions underlying said first segment.

In yet another embodiment of this invention, a 40 shaft triple-layer fabric contains pairs of interchanging weft binder yarns which interchange to provide two paper side segments. The first yarn of the interchanging weft binder yarn pairs provides a first paper side segment of 10 paper side warp yarns, moves between the top and bottom layers to provide two internal binder float regions of 2 and 3 warp pairs, respectively, and between said internal float regions binds to two bottom warp yarns with a binder yarn knuckle separation of four warp yarns to provide a binder stiffening section in regions underlying said second segments. The second yarn of the interchanging weft binder yarn pairs provides a second paper side segment of 10 paper side warp yarns, moves between the top and bottom layers to provide two internal binder float regions of 2 and 3 warp pairs, respectively, and between said internal float regions binds to two bottom warp yarns with a binder yarn knuckle separation of four warp yarns to provide a binder stiffening section in regions underlying said first segment.

In yet a further embodiment of this invention, a 40 shaft, triple-layer fabric contains pairs of interchanging weft binder yarns which interchange to provide two paper side segments. The two members of each binder pair cooperate in an identical manner to those in the embodiment described in the immediately preceding paragraph. However, the relative positioning of the interchange points of at least some binder pairs on the paper side is modified, as is the relative positioning of knuckles of at least some binder pairs on the outside of the wear side fabric.

In yet another embodiment of this invention, a 40 shaft triple-layer fabric contains pairs of interchanging weft binder yarns which interchange to provide two paper side segments. The first yarn of the interchanging weft binder yarn pairs provides a first paper side segment of 10 paper side warp yarns, moves between the top and bottom layers to provide two internal binder float regions of 2 and 3 warp pairs respectively, and between said internal float regions binds to two bottom warp yarns with a binder yarn knuckle separation of four warp yarns to provide a binder stiffening section in regions underlying said second segment. The second yarn of the interchanging weft binder yarn pairs provides a second paper side segment of 10 paper side warp yarns, moves between the top and bottom layers to provide two internal binder float regions of 2 and 3 warp pairs, respectively, and between said internal float regions binds to two bottom warp yarns with a binder yarn knuckle separation of four warp yarns to provide a binder stiffening section in regions underlying said first segment. The weave pattern chosen for the wear side fabric in this 40 shaft embodiment is different from that used for the prior 40 shaft embodiments described above.

In yet another embodiment of this invention, a 48 shaft triple-layer fabric contains pairs of interchanging weft binder yarns which interchange to provide two paper side segments. The first yarn of the interchanging weft binder yarn pairs provides a first paper side segment of 12 paper side warp yarns, moves between the top and bottom layers to provide two internal binder float regions each of 3 warp pairs, and between said internal float regions binds to two bottom warp yarns with a binder yarn knuckle separation of five warp yarns to provide a binder stiffening section in regions underlying said second segment. The second yarn of the interchanging weft binder yarn pairs provides a second paper side segment of 12 paper side warp yarns, moves between the top and bottom layers to provide two internal binder float regions of 3 warp pairs each, and between said internal float regions binds to two bottom warp yarns with a binder yarn knuckle separation of five warp yarns to provide a binder stiffening section in regions underlying said first segment.

In a further embodiment of this invention, a 100 shaft, triple-layer fabric contains pairs of interchanging weft binder yarns which interchange to provide two paper side segments. The first yarn of the interchanging weft binder yarn pairs provides a first paper side segment of 20 paper side warp yarns, moves between the top and bottom layers to provide two internal binder float regions of 2 and 3 warp pairs, respectively, and between said internal float regions binds to six bottom warp yarns with a binder yarn knuckle separation of four warp yarns between each pair of bound bottom warp yarns to provide five (5) binder stiffening sections in regions underlying said second segment. The second yarn of the interchanging weft binder yarn pairs provides a second paper side segment of 30 paper side warp yarns, moves between the top and bottom layers to provide two internal binder float regions of 2 and 3 warp pairs, respectively, and between said internal float regions binds to four bottom warp yarns with a binder yarn knuckle separation of four warp yarns between each pair of bound bottom warp yarns to provide three (3) binder stiffening sections in regions underlying said first segment.

In a final embodiment of this invention, a 21 shaft, triple-layer fabric with a paper side to wear side MD ratio of 2:1 (i.e., 14 paper side warps and 7 wear side warps within each repeat) contains pairs of interchanging weft binder yarns which interchange to provide two paper side segments. The first yarn of the interchanging weft binder yarn pairs provides a first paper side segment of 8 paper side warp yarns, moves between the top and bottom layers to provide one internal binder float region of 3 paper side/2 wear side warps and a further internal float region of 2 paper side/1 wear side warp, respectively, and between said internal float regions binds to one bottom warp yarn in regions underlying said second segments. The second yarn of the interchanging weft binder yarn pairs provides a second paper side segment of 6 paper side warp yarns, moves between the top and bottom layers to provide two internal binder float regions of 4 paperside/2 wear side and 3 paperside/2 wear side warps, respectively, and between said internal float regions binds to one bottom warp yarn in regions underlying said first segments.

Preferably, at least 50% of the pairs of intrinsic interchanging yarns, and most preferably 100% of such pairs, are intrinsic, interchanging weft binder yarn pairs providing 2 segments within each weave repeat, as described above. However, it is within the scope of this invention to also include within the fabrics other types of intrinsic interchanging weft yarn pairs other than binder yarn pairs, such as "intrinsic top weft yarn/binder yarn pairs" (hereinafter defined) and "intrinsic top weft yarn/top weft yarn pairs," (hereinafter defined), in combination with the plurality of intrinsic, interchanging weft binder yarn pairs.

As used throughout this application, "intrinsic top weft yarn/binder yarn pairs" means a pair of interchanging yarns wherein one yarn of the pair; namely the binder yarn of the pair, forms the weft path in the paper side surface of the paper side layer in a first segment of each repeat of the weave pattern and then drops down to encircle at least one warp yarn in the machine side layer in a region underlying an adjacent second segment in the paper side layer. The intrinsic top weft yarn of the top weft yarn/binder yarn pair forms the weft path in a second segment in the paper side layer within each repeat of the weave pattern that is not occupied by the binder yarn of the pair, and then drops out of the paper side layer to float between the paper side layer and machine side layer in the first segment within each repeat of the weave pattern, without in any way binding the paper side layer to the machine side layer within the weave repeat. A "top weft yarn/binder yarn pair" is illustrated in FIG. 2(*b*) of International Publication No. WO 02/14601, the subject matter of which is incorporated herein by reference.

As used throughout this application, reference to "intrinsic top weft yarn/top weft yarn pair" refers to a pair of intrinsic interchanging yarns wherein each yarn forms the cross direction weave path in alternate segments of the paper side surface and then drops down to float between the paper side layer and the machine side layer in the remaining segments within the repeat, and then, after floating between the paper side layer and machine side layer, moves back into the paper side layer to provide a continuation of the weft path in the fabric. One yarn of the weft yarn/weft yarn pair floats between the paper side layer and the machine side layer in a region underlying the segment in which the other weft yarn of the pair forms the weft path in the paper side surface, and then moves up into the paper side surface in an adjacent segment to form the weft path in that segment of the paper side surface overlying the portion of the other weft yarn of the pair that has moved out of the paper side layer to float between the paper side layer and machine side layer in such adjacent segment. Thus, each of the weft yarn/weft yarn pairs cooperates to provide a continuous unbroken weft path across the paper side surface and also includes segments that float between the paper side layer and the machine side layer to stiffen the fabric. However, neither yarn of the weft yarn/weft yarn pairs cooperates to bind the paper side layer and the machine side layer together.

BRIEF DESCRIPTION OF THE DRAWINGS

FIG. 1 is a cross sectional view of a 20 shaft, triple-layer fabric of the prior art showing the weave paths of all CD yarns in a full repeat of the total fabric weave comprising 10 paper side wefts, 10 wear side wefts, and, 10 pairs of interchanging binder weft yarns, said prior art fabric being shown for comparative purposes;

FIG. 2 is a cross sectional view of a 28 shaft, triple-layer fabric of the current invention showing the weave paths of all CD yarns in a full repeat of the total fabric weave comprising 14 paper side wefts, 14 wear side wefts, and, 14 pairs of interchanging binder weft yarns;

FIG. 2A is a diagram of the transition points of the embodiment of the invention illustrated in FIG. 2 showing by "x's" the transitional warp yarns at which the pairs of interchanging yarns interchange positions. This diagram does not depict the weave pattern of the warp yarns with any non-interchanging weft yarns.

FIG. 3 is a cross sectional view of another 28 shaft, triple-layer fabric of the current invention showing the weave paths of all CD yarns in a full repeat of the total fabric weave comprising 14 paper side wafts, 14 wear side wefts, and, 14 pairs of interchanging binder weft yarns;

FIG. 3A is a diagram of the transition points of the embodiment of the invention illustrated in FIG. 3 showing by "x's" the transitional warp yarns at which the pairs of interchanging yarns interchange positions. This diagram does not depict the weave pattern of the warp yarns with any non-interchanging weft yarns.

FIG. 4 is a cross sectional view of another 28 shaft, triple-layer fabric of the current invention showing the weave paths of all CD yarns in a full repeat of the total fabric weave comprising 14 paper side wefts, 14 wear side wefts, and, 14 pairs of interchanging binder weft yarns;

FIG. 4A is a diagram of the transition points of the embodiment of the invention illustrated in FIG. 4 showing by "x's" the transitional warp yarns at which the pairs of interchanging yarns interchange positions. This diagram does not depict the weave pattern of the warp yarns with any non-interchanging weft yarns.

FIG. 5 is a cross sectional view of a fourth 28 shaft, triple-layer fabric of the current invention showing the weave paths of all CD yarns in a full repeat of the total fabric weave comprising 14 paper side wefts, 14 wear side wefts, and, 14 pairs of interchanging binder weft yarns;

FIG. 5A is a diagram of the embodiment of the invention illustrated in FIG. 5 showing by "x's" the transitional warp yarns at which the pairs of interchanging yarns interchange positions. This diagram does not depict the weave pattern of the warp yarns with any non-interchanging weft yarns.

FIG. 6 is a cross sectional view of a fifth 28 shaft, triple-layer fabric of the current invention showing the weave paths of all CD yarns in a full repeat of the total fabric weave comprising 14 paper side wefts, 14 wear side wefts, and, 14 pairs of interchanging binder weft yarns;

FIG. 6A is a diagram of the embodiment of the invention illustrated in FIG. 6 showing by "x's" the transitional warp yarns at which the pairs of interchanging yarns interchange positions. This diagram does not depict the weave pattern of the warp yarns with any non-interchanging weft yarns.

FIG. 7 is a cross sectional view of a 32 shaft, triple-layer fabric of the current invention showing the weave paths of all CD yarns in a repeat of one-half of the total fabric weave, the half repeat comprising 8 paper side wefts, 8 wear side wefts, and, 8 pairs of interchanging binder weft yarns; the full repeat of the total fabric weave comprising 16 paper side wefts, 16 wear side wefts, and, 16 pairs of interchanging binder weft yarns;

FIG. 7A is a diagram of the embodiment of the invention illustrated in FIG. 7 showing by "x's" the transitional warp yarns at which all of the pairs of interchanging yarns in a full weave repeat interchange positions. This diagram does not depict the weave pattern of the warp yarns with any non-interchanging weft yarns;

FIG. 8 is a cross sectional view of a 40 shaft, triple-layer fabric of the current invention showing the weave paths of all CD yarns in a full repeat of the total fabric weave comprising 20 paper side wefts, 20 wear side wefts, and, 20 pairs of interchanging binder weft yarns;

FIG. 8A is a diagram of the embodiment of the invention illustrated in FIG. 8 showing by "x's" the transitional warp yarns at which the pairs of interchanging yarns interchange positions. This diagram does not depict the weave pattern of the warp yarns with any non-interchanging weft yarns.

FIG. 9 is a cross sectional view of a second 40 shaft, triple-layer fabric of the current invention showing the weave paths of all CD yarns in a full repeat of the total fabric weave comprising 10 paper side wefts, 10 wear side wefts, and, 10 pairs of interchanging binder weft yarns;

FIG. 9A is a diagram of the embodiment of the invention illustrated in FIG. 9 showing by "x's" the transitional warp yarns at which the pairs of interchanging yarns interchange positions. This diagram does not depict the weave pattern of the warp yarns with any non-interchanging weft yarns.

FIG. 10 is a cross sectional view of a third 40 shaft, triple-layer fabric of the current invention showing the weave paths of all CD yarns in a full repeat of the total fabric weave comprising 10 paper side wefts, 10 wear side wefts, and, 10 pairs of interchanging binder weft yarns;

FIG. 10A is a diagram of the embodiment of the invention illustrated in FIG. 10 showing by "x's" the transitional warp yarns at which the pairs of interchanging yarns interchange positions. This diagram does not depict the weave pattern of the warp yarns with any non-interchanging weft yarns.

FIG. 11 is a cross sectional view of a 48 shaft, triple-layer fabric of the current invention showing the weave paths of all CD yarns in a repeat of half of the total fabric weave, the half repeat comprising 24 paper side wefts, 24 wear side wefts, and, 12 pairs of interchanging binder weft yarns;

FIG. 11A is a diagram of the embodiment of the invention partially illustrated in FIG. 11 showing by "x's" the transitional warp yarns at which the pairs of interchanging yarns interchange positions. This diagram does not depict the weave pattern of the warp yarns with any non-interchanging weft yarns.

DESCRIPTION OF THE PREFERRED EMBODIMENTS OF THE INVENTION

Figure 12:
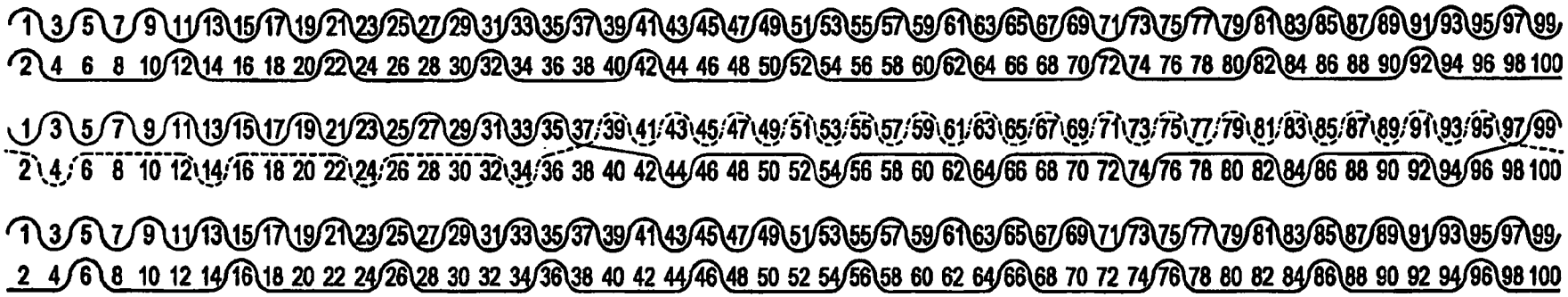
FIG. 12 is a partial cross sectional view of a 100 shaft triple-layer fabric of the current invention showing the weave paths of two pairs of paper side and wear side wefts, and one pair of interchanging binder wefts.

Referring to FIG. 1, the CD yarn paths are shown for the full fabric weave repeat of a prior art fabric 10 corresponding to the fabric shown in FIGS. 1 and 2 of the Ward '195 patent. The Ward '195 patent already has been incorporated by reference herein. The full fabric weave repeat shown in FIG. 1 consists of the following: 10 paperside weft yarns (T1, T2, T3 . . . T10); 10 wear side wefts yarns (B1, B2, B3 . . . B10); and 10 pairs of interchanging binder weft yarns (61*a/b*, 62*a/b*, 63*a/b* . . . 70*a/b*), such that 40 cross-direction yarns are required in total before the weave pattern repeats. Fabrics made according to the Ward '195 patent incorporate a so-called "reversing" of the binder yarns in adjacent binder weft yarn pairs. Interchanging binder pair 62*a/b* provides a single continuous paperside weft path. Yarn 62*a* (dotted line) interlaces with paperside warp yarns 30, 29, 28, 27, 21 and 22, whilst exiting the paperside surface adjacent paperside warp yarn 26 to thereby provide a 6 warp long segment of a single paperside weft path. Within the segment so provided, yarn 62*a* makes 3 separate knuckles above paperside warp yarns 21, 27, & 29. By contrast the other binder yarn 62*b* of the pair only provides a segment length of 4 warp yarns (viz 23, 24, 25, 26) containing 2 separate binder knuckles above paperside warp yarns 23 and 25. Consequently the segments provided by respective binders of the pair 62*a/b* are of different lengths (i.e., 6 warp yarns and 4 warp yarns, respectively, and the number of CD orientated knuckles provided in the segments also are different (i.e., 3 knuckles and 2 knuckles, respectively). This situation is repeated for all the binder pairs in the fabric weave pattern. The reversing technique of Ward involves alternating the sequence of long to short segments for adjacent binder pairs, e.g., pair 62*a/b* is woven with the 6 warp yarn long segment preceding the 4 warp yarn short segment. This arrangement is "reversed" for adjacent pairs 61*a/b* and 63*a/b* which are both so woven that their short 4 warp yarn segments precede their long 6 warp yarn segments. The reference to 6 and 4 adjacent to the two interchanging yarns of each binder pair refers to the order in which the segment lengths are inserted. The repeating sequence of the binder pairs, taking into account the reversing feature, is 10 binder pairs, i.e., it is necessary to weave 10 pairs of binder yarns (in addition to the intervening wearside and paperside weft yarns) before a pair of binder yarns is found that interlaces with the same paperside and wearside warp yarns and which continues the reversing sequence. Thus, although the wearside fabric weave sequence is complete after five weft yarns (B1-B5) and although the paperside weave sequence is complete after one paperside weft (e.g., T1) and one interchanging binder weft pair (e.g., 62*a/b*) it is necessary to weave a full 40 CD yarns (i.e., 10 paperside yarns, 10 wearside yarns, & the 20 yarns in 10 pairs of interchanging binder yarns) to complete the full weave sequence. If the reversing feature was not incorporated into fabric 10 it would be possible to complete the weave repeat using only 20 CD yarns (i.e., 5 paperside yarns, 5 wearside yarns, and 10 yarns or 5 pairs of interchanging binder yarns).

Embodiments of the invention which also have segments of different length will, unless otherwise stated, be illustrated to utilize the reversing feature described above. It is to be understood that "reversing" of binders in adjacent pairs could still be carried out to allow for distribution of different yarn materials or diameters, for example, even where the segment lengths are equal and the wearside interlacings also are equal.

It should be noted that hereinafter the pairs of interchanging binder weft yarns sometimes will be referred to collectively as 61 through 70, without the "a/b" suffix designating the individual yarns in each pair.

The fabric 10 has a twenty (20) shaft repeat, including a ten (10) warp top layer (21 through 30) having a paper side surface within each repeat, a ten (10) warp machine side layer (41 through 50) having a bottom wear side surface within each repeat and a plurality of pairs of first and second intrinsic interchanging weft binder yarns (61 *a/b* through 70*a/b*).

As illustrated in the weft path weave patterns depicted in FIG. 1, the top layer includes top warp yarns 21, 22, 23 . . . 30 within each repeat interwoven with top, i.e., paper side, weft yarns T1, T2 . . . T10 and top segments of the interlacing binder pairs 61, 62, 63 . . . 70 to form a plain weave.

The machine side, i.e., wear side, layer includes bottom warp yarns 41, 42, 43 . . . 50 within each repeat, interwoven with bottom, i.e. wear side, weft yarns B1, B2 . . . B10. The illustrated bottom weave pattern is a 5 shed repeat. In the wear side layer, therefore, 1 in every 5 wear side warp yarn-weft yarn interactions are warp interlacings beneath the weft yarn such that the weft yarn transfers to the interior of the fabric where it may disadvantageously interfere with the flow of water through the fabric and where it does not contribute to fabric wear resistance. This occurs for all wear side weft yarns and can be seen for example at wear side weft B1, which interlaces with wear side MD yarns 45 and 50, respectively. Consequently, in the fabric 10, 20% of the wear side warp-weft interactions are disposed as MD-CD interlacings to establish a wear side MD-CD interlacing percentage (WIP) of 20. It should be noted that the weave pattern of wear side weft yarns B1 through B5 with bottom warp yarns 41 through 50 is identical to the weave patterns of wear side weft yarns B6 through B10 with said bottom warp yarns.

In the 20 shaft fabric shown in FIG. 1 all paper side weft paths are made in plain weave, or so-called 2 shaft weave repeat Therefore there are 5 paper side layer repeats of the plain weave in the 10 paper side warp yarns within each 20 shaft repeat of the fabric. By contrast, all wear side weft paths are made in 5 shaft. Therefore, there are 2 repeats of the 5 shaft weave in the 10 wear side warp yarns within each 20 shaft repeat of the fabric. Consequently the ratio of paper side to wear side weave repeats for the fabric 10, which is the earlier described PWR value, is equal to 2.5 (i.e., 5/2). A higher PWR value could indicate a reduced frequency of wear side weft knuckles interfering with water flow through the fabric.

In the prior art structure illustrated in FIG. 1, the pairs of intrinsic, interchanging weft binder yarns 61 through 70 account for 50% of the cross-machine-direction weft pattern in the paper side layer; being located between each pair of top weft yarns, e.g., T1, T2. That is, every other weft yarn path in the paper side layer 12 is provided by an intrinsic, interchanging weft binder yarn pair.

As is shown in FIG. 1, each pair 61*a/b*, 62*a/b* . . . 70*a/b* of intrinsic, interchanging weft binder yarns includes two segments in the paper side layer within each repeat of the weave pattern in the composite fabric. The two segments of the intrinsic interchanging weft binder yarns in the top layer provide an unbroken weft path in the paper side surface, with each succeeding segment being separated in the paper side surface of the top layer by a top layer transitional warp yarn, e.g., top warp yarns 26 and 22 in the binder pair 62 and top warp yarns 24 and 30 in the binder pair 61 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" or "transition points" or "interchange points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat.

As illustrated in FIG. 1, a first yarn 62*a* of the interchanging weft binder pair 62, which is shown in dotted line representation, provides a first segment in the paper side layer. This first segment comprises paper side warp yarns 21, 30, 29, 28, 27 & transitional warp yarn 22; i.e. a total of 6 warp yarns including the transitional warp yarn 22. Therefore, a segment length of 6 is provided by the yarn 62*a*. The yarn 62*a* cooperates with the yarn 62*b*, which is shown in solid line representation, to provide a continuous weft path in the paper side fabric, which, as illustrated, is a plain weave. The yarn 62*b* provides a second segment in the paper side layer by interlacing with paper side warp yarns 25, 24, 23 and transitioning under warp 26 such that a segment length of 4 is provided.

Segment lengths of 4 and 6 are relatively short, i.e., they produce a relatively high frequency of binder interchange points. Each interchange point tends to sit relatively low in the paperside surface of the fabric such that a greater fiber mass may accrue at each such region thereby adversely effecting the uniformity of the paperside and occasioning wiremark. A variety of values can be employed to identify the occurrence of binder interchange points in the fabric paper side, e.g.:

The percentage of the total paper side warp and binder weft interactions that occurs as interchange points within each weave repeat, which is the IPP value described earlier herein. In FIG. 1, interchange points for binder pair 62*a/b* occur at yarns 22 and 26 respectively, such that 2 in every 10 interactions within the weave repeat occur as interchange points. All other binder pairs also have 2 interchange points per 10 paper side warp yarns within each repeat, such that an IPP value of 20 results (IPP=2/10×100). A lower IPP value can indicate a fabric with reduced occurrence, or frequency, of interchange points and is desirable to decrease regions in the fabric paper side which can cause sheet wire marks;

The percentage of the fabric's warp yarns within the weave repeat that occurs as transitional warp yarns, which is the earlier identified ITP value. In other words the average occurrence of binder interchange points for a binder pair expressed as a percentage of the total number of warp yarns in the fabric weave repeat (i.e., the total in both the top and bottom layers). In the 20 shaft fabric 10 shown in FIG. 1 there is an average of 2 binder interchange points per binder pair within each weave repeat. Accordingly an ITP value of 10 is obtained for fabric 10, i.e., ITP=2/20×100).

The ratio of the number of binder pair interchange points within each paper side layer weave repeat, for a representative binder pair, to the number of weave repeats in the wear side layer over the same fabric unit width as the weave repeat width in the paper side layer, which is the earlier identified IWR value. In other words, in the fabric 10, the average occurrence of binder interchange points for a binder pair within each paper side layer weave repeat is 2. Likewise, within this same unit width, there are two weave repeats of the wear side weft yarns. Thus the IWR value is 2:2=1.

The ratio of the number of binder pair interchange points within each paper side layer weave repeat, for a representative binder pair, to the number of wear side weave warp knuckles over the same fabric unit width as the weave repeat width in the paper side layer, which is the earlier identified WKR value. In the fabric 10, the average occurrence of binder interchange points for a binder pair within each paper side layer weave repeat is 2. Likewise, within this same unit width, there are two wear side warp knuckles. Thus the WKR value is 2:2=1.

Thus, the prior art fabric 10 disclosed in FIG. 1 includes the following parameters:

WIP=20; PWR=2.5; IPP=20; ITP=10; IWR=1 and WKR=1

As will become clear from the detailed description that follows, the fabrics of this invention have various advantageous features that are not disclosed or suggested in the prior art structures. All of the illustrated embodiments of this invention have an IPP value less than 20, and an ITP value less than 10.

Referring to FIG. 2, a first embodiment of a fabric in accordance with this invention is illustrated at 20; showing a single full fabric weave repeat and comprising 14 paper side wefts (T1, T2, T3 . . . T14), 14 wear side wefts (B1, B2, B3 . . . B14), and 14 pairs of interchanging, binder weft yarns (I1/2, I3/4, I5/6 . . . I27/28).

The fabric 20 has a twenty (28) shaft repeat, including a fourteen (14) warp top layer (1, 3, 5, . . . 27) having a paper side surface within each repeat, a fourteen (14) warp machine side layer (2, 4, 6, . . . 28) having a bottom wear side surface within each repeat and a plurality of pairs of first and second intrinsic interchanging weft binder yarns (I1/2 through I27/28).

As illustrated in the weft path weave patterns depicted in FIG. 2, the top layer includes top warp yarns 1, 3, 5 . . . 27 within each repeat interwoven with top, i.e., paper side, weft yarns T1, T2 . . . T14 and top segments of the interlacing binder pairs I1/2, I3/4, I5/6 . . . I27/28 to form a plain weave. Specifically, T1 through T14 each forms a plain weave pattern with the top warp yarns, and interlacing, or interchanging, binder yarn pairs I1/2 through I13/14 provide identical weave paths with the top warp yarns (and also with the bottom warp yarns) as interlacing, or interchanging, binder yarn pairs I15/16 through I27/28, respectively, and said interlacing binder yarn pairs cooperate with the top warp yarns to form a plain weave pattern. Two "repeats" of the binder yarn pair weave sequence are required in each full repeat to allow for reversing of the order of the segment lengths in adjacent binder weft pairs.

The machine side, i.e., wear side, layer includes bottom warp yarns 2, 4, 6, . . . 28 within each repeat, interwoven with bottom, i.e. wear side, weft yarns B1, B2 . . . B14. The wear side weave patterns of wear side weft yarns B1 through B7 are identical to the wear side weave patterns of wear side weft yarns B8 through B14, respectively.

It is to be noted that in many instances commercial forming fabrics are not made with all wearside wefts utilizing identical material. Instead some fabrics may be made with adjacent wearside weft yarns utilizing different raw materials e.g. B1 could be polyester and B2 could be a more wear resistant type material such as polyamide. In such a case for FIG. 2 a full 14 wearside weft yarns are required to avoid irregularity in the alternating sequence of polyester-polyamide yarns. All the embodiments of the invention allow for this wearside weft arrangement. Fabrics of this invention are not restricted to alternating wearside yarns of different material (and/or diameter). It may be desirable to incorporate 2 wearside polyester yarns for every 1 wearside polyamide or vice versa. It also may be desired to utilize a different ratio of unlike wearside weft yarns to optimize the fabric stability/life features. The fabric weave pattern can be adjusted accordingly, as will be understood by people skilled in the art.

Returning to FIG. 2, the illustrated bottom weave pattern is a 7 shed repeat, with each wear side weft yarn passing under six adjacent bottom warp yarns and then forming a knuckle over one bottom warp yarn. In the wear side layer, therefore, 1 in every 7 wear side warp yarn-weft yarn interactions are warp interlacings beneath the weft yarn such that the weft yarn transfers to the interior of the fabric where it may disadvantageously interfere with the flow of water through the fabric and where it will not contribute to fabric wear resistance. However, this occurs in only one of every 7 consecutive bottom warp locations. Moreover, this relationship exists for all wear side weft yarns, as can be seen for example at wear side weft B1, which interlaces with wear side MD yarns 2 and 16, respectively. Consequently, in the fabric 20, 14.3% of the wear side warp and weft yarn interactions within each weave repeat are wear side warp-weft interlacings (i.e., 2 out of 14) to establish a wear side MD-CD interlacing percentage (WIP) of 14.3.

In the 28 shaft fabric shown in FIG. 2 all paper side weft paths are made in plain weave, or so-called 2 shaft weave repeat. Therefore, there are 7 paper side layer weave repeats of the plain weave, in the 14 paper side warp yarns within each 28 shaft repeat of the fabric. By contrast, all non-interchanging wear side weft paths are made in 7 shaft repeats. Therefore, there are 2 repeats of the 7 shaft weave in the 14 wear side warp yarns within each 28 shaft repeat of the fabric. Consequently the ratio of paper side to wear side weave repeats for the fabric 20, which is the earlier described PWR value, is 3.5 (i.e., 7/2). A higher PWR value could indicate a reduced frequency of wear side weft knuckles interfering with water flow through the fabric, which is actually the case when comparing fabric 20 of this invention with fabric 10 of the prior art.

In the fabric 20 illustrated in FIG. 2, the pairs of intrinsic, interchanging weft binder yarns I1/2 through I27/28 account for 50% of the cross-machine-direction weft pattern in the paper side layer; being located between each pair of top weft yarns, e.g., T1, T2. That is, every other weft yarn path in the paper side layer is provided by an intrinsic, interchanging weft binder yarn pair.

As is shown in FIG. 2, each pair of intrinsic, interchanging weft binder yarns I1/2 through I27/28 includes two segments in the paper side layer within each repeat of the weave pattern in the composite fabric. The two segments of the intrinsic interchanging weft binder yarns in the top layer, provide an unbroken weft path in the paper side surface, with each succeeding segment being separated in the paper side surface of the top layer by a top layer transitional warp yarn, e.g., top warp yarns 9 and 25 in the binder pair I1/2 and top warp yarns 1 and 13 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat, i.e., 2 in fabric 20.

Referring to FIG. 2A, a diagram of the top layer transitional points shows the transitional points by the designation "x", which are the uppermost surface of the transitional warp yarns. The 14 warp yarns within each repeat of the upper layer are designated by the 14 vertical columns of the diagram, and the 14 pairs of interchanging binder yarns within the fabric repeat are indicated by the horizontal rows of the diagram.

As illustrated in FIG. 2, a first yarn I1 of the interchanging weft binder pair I1/2 of fabric 20, which is depicted as a dotted line, provides a first segment in the paper side layer. That segment comprises paper side warp yarns 11, 13, 15, 17, 19, 21, 23 & transitional warp yarn 9; i.e. a total of 8 warp yarns including the transitional warp yarn 25. Therefore a segment length of 8 is provided by the binder yarn I1, and this segment length includes 4 knuckles (i.e., over warp yarns 11, 15, 19 and 23). The binder yarn I1 cooperates with the binder yarn I2 to provide a continuous weft path in the paper side fabric layer, which, as illustrated, is a plain weave.

The binder yarn I2, which is shown as a solid line, provides a second segment in the paper side layer by interlacing with paper side warp yarns 27, 1, 3, 5, 7 and transitioning warp yarn 25, such that a segment length of 6 is provided. In this segment length I2 includes 3 knuckles (i.e., over warp yarns 27, 3 and 7). Thus, the two interchanging binder yarns I1 and I2 cooperate to provide different segment lengths of 8 and 6, respectively. These same segment lengths are provided by all of the interchanging binder yarn pairs in the fabric 20. However, the sequence in which the segment lengths of 6 and 8 are provided by adjacent pairs of interchanging binder wefts are illustrated as being reversed. This is reflected in the use of 14 binder pairs in FIG. 2. By way of example, where reversing occurs in a fabric according to FIG. 2, then interchanging binder pair I3/I4 will be inserted such that binder yarn 13, which is represented by the solid line binder, interlaces with paper side warps 1, 3, 5, 7, 9 and 11 to form 3 knuckles, and also with wearside warp yarn 22. Binder yarn 14, which is represented by the dotted line binder, interlaces with paper-side warps 13, 15, 17, 19, 21, 23, 25 and 27 and also with wearside warp yarns, such that the segment lengths of 6 and 8 for I3/I4, respectively, are woven in reverse order to the segment lengths of 8 and 6 for I1/I2, respectively.

As should be noted, the segment lengths of 6 and 8 for the interchanging binder yarn pairs in fabric 20 are greater than the segment lengths of 4 and 6 for the prior art fabric 10 illustrated in FIG. 1. These longer segments provide a reduced frequency of binder interchange points, and so reduce occurrences in the fabric surface of non-planarity to thereby minimize the formation of undesired wire marks in the formed sheet.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 20 has the following values: WIP=14.3; PWR=3.5; IPP=14.3; ITP=7.1; IWR=1 and WKR=1.

It is desirable in the fabrics of this invention to minimize the length of internal floats of the interchanging binder yarns to thereby minimize void volume within the fabric, which, in turn, minimizes undesired water retention properties of the fabric. The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 20 illustrated in FIG. 2, one binder yarn of each pair has a float length of 3 between leaving the top layer and commencing to interlace with a bottom warp yarn, and a float length of 3 as it completes its interlacing with the bottom warp yarn and moves back into the top layer. The other yarn of each pair has a float length of 4 between leaving the top layer and commencing to interlace with a bottom warp yarn, and a float length of 4 as it completes its interlacing with the bottom warp yarn and moves back into the top layer. For example, the binder yarn I1 (dotted line presentation) leaves the top layer adjacent transition top warp yarn 25 and passes between top and bottom warp yarn pairs 25-26, 27-28 and 1-2 (i.e., 3 pairs=float of 3) before interlacing with bottom warp yarn 4. I1 then passes between top and bottom warp yarn pairs 5-6, 7-8 and 9-10 (i.e., 3 pairs=float of 3) before interlacing with top warp yarn 11 of the top layer. The other binder yarn I2 of the pair (solid line presentation) leaves the top layer adjacent transition warp yarn 9 and passes between top and bottom warp yarn pairs 9-10, 11-12, 13-14 and 1-2 (i.e., 4 pairs=float of 4) before interlacing with bottom warp yarn 18. I2 then passes between top and bottom warp yarn pairs 19-20, 21-22, 23-24 and 25-26 (i.e., 4 pairs=float of 4) before interlacing with top warp yarn 27 of the top layer. Thus I1 has two internal floats of 3 and I2 has two internal floats of 4 within each repeat of the weave pattern. Although this structure is within the broadest scope of this invention, it is desirable to reduce the total of all float lengths within each weave repeat, relative to the total float length of fourteen (14) (3+3+4+4) provided in fabric 20.

Still referring to FIG. 2, it should be noted that the interlacing of each binder yarn pair with a bottom warp yarn is "locked" to thereby stabilize the structure. The meaning of "locked" was described earlier in this application and will not be repeated herein for purposes of brevity. By way of example, the interlacing of interchanging bind yarn I2 with bottom warp 18 is locked by the weave pattern of adjacent bottom weft yarns B1, on one side of I2, and B2, on the other side of I2. Specifically, B1 interlaces with bottom warp 16, which is immediately adjacent one side of bottom warp 18, and B2 interlaces with bottom warp 20, which is immediately adjacent the other side of bottom warp 18. This arrangement locks the interlacing of interchanging binder yarn I2 with bottom warp 18. This same relationship exists for each interchanging binder yarn. That is, non-interchanging bottom weft yarns on each side of each interchanging binder yarn binds with bottom warp yarns on each side of, and adjacent to the bottom warp yarn bound by such interchanging binder yarn.

Referring to FIG. 3, a second embodiment of a fabric in accordance with this invention is illustrated at 30; showing the full weave paths for all paper side wefts (T1, T2, T3 . . . T14), wear side wefts (B1, B2, B3 . . . B14), and interchanging binder weft pairs (I1/2, I3/4, I5/6 . . . I27/28). As will be discussed in detail hereinafter, except for the arrangement of the interchanging binder pairs, the fabric 30 is the same as the fabric 20.

Specifically the fabric 30, like the fabric 20, has a twenty-eight (28) shaft repeat, including a fourteen (14) warp top layer (1, 3, 5, . . . 27) having a paper side surface within each repeat, a fourteen (14) warp machine side layer (2, 4, 6, . . . 28) having a bottom wear side surface within each repeat and a plurality of pairs of first and second intrinsic interchanging weft binder yarns (I1/2 through I27/28).

As illustrated in the weft path weave patterns depicted in FIG. 3, the top layer includes top warp yarns 1, 3, 5 . . . 27 within each repeat interwoven with top, i.e., paper side, weft yarns T1, T2 . . . T14 and top segments of the interlacing binder pairs I1/2, I3/4, I5/6 . . . I27/28 to form a plain weave. Specifically, T1 through T14 each forms a plain weave pattern with the top warp yarns, and interlacing, or interchanging, binder yarn pairs I1/2 through I13/14 provide identical weave paths with the top warp yarns (and also with the bottom warp yarns) as interlacing, or interchanging, binder yarn pairs I15/16 through I27/28, respectively, and said interlacing binder yarn pairs cooperate with the top warp yarns to form a plain weave pattern.

As with the fabric 10 shown in FIG. 2, it should be noted that in the fabric 30 the insertion order of the binder pairs reverses such that the full fabric weave repeat requires the use of 14 paperside wefts, 14 wearside wefts and 28 interchanging binder yarns to give 56 cross direction (CD) yarns in total.

This reversal is shown in FIG. 3, by the numbers "4" or "3" to the immediate left of each yarn of each binder pair, which represent the number of paper side knuckles provided by the identified yarn, e.g., I1 forms 4 knuckles and I2 forms 3 knuckles, whereas I3 forms 3 knuckles and I4 forms 4 knuckles.

The machine side, i.e., wear side, layer includes bottom warp yarns 2, 4, 6, . . . 28 within each repeat, interwoven with bottom, i.e., wear side, weft yarns B1, B2 . . . B14. The wear side weave patterns of wear side weft yarns B1 through B7 are identical to the wear side weave patterns of wear side weft yarns B8 through B14, respectively.

The illustrated bottom weave pattern is a 7 shed repeat, with each wear side weft yarn passing under six adjacent bottom warp yarns and then forming a knuckle over one bottom warp yarn. In the wear side layer, therefore, 1 in every 7 wear side warp yarn-weft yarn interactions is a warp interlacing beneath the weft yarn such that the weft yarn transfers to the interior of the fabric where it may disadvantageously interfere with the flow of water through the fabric and where it will not contribute to fabric wear resistance. However, this occurs in only one of every 7 consecutive bottom warp locations. Moreover, this relationship exists for all wear side weft yarns, as can be seen for example at wear side weft B1, which interlaces with wear side MD yarns 2 and 16, respectively. Consequently, in the fabric 30, 14.3% of the wear side warp and weft yarn interactions within each weave repeat are wear side warp-weft interlacings (i.e., 2 out of 14) to establish a wear side MD-CD interlacing percentage (WIP) of 14.3.

In the 28 shaft fabric 30 shown in FIG. 3 all paper side weft paths are made in plain weave, or so-called 2 shaft weave repeat. Therefore there are 7 paper side layer weave repeats of the plain weave in the 14 paper side warp yarns within each 28 shaft repeat of the fabric. By contrast, all non-interchanging wear side weft paths are made in 7 shaft repeats. Therefore, there are 2 repeats of the 7 shaft weave in the 14 wear side warp yarns within each 28 shaft repeat of the fabric. Consequently the ratio of paper side to wear side weave repeats for the fabric 30, which is the earlier described PWR value, is equal to 3.5 (i.e., 7/2). A higher PWR value could indicate a reduced frequency of wear side weft knuckles interfering with water flow through the fabric, which is actually the case when comparing fabric 30 of this invention with fabric 10 of the prior art.

In the fabric 30 illustrated in FIG. 3, like the fabric 20 illustrated in FIG. 2, the pairs of intrinsic, interchanging weft binder yarns I1/2 through I27/28 account for 50% of the cross-machine-direction weft pattern in the paper side layer; being located between each pair of top weft yarns, e.g., T1, T2. That is, every other weft yarn path in the paper side layer is provided by an intrinsic, interchanging weft binder yarn pair. As will be explained hereinafter, the difference in structure between fabric 20 shown in FIG. 2 and fabric 30 shown in FIG. 3 resides in the weave pattern of the interchanging weft binder yarn pairs.

As is shown in FIG. 3, each pair of intrinsic, interchanging weft binder yarns I1/2 through I27/28 includes two segments in the paper side layer within each repeat of the weave pattern in the composite fabric. The two segments of the intrinsic interchanging weft binder yarns in the top layer provide an unbroken weft path in the paper side surface, with each succeeding segment being separated in the paper side surface of the top layer by a top layer transitional warp yarn, e.g., top warp yarns 5 and 17 in the binder pair I1/2 and top warp yarns 9 and 21 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat i.e., 2 in fabric 30.

Referring to FIG. 3A, a diagram of the top layer transitional points of fabric 30 shows the transition points by the designation "x," which correspond to the uppermost surface of the transitional warp yarns. The 14 warp yarns within each repeat of the upper layer are designated by the 14 vertical columns of the diagram and the 14 pairs of interchanging binder yarns within the fabric repeat are indicated by the horizontal rows of the diagram.

As illustrated in FIG. 3, a first yarn I1 of the interchanging weft binder pair I1/2 of fabric 30, which is depicted as a dotted line, provides a first segment in the paper side layer. That segment comprises paper side warp yarns 19, 21, 23, 25, 27, 1, 3 & transitional warp yarn 17; i.e. a total of 8 warp yarns including the transitional warp yarn 17. Therefore, a segment length of 8 is provided by the binder yarn I1. The binder yarn I1 cooperates with the binder yarn I2 to provide a continuous weft path in the paper side fabric layer, which, as illustrated, is a plain weave.

The binder yarn I2, which is shown in solid representation, provides a second segment in the paper side layer by interlacing with paper side warp yarns 7, 9, 11, 13, 15 & transitional warp yarn 5; i.e., a total of 6 warp yarns including the transitional warp yarn 5. Therefore, a segment length of 6 is provided by the binder yarn I2. Thus, the two interchanging binder yarns I1 and I2 cooperate to provide segment lengths of 8 and 6, respectively, with 4 paperside knuckles and 3 paperside knuckles, respectively. These same segment lengths are provided by all of the interchanging binder yarn pairs in the fabric 30. However, as with the fabric 10 shown in FIG. 2, the sequence in which adjacent interchanging binder pairs provide the segments of 6 and 8 are reversed in this illustrated embodiment of the fabric 30.

As should be noted the segment lengths of 6 and 8 for the interchanging binder yarn pairs in fabric 30 are the same as in fabric 20 but are greater than the segment lengths of 4 and 6 for the prior art fabric 10 illustrated in FIG. 1. These longer segment lengths provide a reduced frequency of binder interchange points, and so reduce occurrences in the fabric surface of non-planarity to thereby minimize the formation of undesired wire marks in the formed sheet.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 30 has the following values: WIP 14.3;

PWR=3.5; IPP=14.3; ITP=7.1; IWR=1 and WKR=1. These are the same values as in the previously described fabric 20 (FIG. 2).

As stated earlier herein, it is desirable in the fabrics of this invention to minimize the length of internal floats of the interchanging binder yarns to thereby minimize void volume within the fabric, which, in turn, minimizes undesired water retention properties of the fabric. The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 30 illustrated in FIG. 3, one binder yarn of each pair has a float length of 2 between leaving the top layer and commencing to interlace with a bottom warp yarn, and a float length of 2 as it completes its interlacing with the bottom warp yarn and moves back into the top layer. The other yarn of each pair has a float length of 3 between leaving the top layer and commencing to interlace with a bottom warp yarn, and a float length of 3 as it completes its interlacing with the bottom warp yarn and moves back into the top layer. For example, the binder yarn I1 (dotted line) leaves the top layer adjacent transition top warp yarn 5 and passes between top and bottom warp yarn pairs 5-6 and 7-8 (i.e., 2 pairs=float of 2) before interlacing with bottom warp yarn 10. I1 then also binds to spaced-apart bottom warp yarn 14 and then passes between top and bottom warp yarn pairs 15-16 and 17-18 (i.e., 2 pairs=float of 2) before interlacing with top warp yarn 19 of the top layer. The other binder yarn I2 of the pair (solid line) leaves the top layer adjacent transition warp yarn 17 and passes between top and bottom warp yarn pairs 17-18, 19-20 and 21-22 (i.e., 3 pairs=float of 3) before interlacing with bottom warp yarn 24. I2 then also binds to spaced-apart bottom warp yarn 28 and then passes between top and bottom warp yarn pairs 1-2, 3-4 and 5-6 (i.e., 3 pairs=float of 3) before interlacing with the top warp yarn 7 of the top layer. Thus I1 has two internal floats of 2 and I2 has two internal floats of 3 within each repeat of the weave pattern. Therefore, the total float length within each weave repeat in fabric 30 is ten (10) (3+3+2+2=10), which is less than the total float length fourteen (14) of the fabric 20. This reduced float length minimizes void volume within the fabric, which, in turn, minimizes undesired water retention properties of the fabric 30 relative to the fabric 20.

Still referring to FIG. 3, it should be noted that, unlike fabric 20, the interlacing of each binder yarn pair with a bottom warp yarn in fabric 30 is "unlocked," which may permit some lateral shifting of the knuckles provided by the interlacing of the interchanging binder pairs (e.g., I1, I2) with the bottom warp yarns (e.g., 24, 26 and 28 with I1 and 10, 12 and 14 with I2). Bottom warp yarns 24, 26 and 28 constitute a single segment bound by I1, and bottom warp yarns 10, 12 and 14 constitute a single segment bound by I2. The meaning of "unlocked" was described earlier in this application and will not be repeated herein for purposes of brevity. By way of example, the interlacing of interchanging bind yarn I1 with bottom warp 24, 26 and 28 is unlocked because the weave patterns of adjacent, non-interchanging bottom weft yarn B1, on one side of I1, and adjacent, non-interchanging bottom weft yarn B2, on the other side of I1, do not provide interlacings with bottom warp yarns 22 and 2, respectively, and 8 and 16, respectively. Bottom warp yarns 22 and 2 are the two bottom warp yarns immediately adjacent opposite sides of the group of interlaced bottom warp yarns 24, 26 and 28, which together constitute a single segment bound by I1, and bottom warp yarns 8 and 16 are the two warp yarns immediately adjacent the group of interlaced bottom warp yarns 10, 12 and 14, which together constitute a single segment bound by I2. This same unlocked binding relationship exists throughout the entire fabric 30, to thereby provide a completely unlocked structure.

Referring to FIG. 4, a third embodiment of a fabric in accordance with this invention is a 28 shaft repeat and is illustrated at 40; showing the full weave paths for all paper side wefts (T1, T2, T3 . . . T14), wear side wefts (B1, B2, B3 . . . B14), and interchanging binder weft pairs (I1/2, I3/4, I5/6 . . . I27/28). As will be discussed in detail hereinafter, except for the arrangement of the interchanging binder pairs, the fabric 40 is the same as the fabrics 20 and 30.

Specifically the fabric 40, like the fabrics 20 and 30, has a twenty eight (28) shaft repeat, including a fourteen (14) warp top layer (1, 3, 5, . . . 27) having a paper side surface within each repeat, a fourteen (14) warp machine side layer (2, 4, 6, . . . 28) having a bottom wear side surface within each repeat and a plurality of pairs of first and second intrinsic interchanging weft binder yarns (I1/2 through I27/28).

As illustrated In the weft path weave patterns depicted in FIG. 4, the top layer includes top warp yarns 1, 3, 5 . . . 27 within each repeat interwoven with top, i.e., paper side, weft yarns T1, T2 . . . T14 and top segments of the interlacing binder pairs I1/2, I3/4, I5/6 . . . I27/28 to form a plain weave. Specifically, T1 through T14 each forms a plain weave pattern with the top warp yarns, and interlacing, or interchanging, binder yarn pairs I1/2 through I13/14 provide identical weave paths with the top warp yarns (and also with the bottom warp yarns) as interlacing, or interchanging, binder yarn pairs I15/16 through I27/28, respectively, and said interlacing binder yarn pairs cooperate with the top warp yarns to form a plain weave pattern. As with the previously described embodiments of this invention, in the fabric 40 the insertion order of the binder pairs reverses such that the full fabric weave repeat requires the use of 14 paper side wefts, 14 wear side wefts and 28 interchanging binder yarns (i.e., 14 pairs of binder yarns) to give 56 CD yarns in total. This reversal is shown in FIG. 4 by the numbers "4" or "3" to the immediate left of each yarn of each binder pair, to represent the number of paper side knuckles provided by the identified yarn, e.g., I1 forms 4 knuckles and I2 forms 3 knuckles, whereas I3 forms 3 knuckles and I4 forms 4 knuckles.

The machine side, i.e., wear side, layer includes bottom warp yarns 2, 4, 6, . . . 28 within each repeat, interwoven with bottom, i.e., wear side, weft yarns B1, B2 . . . B14. The wear side weave patterns of bottom wear side weft yarns B1 through B7 are identical to the wear side weave patterns of the bottom wear side weft yarns B8 through B14.

The illustrated bottom weave pattern is a 7 shed repeat, with each wear side weft yarn passing under six adjacent bottom warp yarns and then forming a knuckle over one bottom warp yarn. In the wear side layer, therefore, 1 in every 7 wear side warp yarn-weft yarn interactions are warp interlacings beneath the weft yarn such that the weft yarn transfers to the interior of the fabric where it may disadvantageously interfere with the flow of water through the fabric and where it will not contribute to fabric wear resistance. However, this occurs in only one of every 7 consecutive bottom warp locations. Moreover, this relationship exists for all wear side weft yarns, as can be seen for example at wear side weft B1, which interlaces with wear side MD yarns 2 and 16, respectively. Consequently, in the fabric 40, 14.3% of the wear side warp and weft yarn interactions within each weave repeat are wear side warp-weft interlacings (i.e., 2 out of 14) to establish a wear side MD-CD interlacing percentage (WIP) of 14.3.

In the 28 shaft fabric 40 shown in FIG. 4 all paper side weft paths are made in plain weave, or so-called 2 shaft weave repeat. Therefore, there are 7 paper side layer weave repeats of the plain weave in the 14 paper side warp yarns within each 28 shaft repeat of the fabric. By contrast, all non-interchanging wear side weft paths are made in 7 shaft repeats. Therefore, there are 2 repeats of the 7 shaft weave in the 14 wear side warp yarns within each 28 shaft repeat of the fabric. Consequently the ratio of paper side to wear side weave repeats for the fabric 40, which is the earlier described PWR value, is equal to 3.5 (i.e., 7/2). A higher PWR value could indicate a reduced frequency of wear side weft knuckles interfering with water flow through the fabric, which is actually the case when comparing fabric 40 of this invention with fabric 10 of the prior art.

In the fabric 40 illustrated in FIG. 4, like the fabric 20 illustrated in FIG. 2 and the fabric 30 illustrated in FIG. 3, the pairs of intrinsic, interchanging weft binder yarns I1/2 through I27/28 account for 50% of the cross-machine-direction weft pattern in the paper side layer; being located between each pair of top weft yarns, e.g., T1, T2. That is, every other weft yarn path in the paper side layer is provided by an intrinsic, interchanging weft binder yarn pair. As will be explained hereinafter, the difference in structure between fabric 20 shown in FIG. 2, fabric 30 shown in FIG. 3 and fabric 40 shown in FIG. 4 resides in the weave pattern of the interchanging weft binder yarn pairs. In particular, and as will be discussed in detail hereinafter, the interchanging weft binder yarn pairs in fabric 40 provide binder stiffening sections, which are not included in the fabrics 20 and 30. In addition to providing a stiffening function, the provision of stiffening sections also reduces the total float length within each repeat of the interchanging yarn pairs, as will be discussed in detail hereinafter.

As is shown in FIG. 4, each pair of intrinsic, interchanging weft binder yarns I1/2 through I27/28 includes two segments in the paper side layer within each repeat of the weave pattern in the composite fabric. The two segments of the intrinsic interchanging weft binder yarns in the top layer provide an unbroken weft path in the paper side surface, with each succeeding segment being separated in the paper side surface of the top layer by a top layer transitional warp yarn, e.g., top warp yarns 1 and 17 in the binder pair I1/2 and top warp yarns 5 and 21 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat, i.e., 2 in fabric 40.

Referring to FIG. 4A, a diagram of the top layer transitional points of fabric 40 shows the transition points by the designation "x," which correspond to the uppermost surface of the transitional warp yarns. The 14 warp yarns within each repeat of the upper layer are designated by the 14 vertical columns of the diagram and the 14 pairs of interchanging binder yarns within the fabric repeat are indicated by the horizontal rows of the diagram.

As illustrated in FIG. 4, a first yarn I1 of the interchanging weft binder pair I1/2 of fabric 40, which is depicted as a dotted line, provides a first segment in the paper side layer. That segment comprises paper side warp yarns 3, 5, 7, 9, 11, 13, 15 & transitional warp yarn 1, i.e., a total of 8 warp yarns including the transitional warp yarn 1, providing 4 paper side knuckles. Therefore, a segment length of 8 is provided by the binder yarn I1. The binder yarn I1 cooperates with the binder yarn I2 to provide a continuous weft path in the paper side fabric layer, which, as illustrated, is a plain weave. The binder yarn I2, which is shown in solid representation, provides a second segment in the paper side layer by interlacing with paper side warp yarns 19, 21, 23, 25, 27 & transitional warp yarn 17; i.e. a total of 6 warp yarns including the transitional warp yarn 17, providing 3 paper side knuckles. Therefore, a segment length of 6 is provided by the binder yarn I2. Thus, the two interchanging binder yarns I1 and I2 cooperate to provide segment lengths of 8 and 6, respectively. These same segment lengths are provided by all of the interchanging binder yarn pairs in the fabric 40. However, as with the previously described fabrics of this invention, the sequence in which adjacent interchanging binder pairs provide the segments of 6 and 8 are reversed in the illustrated embodiment of the fabric 40.

As should be noted the segment lengths of 6 and 8 for the interchanging binder yarn pairs in fabric 40 are the same as in fabrics 30 and 20 but are greater than the segment lengths of 4 and 6 for the prior art fabric 10 illustrated in FIG. 1. These longer segment lengths in the fabrics of this invention provide a reduced frequency of binder interchange points, and so reduce occurrences in the fabric surface of non-planarity to thereby minimize the formation of undesired wire marks in the formed sheet.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 40 has the following values: WIP=14.3; PWR=3.5; IPP=14.3; ITP=7.1; IWR=1 and WKR=1. These are the same values as in the previously described fabrics 20 (FIG. 2) and 30 (FIG. 3).

As stated earlier herein, it is desirable in the fabrics of this invention to minimize the length of internal floats of the interchanging binder yarns to thereby minimize void volume within the fabric, which, in turn, minimizes undesired water retention properties of the fabric. It is also desirable to stiffen the fabric in the transverse direction to prevent undesired CD deformation in the fabric.

The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 40 illustrated in FIG. 4, one binder yarn of each pair has a float length of 2 between leaving the top layer and commencing to interlace with a bottom warp yarn, and a float length of 2 as it completes its interlacing with the bottom warp yarn and moves back into the top layer. The other yarn of each pair has a float length of 2 between leaving the top layer and commencing to interlace with a bottom warp yarn, and a float length of 3 as it completes its interlacing with the bottom warp yarn and moves back into the top layer. For example, the binder yarn I1 (dotted line) leaves the top layer adjacent transition warp yarn 17 and passes between top and bottom warp yarn pairs 17-18 and 19-20 (i.e., 2 pairs=float of 2) before interlacing with bottom warp yarn 22. I1 then also binds to spaced-apart bottom warp yarn 26 and then passes between top and bottom warp yarn pairs 27-28 and 1-2 (i.e., 2 pairs=float of 2) before entering the top layer and binding to top warp yarn 3.

The other binder yarn I2 of the pair I1/2 (solid line) leaves the top layer adjacent transition top warp yarn 1 and passes between top and bottom warp yarn pairs 1-2, 3-4 and 5-6 (i.e., 3 pairs=float of 3) before interlacing with bottom warp yarn 8. I2 then also binds to spaced-apart bottom warp yarn 14 and then passes between top and bottom warp yarn pairs 15-16 and 17-18 (i.e., 2 pairs=float of 2) before binding to the top warp yarn 19 of the top layer. It also should be noted that this binder yarn I2 provides a stiffening section underlying one segment of the interchanging binder yarns by floating over two consecutive and contiguous bottom warp yarns 10 and 12 between the warp yarns 8 and 14 that are bound by the yarn I2. This stiffening section enhances the CD stiffness of the fabric 40 to minimize undesired transverse distortion of the fabric.

Thus, in the fabric 40, I1 has two internal floats of 2 within each repeat of the weave pattern, and I2 has two internal floats of 3 and 2, respectively. Thus the total float length within each weave repeat is nine (9) (3+2+2+2=9), which is less than the total float length often (10) in fabric 30 and fourteen (14) in fabric 20. This reduced float length minimizes void volume within the fabric 40, which, in turn, minimizes undesired water retention properties of that fabric relative to the fabrics 20 and 30.

Still referring to FIG. 4, it should be noted that, unlike fabric 20 but like fabric 30, the interlacing of each binder yarn pair with a bottom warp yarn in fabric 40 is "unlocked," which may permit some lateral shifting of the knuckles provided by the interlacing of the interchanging binder pairs (e.g., I1, I2) with the bottom warp yarns (e.g., 22 and 26 with I1 and 8 and 14 with I2). The meaning of "unlocked" was described earlier in this application and will not be repeated herein for purposes of brevity. By way of example, the interlacing of interchanging bind yarn I2 with bottom warp 8 and 14 is unlocked because the weave patterns of adjacent, non-interchanging bottom weft yarn B1, on one side of I2, and adjacent, non-interchanging bottom weft yarn B2, on the other side of I2, do not provide interlacings with bottom warp yarns 6 and 10, respectively, which are the two warp yarns immediately adjacent opposite sides of bottom warp yarn 8; do not provide interlacings with bottom warp yarns 12 and 16, respectively, which are the two warp yarns immediately adjacent opposite sides of bottom warp yarn 14, and do not provide interlacings with bottom warp yarns 20 and 28, respectively, which are the two warp yarns immediately adjacent opposite sides of the group of bottom warp yarns 22, 24 and 26, which together constitute one segment bound by I2. This same unlocked binding relationship exists throughout the entire fabric 40, to thereby provide a completely unlocked structure.

It should be noted that in all of the fabrics 20, 30 and 40 disclosed thus far, the adjacent, non-interchanging bottom weft binder yarns, e.g., B1, B2, B3, etc. have a two (2) step relationship to each other. That is, B1 binds with bottom warp yarns 2 and 16, and B2 then steps over two (2) to bind with bottom warp yarns 6 and 20, respectively. Likewise, B3 then steps over two (2) relative to adjacent bottom weft binder yarn B2 to bind with bottom warp yarns 10 and 24, respectively. As will be pointed out hereinafter, other embodiments of this invention have more than a two (2) step relationship between adjacent, non-interchanging bottom weft yarns.

Referring to FIG. 5, a fourth embodiment of a fabric in accordance with this invention is also a 28 shaft repeat and is illustrated at 50; showing a single full fabric weave repeat and comprising 14 paper side wefts (T1, T2, T3 . . . T14), 14 wear side wefts (B1, B2, B3 . . . B14), and 14 pairs of interchanging weft binder yarns (I1/2, I3/4, I5/6 . . . I27/28). As will be discussed in detail hereinafter, this fabric 50 differs from the previous embodiments 20, 30 and 40 in the step relationship between adjacent, non-interchanging bottom weft yarns and the specific location of the transitional warp yarns in at least some of the pairs of interchanging weft binder yarns.

The fabric 50, like the fabrics 20, 30 and 40, has a twenty eight (28) shaft repeat, including a fourteen (14) warp top layer (1, 3, 5, . . . 27) having a paper side surface within each repeat, a fourteen (14) warp machine side layer (2, 4, 6, . . . 28) having a bottom wear side surface within each repeat and a plurality of pairs of first and second intrinsic interchanging weft binder yarns (I1/2 through I27/28).

As illustrated in the weft path weave patterns depicted in FIG. 5, the top layer includes top warp yarns 1, 3, 5 . . . 27 within each repeat interwoven with top, i.e., paper side, weft yarns T1, T2 . . . T14 and top segments of the interlacing binder pairs I1/2, I3/4, I5/6 . . . I27/28 to form a plain weave. Specifically, T1 through T14 each forms a plain weave pattern with the top warp yarns, and interlacing, or interchanging, binder yarn pairs I1/2 through I13/14 provide identical weave paths with the top warp yarns (and also with the bottom warp yarns) as interlacing, or interchanging, binder yarn pairs I15/16 through I27/28, respectively, and said interlacing binder yarn pairs cooperate with the top warp yarns to form a plain weave pattern. Two "repeats" of the binder yarn pair weave sequence are required in each full repeat to allow for reversing of the order of the segment lengths in adjacent binder weft pairs, as has been discussed in detail earlier herein.

The machine side, i.e., wear side, layer includes bottom warp yarns 2, 4, 6, . . . 28 within each repeat, interwoven with bottom, i.e., wear side, weft yarns B1, B2 . . . B14. The wear side weave patterns of wear side weft yarns B1 through B7 are identical to the wear side weave patterns of wear side weft yarns B8 through B14, respectively.

Still referring to FIG. 5, the illustrated bottom weave pattern is a 7 shed repeat, with each wear side weft yarn passing under six adjacent bottom warp yarns and then forming a knuckle over one bottom warp yarn. In the wear side layer, therefore, 1 in every 7 wear side warp yarn-weft yarn interactions are warp interlacings beneath the weft yarn such that the weft yarn transfers to the interior of the fabric where it may disadvantageously interfere with the flow of water through the fabric and where it will not contribute to fabric wear resistance. However, this occurs in only one of every 7 consecutive bottom warp locations. Moreover, this relationship exists for all wear side weft yarns and can be seen for example at wear side weft B1, which interlaces with wear side MD yarns 2 and 16, respectively. Consequently, in the fabric 50, 14.3% of the wear side warp and weft yarn interactions within each weave repeat are wear side warp-weft interlacings (i.e., 2 out of 14) to establish a wear side MD-CD interlacing percentage (WIP) of 14.3.

Unlike the fabrics 20, 30 and 40, the adjacent, non-interchanging bottom weft yarns B1, B2, etc. have a three (3) step relationship. That is, each non-interchanging bottom weft yarn binds to a bottom warp yarn located three (3) warp yarns from the bottom warp yarn to which the adjacent non-interchanging weft yarn is bound. For example, as noted earlier, bottom weft yarn B1 binds over bottom warp yarns 2 and 16. The next adjacent bottom weft yarn B2 steps three (3) bottom warp yarns and binds to bottom warp yarns 8 and 22. This same three (3) step arrangement continues for all of the remaining bottom weft yarn B3 through B14.

In the 28 shaft fabric 50 shown in FIG. 5 all paper side weft paths are made in plain weave, or so-called 2 shaft weave repeat. Therefore there are 7 paper side layer repeats of the plain weave in the 14 paper side warp yarns within each 28 shaft repeat of the fabric. By contrast all wear side weft paths are made in 7 shaft repeats. Therefore, there are 2 repeats of the 7 shaft weave in the 14 wear side warp yarns within each 28 shaft repeat of the fabric. Consequently the ratio of paper side to wear side weave repeats for the fabric 50, which is the earlier described PWR value, is equal to 3.5 (i.e., 7/2). A higher PWR value could indicate a reduced frequency of wear side weft knuckles interfering with water flow through the fabric, which is actually the case when comparing fabric 50 of this invention with fabric 10 of the prior art.

In the fabric 50 illustrated in FIG. 5, like the fabric 20 illustrated in FIG. 2, fabric 30 illustrated in FIG. 3 and fabric 40 illustrated in FIG. 4, the pairs of intrinsic, interchanging weft binder yarns I1/2 through I27/28 account for 50% of the cross-machine-direction weft pattern in the paper side layer; being located between each pair of top weft yarns, e.g., T1, T2. That is, every other weft yarn path in the paper side layer is provided by an intrinsic, interchanging weft binder yarn pair. The interchanging binder pairs in the fabric 50 are similar to the interchanging binder pairs in the fabric 20 illustrated in FIG. 2. Specifically, in both the fabrics 20 and 50 each yarn of each interchanging binder pair binds to only a single bottom warp yarn underlying one of the two segments within each weave repeat. In addition, because of this relationship, one yarn of each interchanging binder pair in the fabric 50 has two floats of 4 and two floats of 3, just like in the fabric 20. However, the binder yarn pairs in the fabric 50 do not include, or provide any stiffening sections of the type provided in the fabric 40 (FIG. 4).

As is shown in FIG. 5, each pair of intrinsic, interchanging weft binder yarns I1/2 through I27/28 includes two segments in the paper side layer within each repeat of the weave pattern in the composite fabric, just like in fabrics 20, 30 and 40. The two segments of the intrinsic interchanging weft binder yarns in the top layer, provide an unbroken weft path in the paper side surface, with each succeeding segment being separated in the paper side surface of the top layer by a top layer transitional warp yarn, e.g., top warp yarns 5 and 17 in the binder pair I1/2 and top warp yarns 9 and 25 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat i.e., 2 in fabric 50.

Referring to FIG. 5A, a diagram of the top layer transitional points shows the transitional points by the designation "x," which are the uppermost surface of the transitional warp yarns. The 14 warp yarns within each repeat of the upper layer are designated by the 14 vertical columns of the diagram and the 14 pairs of interchanging binder yarns within the fabric repeat are indicated by the horizontal rows of the diagram.

As illustrated in FIG. 5, a first yarn I1 of the interchanging weft binder pair I1/2 of fabric 50, which is depicted as a dotted line, provides a first segment in the paper side layer. That segment comprises paper side warp yarns 19, 21, 23, 25, 27, 1, 3 & transitional warp yarn 17, i.e., a total of 8 warp yarns including the transitional warp yarn 17. Therefore, a segment length of 8 is provided by the binder yarn I1. The binder yarn I1 cooperates with the binder yarn I2 to provide a continuous weft path in the paper side fabric layer, which, as illustrated, is a plain weave. The binder yarn I2, which is shown in solid line representation, provides a second segment in the paper side layer by interlacing with paper side warp yarns 7, 9, 11, 13, 15 & transitional warp yarn 5, i.e., a total of 6 warp yarns including the transitional warp yarn 5. Therefore, a segment length of 6 is provided by the binder yarn I2. Thus, the two interchanging binder yarns I1 and I2 cooperate to provide segment lengths of 8 and 6, respectively, which provide 4 paperside knuckles and 3 paperside knuckles, respectively. These same segment lengths are provided by all of the interchanging binder yarn pairs in the fabric 50. However, as with the previously described fabrics of this invention, the sequence in which adjacent interchanging binder pairs provide the segments of 6 and 8 are reversed in the illustrated embodiment of the fabric 50.

As should be noted, the segment lengths of 6 and 8 for the interchanging binder yarn pairs in fabric 50 are the same as in fabrics 40, 30 and 20 but are greater than the segment lengths of 4 and 6 for the prior art fabric 10 illustrated in FIG. 1. These longer segment lengths in the fabrics of this invention provide a reduced frequency of binder interchange points, and so reduce occurrences in the fabric surface of non-planarity to thereby minimize the formation of undesired wire marks in the formed sheet.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 50 has the following values: WIP=14.3; PWR=3.5; IPP=14.3; ITP=7.1; IWR=1 and WKR=1. These are the same values as in the previously described fabrics 20 (FIG. 2) and 30 (FIG. 3) and 40 (FIG. 4).

As stated earlier herein, it is desirable in the fabrics of this invention to minimize the length of internal floats of the interchanging binder yarns to thereby minimize void volume within the fabric, which, in turn, minimizes undesired water retention properties of the fabric. The description of internal float length was included earlier in this application, and for purposes of brevity will not be repeated in detail herein.

Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 50 illustrated in FIG. 5, one binder yarn of each pair has a float length of 3 between leaving the top layer and commencing to interlace with a bottom warp yarn, and a float length of 3 as it completes its interlacing with the bottom warp yarn and moves back into the top layer. The other yarn of each pair has a float length of 4 between leaving the top layer and commencing to interlace with a bottom warp yarn, and a float length of 4 as it completes its interlacing with the bottom warp yarn and moves back into the top layer. For example, the binder yarn I1 (dotted line) leaves the top layer adjacent transition warp yarn 5 and passes between top and bottom warp yarn pairs 5-6, 7-8 and 9-10 (i.e., 3 pairs=float of 3) before interlacing with bottom warp yarn 12. I1 then passes between top and bottom warp yarn pairs 13-14, 15-16 and 17-18 (i.e., 3 pairs=float of 3) before entering the top layer and binding to top warp yarn 19. The other binder yarn I2 of the pair I1/2 (solid line representation) leaves the top layer adjacent transition top warp yarn 17 and passes between top and bottom warp yarn pairs 17-18, 19-20, 21-22 and 23-24 (i.e., 4 pairs=float of 4) before interlacing with bottom warp yarn 26. I2 then passes between top and bottom warp yarn pairs 27-28, 1-2, 3-4, and 5-6 (i.e., 4 pairs=float of 4) before entering the top layer to bind with top warp yarn 7.

Thus, in the fabric 50, I1 has two internal floats of 3 and I2 has two internal floats of 4 within each repeat of the weave pattern. Therefore, the total float length within each weave repeat is fourteen (14) (4+4+3+3=14), which is the same as in the fabric 20 (FIG. 2).

Still referring to FIG. 5, it should be noted that, unlike fabric 20, but like fabric 30, the interlacing of each binder yarn pair with a bottom warp yarn is "unlocked," which may permit some lateral shifting of the knuckles provided by the interlacing of the interchanging binder pairs (e.g., I1, I2) with the bottom warp yarns (e.g., 12 with I1 and 26 with I2). The meaning of "unlocked" was described earlier in this application and will not be repeated herein for purposes of brevity. By way of example, the interlacing of interchanging bind yarn I2 with bottom warp 26 is unlocked because the weave patterns of adjacent, non-interchanging bottom weft yarn B1, on one side of I2, and adjacent, non-interchanging bottom weft yarn B2, on the other side of I2, do not provide interlacings with bottom warp yarns 24 and 28, respectively, which are the two warp yarns immediately adjacent bottom warp yarn 26. This same unlocked binding relationship exists throughout the entire fabric 50, to thereby provide a completely unlocked structure.

Referring to FIG. 6, a fifth embodiment of a fabric in accordance with this invention is a 28 shaft repeat and is illustrated at 60; showing the full weave paths for all paper side wefts (T1, T2, T3 . . . T14), wear side wefts (B1, B2, B3 . . . B14), and interchanging binder weft pairs (I1/2, I3/4, I5/6 . . . I27/28). As will be discussed in detail hereinafter, except for the arrangement of the interchanging binder pairs, the fabric 60 is the same as the fabric 50 shown in FIG. 5.

Specifically the fabric 60, like the fabric 50, has a twenty eight (28) shaft repeat, including a fourteen (14) warp top layer (1, 3, 5, . . . 27) having a paper side surface within each repeat, a fourteen (14) warp machine side layer (2, 4, 6, . . . 28) having a bottom wear side surface within each repeat and a plurality of pairs of first and second intrinsic interchanging weft binder yarns (I1/2 through I27/28).

As illustrated in the weft path weave patterns depicted in FIG. 6, the top layer includes top warp yarns 1, 3, 5 . . . 27 within each repeat interwoven with top, i.e., paper side, weft yarns T1, T2 . . . T14 and top segments of the interlacing binder pairs I1/2, I3/4, I5/6. . . I27/28 to form a plain weave. Specifically, T1 through T14 each forms a plain weave pattern with the top warp yarns, and interlacing binder pairs I1/2 through I13/14 provide identical weave patterns with the top warp yarns (and also the bottom warp yarns) as interlacing binder pairs I15/16 through I27/28, respectively, each interlacing binder pair cooperating with the top warp yarns to form a plain weave pattern.

As with the previously described embodiments of this invention, in the fabric 60 the insertion order of the binder pairs reverses such that the full fabric weave repeat requires the use of 14 paper side wefts, 14 wear side wefts and 28 interchanging binder yarns to give 56 CD (cross direction) yarns in total. This reversal is shown in FIG. 6 by the numbers "5" or "2" to the immediate left of each yarn of each binder pair, to represent the number of paper side knuckles provided by the identified yarn, e.g., I1 forms 5 knuckles and I2 forms 2 knuckles, whereas I3 forms 2 knuckles and I4 forms 5 knuckles.

The machine side, i.e., wear side, layer of the fabric 60 includes bottom warp yarns 2, 4, 6 . . . 28 within each repeat, interwoven with bottom, i.e., wear side weft yarns B1, B2 . . . B14. The wear side weave patterns of wear side weft yarns B1 through B7 are identical to the wear side weave patterns of wear side weft yarns B8-14, respectively. Moreover, like in the fabric 50, the adjacent, non-interchanging wear side weft yarns have a three (3) step relationship. That is, B1 binds to bottom warp yarns 2 and 16, and B2 then steps three (3) bottom warp yarns to bind with bottom warp yarns 8 and 22. This same three (3) step relationship continues for all of the wear side weft yarns, just as in the fabric 50 shown in FIG. 5.

Still referring to FIG. 6, the bottom weave pattern of the non-interchanging weft yarns of the fabric 60 is the same as the bottom weave pattern of the non-interchanging weft yarns of the fabric 50. Specifically, the bottom weave pattern is a 7 shed repeat, with each wear side weft yarn passing under six adjacent bottom warp yarns and then forming a knuckle over one bottom warp yarn. In the wear side layer, therefore, 1 in every 7 wear side warp yarn-weft yarn interactions are warp interlacings beneath the weft yarn such that the weft yarn transfers to the interior of the fabric where it may disadvantageously interfere with the flow of water through the fabric and where it will not contribute to fabric wear resistance. However, this occurs in only one of every 7 consecutive bottom warp locations. Moreover, this relationship exists for all wear side weft yarns, as can be seen for example at wear side weft B1, which interlaces with wear side MD yarns 2 and 16, respectively. Consequently, in the fabric 60, 14.3% of the wear side warp and weft yarn interactions within each weave repeat are wear side warp-weft interlacings (i.e., 2 out of 14) to establish a wear side MD-CD interlacing percentage (WIP) of 14.3.

In the 28 shaft fabric 60 shown in FIG. 6 all paper side weft paths are made in plain weave, or so-called 2 shaft weave repeat. Therefore there are 7 paper side layer repeats of the plain weave, in the 14 paper side warp yarns within each 28 shaft repeat of the fabric. By contrast all wear side weft paths are made in 7 shaft repeats. Therefore, there are 2 repeats of the 7 shaft weave in the 14 wear side warp yarns within each 28 shaft repeat of the fabric. Consequently the ratio of paper side to wear side weave repeats for the fabric 60, which is the earlier described PWR value, is equal to 3.5 (i.e., 7/2). A higher PWR value could indicate a reduced frequency of wear side weft knuckles interfering with water flow through the fabric, which is actually the case when comparing fabric 60 of this invention with fabric 10 of the prior art.

In the fabric 60 illustrated in FIG. 6, like in the fabrics 20, 30, 40 and 50, the pairs of intrinsic, interchanging weft binder yarns I1/2 through I27/28 account for 50% of the cross-machine-direction weft pattern in the paper side layer, being located between each pair of top weft yarns, e.g., T1, T2. That is, every other weft yarn path in the paper side layer is provided by an intrinsic, interchanging weft binder yarn pair. As will be explained hereinafter, the difference in structure between the fabric 60 illustrated in FIG. 6 and the fabric 50 illustrated in FIG. 5 resides in the weave pattern of the interchanging weft binder yarn pairs. In particular, and as will be discussed in detail hereinafter, the interchanging weft binder yarn pairs in fabric 60 provide binder stiffening sections, which are not included in the fabric 50. In addition to providing a stiffening function, the provision of stiffening sections reduces the total float length within each repeat of the interchanging yarn pairs, as also will be discussed in detail hereinafter.

As is shown in FIG. 6, each pair of intrinsic, interchanging weft binder yarns I1/2 through I27/28 includes two segments in the paper side layer within each repeat of the weave pattern in the composite fabric. The two segments of the intrinsic interchanging weft binder yarns in the top layer, provide an unbroken weft path in the paper side surface, with each succeeding segment being separated in the paper side surface of the top layer by a top layer transitional warp yarn, e.g., top warp yarns 1 and 21 in the binder pair I1/2 and top warp yarns 13 and 21 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat, i.e., 2 in fabric 60.

Referring to FIG. 6A, a diagram of the top layer transitional points of fabric 60 shows the transitional points by the designation "x," which correspond to the uppermost surface of the transitional warp yarns. The 14 warp yarns within each repeat of the upper layer are designated by the 14 vertical columns of the diagram and the 14 pairs of interchanging binder yarns within the fabric repeat are indicated by the horizontal rows of the diagram.

As illustrated in FIG. 6, a first yarn I1 of the interchanging weft binder pair I1/2 of fabric 60, which is depicted as a solid line, provides a first segment in the paper side layer. That segment comprises paper side warp yarns 3, 5, 7, 9, 11, 13, 15, 17, 19 & transitional warp yarn 1, i.e. a total of 10 warp yarns including the transitional warp yarn 1, providing 5 paper side knuckles. Therefore, a segment length of 10 is provided by the binder yarn I1. The binder yarn I1 cooperates with the binder yarn I2 to provide a continuous weft path in the paper side fabric layer, which, as illustrated, is a plain weave. The binder yarn I2, which is shown in dotted representation, provides a second segment in the paper side layer by interlacing with paper side warp yarns 23, 25, 27 & transitional warp yarn 21; i.e., a total of 4 warp yarns including the transitional warp yarn 21, providing 2 paper side knuckles. Therefore, a segment length of 4 is provided by the binder yarn I2. Thus, the two interchanging binder yarns I1 and I2 in the fabric 60 cooperate to provide segment lengths of 10 and 4, respectively, to provide 5 paper side knuckles and 2 paper side knuckles, respectively. These segment lengths are different than the segment lengths provided in the earlier described embodiments of this invention and are provided by all of the interchanging binder yarn pairs in the fabric 60. However, as with the previously described embodiments of this invention, the sequence in which adjacent interchanging binder pairs provide the segments 10 and 4 are reversed in the illustrative embodiment of the fabric 60.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 60 has the following values: WIP=14.3; PWR=3.5; IPP=14.3; ITP=7.1; IWR=1 and WKR=1. These are the same values as in the previously described fabrics of this invention, i.e., fabrics 20, 30, 40 and 50.

As stated earlier herein, it is desirable in the fabrics of this invention to minimize the length of internal floats of the interchanging binder yarns to thereby minimize void volume within the fabric, which minimizes undesired water retention properties of the fabric. It is also desirable to stiffen the fabric in the transverse direction to prevent undesired CD deformation in the fabric;

The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 60 illustrated in FIG. 6, both binder yarns of each pair have a float length of 2 between leaving the top layer and commencing to interlace with a bottom warp yarn, and a float length of 2 as they complete their interlacing with the bottom warp yarn and move back into the top layer. For example, the binder yarn I1 (solid line) leaves the top layer adjacent transition top warp yarn 21 and passes between top and bottom warp yarn pairs 21-22 and 23-24 (i.e., 2 pairs=float of 2) before interlacing with bottom warp yarn 26. I1 then passes between top and bottom warp yarn pairs 27-28 and 1-2 (i.e., 2 pairs=float of 2) before entering the top layer to bind with top warp yarn 3.

The other binder yarn I2 of the pair I1/2 (dotted line) leaves the top layer adjacent transition warp yarn 1 and passes between top and bottom warp yarn pairs 1-2 and 3-4 (i.e., 2 pairs=float of 2) before interlacing with bottom warp yarn 6. I2 then also binds to spaced-apart bottom warp yarns 12 and 18 and then passes between top and bottom warp yarn pairs 19-20 and 21-22 (i.e., 2 pairs=float of 2) before entering the top layer and binding to top warp yarn 23. Thus, in the fabric 60, both I1 and I2 have two internal floats of 2 within each repeat of the weave pattern. Thus the total float length within each weave repeat is eight (8)(2+2+2+2=8), which is less than the total float length in all of the previously described embodiments of this invention. This reduced float length minimizes void volume within the fabric, which, in turn, minimizes undesired water retention properties of the fabric 60 relative to the other fabrics of this invention.

Still referring to FIG. 6, it should be noted that the binding of I2 with bottom warp yarns 6, 12 and 18 creates two distinct stiffening sections in the interior of the fabric underlying one segment of the interchanging binder yarn pair I1-I2. One stiffening section is provided by I2 bridging, adjacent bottom warp yarns 8 and 10 in the interior of the fabric between interlocking with bottom warp yarns 6 and 12. The other stiffening section is provided by I2 bridging, adjacent bottom warp yarns 14 and 16 in the interior of the fabric between interlocking with bottom warp yarns 12 and 18. The inclusion of two stiffening sections in the interior of the fabric underlying one segment of interchanging binder yarn pairs exists for all interchanging binder yarn pairs employed in the fabric 60.

Still referring to FIG. 6, it should be noted that, unlike fabric 20, the interlacing of each binder yarn pair with a bottom warp yarn in fabric 60 is "unlocked," which may permit some lateral shifting of the knuckles provided by the interlacing of the interchanging binder pairs (e.g., I1, I2) with the bottom warp yarns (e.g., 26 with I1 and 6, 12 and 18 with I2). The meaning of "unlocked" was described earlier in this application and will not be repeated herein for purposes of brevity. By way of example, the interlacing of interchanging bind yarn I1 with bottom warp 26 is unlocked because the weave patterns of adjacent, non-interchanging bottom weft yarn B1 on one side of I1 and I2, and adjacent, non-interchanging bottom weft yarn B2 on the other side of I1 and I2, do not provide interlacings with bottom warp yarns 24 and 28, respectively, which are the two warp yarns immediately adjacent bottom warp yarn 26 that is bound by I1; do not provide interlacings with bottom warp yarns 4 and 8, respectively, which are the two warp yarns immediately adjacent bottom warp yarn 6 bound by I2; do not provide interlacings with bottom warp yarns 10 and 14, respectively, which are the two warp yarns immediately adjacent bottom warp yarn 12 bound by I2 and do not provide interlacings with bottom warp yarns 16 and 20, respectively, which are the two warp yarns immediately adjacent bottom warp yarn 18 bound by I2. This same binding relationship exists throughout the entire fabric 60, to thereby provide a completely unlocked structure.

It should be noted that in fabric 60, like in fabric 50, the adjacent, non-interchanging bottom weft binder yarns, e.g., B1, B2, B3, etc. have a three (3) step relationship to each other. That is, B1 binds with bottom warp yarns 2 and 16, and B2 then steps over three (3) bottom warp yarns to bind with bottom warp yarns 8 and 22, respectively. Likewise, B3 then steps over three (3) bottom warp yarns relative to adjacent bottom weft binder yarn B2 to bind with bottom warp yarns 14 and 28, respectively, etc.

Referring to FIG. 7, a sixth embodiment of a fabric in accordance with this invention is shown at 70. Unlike all of the previous embodiments, the fabric 70 is a 32 shaft repeat, as opposed to a 28 shaft repeat. FIG. 7 shows all of the weft yarns in one-half the full weave path for all paper side wefts (T1, T2, T3 . . . T8), wear side wefts (B1, B2, B3 . . . B8), and interchanging binder weft pairs (I1/2, I3/4, I5/6 . . . I15/16).

Specifically the fabric 70 has a thirty-two (32) shaft repeat, including a sixteen (16) warp top layer (1, 3, 5, . . . 31) having a paper side surface within each repeat, a sixteen (16) warp machine side layer (2, 4, 6, . . . 32) having a bottom wear side surface within each repeat and a plurality of pairs of first and second intrinsic interchanging weft binder yarns (I1/2 through I15/16).

As illustrated in the weft path weave patterns depicted in FIG. 7, the top layer of fabric 70 includes top warp yarns 1, 3, 5 . . . 31 within each repeat interwoven with top, i.e., paper side, weft yarns T1, T2 . . . T8 and top segments of the interlacing binder pairs I1/2, I3/4, I5/6 . . . I15/16 to form a plain weave. This constitutes one-half of the paper side weft yarns and interchanging binder yarn pairs in the full weft weave repeat.

The machine side, i.e., wear side, layer of the fabric 70 includes bottom warp yarns 2, 4, 6 . . . 32 within each repeat, interwoven with bottom, i.e., wear side weft yarns B1, B2 . . . B8. These bottom weft yarns constitute one-half of the full weft weave pattern. As in the fabrics 50 and 60, the adjacent, non-interchanging wear side weft yarns have a three (3) step relationship. That is, B1 binds to bottom warp yarns 2 and 18, and B2 then steps three (3) bottom warp yarns to bind with bottom warp yarns 8 and 24. This same three (3) step relationship continues for all of the wear side weft yarns, just as in the fabrics 50 and 60 shown in FIGS. 5 and 6, respectively.

Still referring to FIG. 7, the bottom weave pattern of the non-interchanging yarns of the fabric 70 is an 8 shed repeat, with each wear side weft yarn passing under seven adjacent bottom warp yarns and then forming a knuckle over one bottom warp yarn. In the wear side layer, therefore, 1 in every 8 wear side warp yarn-weft yarn interactions are warp interlacings beneath the weft yarn such that the weft yarn transfers to the interior of the fabric where it may disadvantageously interfere with the flow of water through the fabric and where it will not contribute to fabric wear resistance. However, in the fabric 70 this occurs in only one of every 8 consecutive bottom warp locations. Moreover, this relationship exists for all wear side weft yarns, as can be seen for example at wear side weft B1, which interlaces with wear side MD yarns 2 and 18, respectively. Consequently, in the fabric 70, 12.5% of the wear side warp and weft yarn interactions within each weave repeat are wear side warp-weft interlacings (i.e., 2 out of 16) to establish a wear side MD-CD interlacing percentage (WIP) of 12.5.

In the 32 shaft fabric 70 shown in FIG. 7 all paper side weft paths are made in plain weave or so-called 2 shaft weave repeat. Therefore there are 8 paper side layer repeats of the plain weave in the 16 paper side warp yarns within each 32 shaft repeat of the fabric 70. By contrast all wear side weft paths are made in 8 shaft repeats. Therefore, there are 2 repeats of the 8 shaft weave in the 16 wear side warp yarns within each 32 shaft repeat of the fabric 70. Consequently the ratio of paper side to wear side weave repeats for the fabric 70, which is the earlier described PWR value, is equal to 4.0 (i.e., 8/2). A higher PWR value could indicate a reduced frequency of wear side weft knuckles interfering with water flow through the fabric, which is actually the case when comparing fabric 70 of this invention with fabric 10 of the prior art and with all of the previously described embodiments of this invention.

In the fabric 70 illustrated in FIG. 7, like in the fabrics 20, 30, 40, 50 and 60, the pairs of intrinsic, interchanging weft binder yarns I1/2 through I15/16 account for 50% of the cross-machine-direction weft pattern in the paper side layer; being located between each pair of top weft yarns, e.g., T1, T2. That is, every other weft yarn path in the paper side layer is provided by an intrinsic, interchanging weft binder yarn pair. As will be explained in detail hereinafter the interchanging weft binder yarn pairs in fabric 70 provide a binder stiffening section underlying each segment, unlike the previously described embodiments. In addition to providing a stiffening function, the provision of stiffening sections in the fabric 70 reduces the total float length within each repeat of the interchanging yarn pairs, as also will be discussed in detail hereinafter.

As is shown in FIG. 7, each pair of intrinsic, interchanging weft binder yarns I1/2 through I15/16, which is one-half of the number of pairs employed in the full weft weave pattern, includes two segments in the paper side layer within each repeat of the weave pattern in the composite fabric. The two segments of the intrinsic interchanging weft binder yarns in the top layer provide an unbroken weft path in the paper side surface, with each succeeding segment being separated in the paper side surface of the top layer by a top layer transitional warp yarn, e.g., top warp yarns 9 and 25 in the binder pair I1/2 and top warp yarns 5 and 21 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat, i.e., 2 in fabric 70.

Referring to FIG. 7A, a diagram of the top layer transitional points shows the transitional points by the designation "x," which are the uppermost surface of the transitional warp yarns. The 16 top warp yarns within each repeat of the upper layer are designated by the 16 vertical columns of the diagram and one full repeat of the 16 pairs of interchanging binder yarns are indicated by the sixteen (16) horizontal rows of the diagram.

As illustrated in FIG. 7, a first yarn I1 of the interchanging weft binder pair I1/2 of fabric 70, which is depicted as a solid line, provides a first segment in the paper side layer. That segment comprises paper side warp yarns 27, 29, 31, 1, 3, 5, 7 & transitional warp yarn 25, i.e., a total of 8 warp yarns including the transitional warp yarn 25, providing four (4) paper side knuckles. Therefore, a segment length of 8 is provided by the binder yarn I1. The binder yarn I1 cooperates with the binder yarn I2 to provide a continuous weft path in the paper side fabric layer, which, as illustrated, is a plain weave. The binder yarn I2, which is shown in dotted representation, provides a second segment in the paper side layer by interlacing with paper side warp yarns 11, 13, 15, 17, 19, 21, 23 & transitional warp yarn 9; i.e., a total of 8 warp yarns including the transitional warp yarn 9, providing four (4) paper side knuckles. Therefore, a segment length of 8 is provided by the binder yarn I2. Thus, the two interchanging binder yarns I1 and I2 in the fabric 70 each cooperate to provide a segment length of 8. Thus, there is no reversing of binders in adjacent pairs based on a different path length of the two segments within each repeat. However, as explained earlier, reversing of binders in adjacent pairs could still be carried out to allow for a desired distribution of different yarn materials or diameters or to vary the relative spacing of binder knuckles even where the segment lengths are equal and wear side interlacings also are equal.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 70 has the following values: WIP=12.5; PWR=4.0; IPP=12.5; ITP=6.3; IWR=1 and WKR=1.

As stated earlier herein, it is desirable in the fabrics of this invention to minimize the length of internal floats of the interchanging binder yarns to thereby minimize void volume within the fabric, which minimizes undesired water retention properties of the fabric. It is also desirable to stiffen the fabric in the transverse direction to prevent undesired CD deformation in the fabric.

The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 70 illustrated in FIG. 7, both binder yarns of each pair have a float length of 2 between leaving the top layer and commencing to interlace with a bottom warp yarn, and a float length of 2 as they complete their interlacing with the bottom warp yarn and move back into the top layer. For example, the binder yarn I1 (solid line) leaves the top layer adjacent transition top warp yarn 9 and passes between top and bottom warp yarn pairs 9-10 and 11-12 (i.e., 2 pairs=float of 2) before interlacing with bottom warp yarn 14. I1 then passes between top and bottom warp yarn pairs 23-24 and 25-26 (i.e., 2 pairs=float of 2) after binding to bottom warp yarn 22 and before entering the top layer to bind with top warp yarn 27. I1, between binding to bottom warp yarn 14 and bottom warp yarn 22 floats over adjacent, bottom warp yarns 16, 18 and 20 in the interior of the fabric 70 to provide a stiffening section in the fabric.

The other binder yarn I2 of the pair I1/2 (dotted line) leaves the top layer adjacent transition warp yarn 25 and passes between top and bottom warp yarn pairs 25-26 and 27-28 (i.e., 2 pairs=float of 2) before interlacing with bottom warp yarn 30. I2 then passes between top and bottom warp yarn pairs 7-8 and 9-10 (i.e., 2 pairs=float of 2) after binding to bottom warp yarn 6 and before entering the top layer to bind with top warp yarn 11. I2, between binding to bottom warp yarn 30 and bottom warp yarn 6 floats over adjacent, bottom warp yarns 32, 2 and 4 in the interior of the fabric 70 to provide a further stiffening section in the fabric. Thus, the fabric 70 is stiffened under each of the two paper side segments within each weave repeat created by the interchanging binder yarn pairs, to thereby provide a highly stable structure.

Moreover, in the fabric 70 each of the interchanging binder yarn pairs, e.g., I1 and I2, have two internal floats of 2 within each repeat of the weave pattern. Thus the total float length within each weave repeat is eight (8)(2+2+2+2=8), which is the same as the total float in fabric 60, and less than the total float in all of the other previously described embodiments of this invention. This reduced float length minimizes void volume within the fabric, which, in turn, minimizes undesired water retention properties of the fabric 70 relative to the fabrics 50, 40, 30 and 20 of this invention.

Still referring to FIG. 7, it should be noted that, unlike fabric 20, the interlacing of each binder yarn pair with a bottom warp yarn in fabric 70 is "unlocked," which may permit some lateral shifting of the knuckles provided by the interlacing of the interchanging binder pairs (e.g., I1, I2) with the bottom warp yarns (e.g., 14 and 22 with I1 and 30 and 6 with I2). The meaning of "unlocked" was described earlier in this application and will not be repeated herein for purposes of brevity. By way of example, the interlacing of interchanging bind yarns I1 and I2 with bottom warp yarns 14, 22, 30 and 6, respectively, are unlocked because the weave patterns of adjacent, non-interchanging bottom weft yarn B1, on one side of I1 and I2, and adjacent, non-interchanging bottom weft yarn B2, on the other side of I1 and I2, do not provide interlacings with bottom warp yarns 12 and 16, respectively, which are the two warp yarns immediately adjacent bottom warp yarn 14 that is bound by I1; do not provide interlacings with bottom warp yarns 18 and 24, respectively, which are the two warp yarns immediately adjacent bottom warp yarn 22 that also is bound by I1; do not provide interlacings with bottom warp yarns 28 and 32, respectively, which are the two warp yarns immediately adjacent bottom warp yarn 30 bound by I2 and do not provide interlacings with bottom warp yarns 4 and 8, respectively, which are the two warp yarns immediately adjacent bottom warp yarn 6 that also is bound by I2. This same binding relationship exists throughout the entire fabric 70, to thereby provide a completely unlocked structure.

Referring to FIG. 8, a seventh embodiment of a fabric in accordance with this invention is shown at 80. Unlike all of the previous embodiments, the fabric 80 is a 40 shaft repeat. FIG. 8 shows the full weave paths for all paper side wefts (T1, T2, T3 . . . T20), wear side wefts (B1, B2, B3 . . . B20), and interchanging binder weft pairs (I1/2, I3/4, I5/6 . . . I39/40) for the fabric 80.

Specifically, the fabric 80 has a forty (40) shaft repeat, including a twenty (20) warp top layer (1, 3, 5, . . . 39) having a paper side surface within each repeat, a twenty (20) warp machine side layer (2, 4, 6, . . . 40) having a bottom wear side surface within each repeat and a plurality of pairs of first and second intrinsic interchanging weft binder yarns (I1/2 through I39/40).

As illustrated in the weft path weave patterns depicted in FIG. 8, the top layer of fabric 80 includes top warp yarns 1, 3, 5 . . . 39 within each repeat interwoven with top, i.e., paper side, weft yarns T1, T2 . . . T20 and top segments of the interlacing binder pairs I1/2, I3/4, I5/6 . . . I39/40 to form a plain weave.

The machine side, i.e., wear side, layer of the fabric 80 includes bottom warp yarns 2, 4, 6 . . . 40 within each repeat, interwoven with bottom, i.e., wear side weft yarns B1, B2 . . . B20. Moreover, like in the fabrics 20, 30 and 40, the adjacent, non-interchanging wear side weft yarns have a two (2) step relationship. That is, B1 binds to bottom warp yarns 2, 12, 22 and 32, and B2 then steps two (2) bottom warp yarns to bind with bottom warp yarns 6, 16, 26 and 36. This same two (2) step relationship continues for all of the wear side weft yarns, just as in the fabrics 20, 30 and 40 shown in FIGS. 24, respectively.

Still referring to FIG. 8, the bottom weave pattern of the non-interchanging yarns of the fabric 80 is a 5 shed repeat, with each wear side weft yarn passing under four adjacent bottom warp yarns and then forming a knuckle over one bottom warp yarn. In the wear side layer, therefore, 1 in every 5 wear side warp yarn-weft yarn interactions are warp interlacings beneath the weft yarn such that the weft yarn transfers to the interior of the fabric where it may disadvantageously interfere with the flow of water through the fabric and where it will not contribute to fabric wear resistance. This 5 shed weave pattern exists for all non-interchanging wear side weft yarns, as can be seen for example at wear side weft B1, which interlaces with wear side MD yarns 2, 12, 22 and 32, respectively, within each 40 shed repeat. Consequently, in the fabric 80, 20% of the wear side warp yarns within each weave repeat are wear side warp-weft interlacings (i.e., 4 out of 20) to establish a wear side MD-CD interlacing percentage (WIP) of 20.

In the 40 shaft fabric 80 shown in FIG. 8 all paper side weft paths are made in plain weave, or so-called 2 shaft weave repeat. Therefore, there are 10 paper side layer repeats of the plain weave in the 20 paper side warp yarns within each 40 shaft repeat of the fabric 80. By contrast all wear side weft paths are made in 5 shaft repeats. Therefore, there are 4 repeats of the 5 shaft weave in the 20 wear side warp yarns within each 40 shaft repeat of the fabric 80. Consequently the ratio of paper side to wear side weave repeats for the fabric 80, which is the earlier described PWR value, is equal to 2.5 (i.e., 10/4).

In the fabric 80 illustrated in FIG. 8, like in the fabrics 20, 30, 40, 50, 60 and 70, the pairs of intrinsic, interchanging weft binder yarns I1/2 through I19/20 account for 50% of the cross-machine-direction weft pattern in the paper side layer; being located between each pair of top weft yarns, e.g., T1, T2. That is, every other weft yarn path in the paper side layer is provided by an intrinsic, interchanging weft binder yarn pair. As will be explained in detail hereinafter the interchanging weft binder yarn pairs in fabric 80 provide a binder stiffening section underlying each segment formed by the interchanging binder yarn pairs, in a manner similar to that in fabric 70 shown in FIG. 7. In addition to providing a stiffening function, the provision of stiffening sections in the fabric 80 reduces the total float length within each repeat of the interchanging yarn pairs, as compared to omitting such stiffening sections, as also will be discussed in detail hereinafter.

As is shown in FIG. 8, each pair of intrinsic, interchanging weft binder yarns I1/2 through I39/40 includes two segments in the paper side layer within each repeat of the weave pattern in the composite fabric. The two segments of the intrinsic interchanging weft binder yarns in the top layer provide an unbroken weft path in the paper side surface, with each succeeding segment being separated in the paper side surface of the top layer by a top layer transitional warp yarn, e.g., top warp yarns 17 and 37 in the binder pair I1/2 and top warp yarns 13 and 33 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat, i.e., 2 in fabric 80.

Referring to FIG. 8A, a diagram of the top layer transitional points shows the transitional points by the designation "x," which are the uppermost surface of the transitional warp yarns. The 20 warp yarns within each repeat of the upper layer are designated by the 20 vertical columns of the weave diagram and the full repeat provided by the 20 pairs of interchanging binder yarns are indicated by the twenty (20) horizontal rows of the diagram.

As illustrated in FIG. 8, a first yarn I1 of the interchanging weft binder pair I1/2 of fabric 80, which is depicted as a solid line, provides a first segment in the paper side layer. That segment comprises paper side warp yarns 19, 21, 23, 25, 27, 29, 31, 33, 35 & transitional warp yarn 17, i.e., a total of 10 warp yarns including the transitional warp yarn 17, providing five (5) paper side knuckles. Therefore, a segment length of 10 is provided by the binder yarn I1. The binder yarn I1 cooperates with the binder yarn I2 to provide a continuous weft path in the paper side fabric layer, which, as illustrated, is a plain weave.

The binder yarn I2, which is shown in dotted representation, provides a second segment in the paper side layer by interlacing with paper side warp yarns 39, 1, 3, 5, 7, 9, 11, 13, 15 & transitional warp yarn 37; i.e., a total of 10 warp yarns including the transitional warp yarn 37, providing five (5) paper side knuckles. Therefore, a segment length of 10 is provided by the binder yarn I2. Thus, the two interchanging binder yarns I1 and I2 in the fabric 80 each cooperate to provide a segment length of 10 and 5 paper side knuckles. Thus, there is no reversing of binders in adjacent pairs based on a different path length of the two segments within each repeat. However, as explained earlier, reversing of binders in adjacent pairs could still be carried out to allow for a desired distribution of different yarn materials or diameters even where the segment lengths are equal and wear side interlacings also are equal.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 80 has the following values: WIP=20; PWR=2.5; IPP=10; ITP=5; IWR=0.5 and WKR=0.5.

As stated earlier herein, it is desirable in the fabrics of this invention to minimize the length of internal floats of the interchanging binder yarns to thereby minimize void volume within the fabric, which minimizes undesired water retention properties of the fabric. It is also desirable to stiffen the fabric in the transverse direction to prevent undesired CD deformation in the fabric.

The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 80 illustrated in FIG. 8, both binder yarns of each pair have a float length of 3 between leaving the top layer and commencing to interlace with a bottom warp yarn, and a float length of 2 as they complete their interlacing with the bottom warp yarn and move back into the top layer. For example, the binder yarn I1 (solid line) leaves the top layer adjacent transition top warp yarn 37 and passes between top and bottom warp yarn pairs 37-38, 39-40 and 1-2 (i.e., 3 pairs=float of 3) before interlacing with bottom warp yarn 4. I1 then passes between top and bottom warp yarn pairs 15-16 and 17-18 (i.e., 2 pairs=float of 2) after binding to bottom warp yarn 14 and before entering the top layer to bind with top warp yarn 19. I1, between binding to bottom warp yarn 4 and bottom warp yarn 14 floats over adjacent, bottom warp yarns 6, 8, 10 and 12 in the interior of the fabric 80 to provide a stiffening section in the fabric underlying one top segment.

The other binder yarn I2 of the pair I1/2 (dotted line) leaves the top layer adjacent transition warp yarn 17 and passes between top and bottom warp yarn pairs 17-18, 19-20 and 21-22 (i.e., 3 pairs=float of 3) before interlacing with bottom warp yarn 24. I2 then passes between top and bottom warp yarn pairs 35-36 and 37-38 (i.e., 2 pairs=float of 2) after binding to bottom warp yarn 34 and before entering the top layer to bind with top warp yarn 39. I2, between binding to bottom warp yarn 24 and bottom warp yarn 34 floats over adjacent, bottom warp yarns 26, 28, 30 and 32 in the interior of the fabric 80 to provide a further stiffening section in the fabric underlying the other top segment provided by the interchanging binder yarns. Thus, the fabric 80, like the fabric 70, is stiffened under each segment created by the interchanging binder yarn pairs to provide a highly stable structure.

Moreover, in the fabric 80 each of the interchanging binder yarn pairs, e.g., I1 and I2, have one internal float of 2 and one internal float of 3 within each repeat of the weave pattern. Thus the total float length within each weave repeat of the fabric 80 is ten (10) (2+3+2+3=10). Although other embodiments of this invention have a lower total float length, a total float length of 10 is considered to be very acceptable within this invention. This low float length minimizes void volume within the fabric, which, in turn, minimizes undesired water retention properties of the fabric 80 relative to fabrics having a higher total float length.

Still referring to FIG. 8, it should be noted that, like fabric 20, the interlacing of each binder yarn pair with a bottom warp yarn in fabric 80 is "locked," which may provide the same benefits as discussed earlier with respect to the fabric 20. The meaning of "locked" was described earlier in this application and will not be repeated herein for purposes of brevity. By way of example, the interlacing of interchanging bind yarn I1 with bottom warp yarns 4 and 14 is locked because the weave patterns of adjacent, non-interchanging bottom weft yarn B1, on one side of I1 and I2, and adjacent, non-interchanging bottom weft yarn B2, on the other side of I1 and I2, provide interlacings with bottom warp yarns 2 and 6, respectively, which are the two warp yarns immediately adjacent bottom warp yarn 4 that is bound by I1; and with bottom warp yarns 12 and 16, respectively, which are the two warp yarns immediately adjacent bottom warp yarn 14 that also is bound by I1. Moreover, this same relationship is achieved with respect to the bottom warp yarns bound by I2 and the binding of immediately adjacent bottom warp yarns by B1 and B2, respectively. This same binding relationship exists throughout the entire fabric 80, to thereby provide a completely locked structure.

Referring to FIG. 9, an eighth embodiment of a fabric in accordance with this invention is shown at 90. The fabric 90, like the fabric 80, is a 40 shaft repeat. FIG. 9 shows the full weave paths for all paper side wefts (T1, T2, T3 . . . T10), wear side wefts (B1, B2, B3 . . . B10), and interchanging binder weft pairs (I1/2, I3/4, I5/6 . . . I19/20) for the fabric 90. Thus, the fabric 90, unlike the fabric 80, provides a full weft path with ten (10) top weft yarns, ten (10) bottom weft yarns and ten (10) pairs of interchanging binder yarns.

Specifically, the fabric 90 has a forty (40) shaft repeat, including a twenty (20) warp top layer (1, 3, 5, . . . 39) having a paper side surface within each repeat, a twenty (20) warp machine side layer (2, 4, 6, . . . 40) having a bottom wear side surface within each repeat and a plurality of pairs of first and second intrinsic interchanging weft binder yarns (I1/2 through I19/20).

As illustrated in the weft path weave patterns depicted in FIG. 9, the top layer of fabric 90 includes top warp yarns 1, 3, 5 . . . 39 within each repeat interwoven with top, i.e., paper side, weft yarns T1, T2 . . . T10 and top segments of the interlacing binder pairs I1/2, I3/4, I5/6 . . . I19/20 to form a plain weave.

The machine side, i.e., wear side, layer of the fabric 90 includes bottom warp yarns 2, 4, 6 . . . 40 within each repeat, interwoven with bottom, i.e., wear side weft yarns B1, B2 . . . B20. Moreover, like in the fabrics 20, 30, 40 and 80, the adjacent, non-interchanging wear side weft yarns have a two (2) step relationship. That is, B1 binds to bottom warp yarns 2, 12, 22 and 32, and B2 then steps two (2) bottom warp yarns to bind with bottom warp yarns 6, 16, 26 and 36. This same two (2) step relationship continues for all of the wear side weft yarns, just as in the fabrics 20, 30, 40 and 80 shown in FIGS. 2-4 and 8, respectively. In fact, the weave pattern of the bottom weft yarns B1 through B10 in the fabric 90 is identical to the weave pattern of the bottom weft yarns B1 through B10 in the fabric 80.

Still referring to FIG. 9, the bottom weave pattern of the non-interchanging yarns of the fabric 90 is a 5 shed repeat, with each wear side weft yarn passing under four adjacent bottom warp yarns and then forming a knuckle over one bottom warp yarn. In the wear side layer, therefore, 1 in every 5 wear side warp yarn-weft yarn interactions are warp interlacings beneath the weft yarn such that the weft yarn transfers to the interior of the fabric where it may disadvantageously interfere with the flow of water through the fabric and where it will not contribute to fabric wear resistance. This 5 shed weave pattern exists for all non-interchanging wear side weft yarns, as can be seen for example at wear side weft B1, which interlaces with wear side MD yarns 2, 12, 22 and 32, respectively, within each 40 shed repeat. Consequently, in the fabric 90, 20% of the wear side warp yarns within each weave repeat are wear side warp-weft interlacings (i.e., 4 out of 20) to establish a wear side MD-CD interlacing percentage (WIP) of 20.

In the 40 shaft fabric 90 shown in FIG. 9 all paper side weft paths are made in plain weave, or so-called 2 shaft weave repeat. Therefore, there are 10 paper side layer repeats of the plain weave in the 20 paper side warp yarns within each 40 shaft repeat of the fabric 90. By contrast all wear side weft paths are made in 5 shaft repeats. Therefore, there are 4 repeats of the 5 shaft weave in the 20 wear side warp yarns within each 40 shaft repeat of the fabric 90. Consequently the ratio of paper side to wear side weave repeats for the fabric 90, which is the earlier described PWR value, is equal to 2.5 (i.e., 10/4).

In the fabric 90 illustrated in FIG. 9, like in the fabrics 20, 30, 40, 50, 60, 70 and 80, the pairs of intrinsic, interchanging weft binder yarns I1/2 through I19/20 account for 50% of the cross-machine-direction weft pattern in the paper side layer; being located between each pair of top weft yarns, e.g., T1, T2. That is, every other weft yarn path in the paper side layer is provided by an intrinsic, interchanging weft binder yarn pair. As will be explained in detail hereinafter the interchanging weft binder yarn pairs in fabric 90 provide a binder stiffening section underlying each segment formed by the interchanging binder yarn pairs, in a manner similar to that in fabrics 70 and 80 shown in FIGS. 7 and 8, respectively. In addition to providing a stiffening function, the provision of stiffening sections in the fabric 90 reduces the total float length within each repeat of the interchanging yarn pairs, as compared to omitting such stiffening sections, as also will be discussed in detail hereinafter.

As is shown in FIG. 9, each pair of intrinsic, interchanging weft binder yarns I1/2 through I19/20 includes two segments in the paper side layer within each repeat of the weave pattern in the composite fabric. The two segments of the intrinsic interchanging weft binder yarns in the top layer provide an unbroken weft path in the paper side surface, with each succeeding segment being separated in the paper side surface of the top layer by a top layer transitional warp yarn, e.g., top warp yarns 17 and 37 in the binder pair I1/2 and top warp yarns 13 and 33 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat, i.e., 2 in fabric 90.

Referring to FIG. 9A, a diagram of the top layer transitional points shows the transitional points by the designation "x," which are the uppermost surface of the transitional warp yarns. The 20 warp yarns within each repeat of the upper layer are designated by the 20 vertical columns of the diagram and the full repeat provided by the 10 pairs of interchanging binder yarns are indicated by the ten (10) horizontal rows of the diagram.

As illustrated in FIG. 9, a first yarn I1 of the interchanging weft binder pair I1/2 of fabric 90, which is depicted as a dotted line, provides a first segment in the paper side layer. That segment comprises paper side warp yarns 19, 21, 23, 25, 27, 29, 31, 33, 35 & transitional warp yarn 17, i.e., a total of 10 warp yarns including the transitional warp yarn 17, providing five (5) paper side knuckles. Therefore, a segment length of 10 is provided by the binder yarn I1. The binder yarn I1 cooperates with the binder yarn I2 to provide a continuous weft path in the paper side fabric layer, which, as illustrated, is a plain weave.

The binder yarn I2, which is shown in solid representation, provides a second segment in the paper side layer by interlacing with paper side warp yarns 39, 1, 3, 5, 7, 9, 11, 13, 15 & transitional warp yarn 37; i.e., a total of 10 warp yarns including the transitional warp yarn 37, providing five (5) paper side knuckles. Therefore, a segment length of 10 is provided by the binder yarn I2. Thus, the two interchanging binder yarns I1 and I2 in the fabric 90 each cooperate to provide a segment length of 10 and 5 paper side knuckles. Thus, there is no reversing of binders in adjacent pairs based on a different path length of the two segments within each repeat. However, as explained earlier, reversing of binders in adjacent pairs could still be carried out to allow for a desired distribution of different yarn materials or diameters even where the segment lengths are equal and wear side interlacings also are equal.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 90 has the following values: WIP=20; PWR=2.5; IPP=10; ITP=5; IWR=0.5 and WKR=0.5.

As stated earlier herein, it is desirable in the fabrics of this invention to minimize the length of internal floats of the interchanging binder yarns to thereby minimize void volume within the fabric, which minimizes undesired water retention properties of the fabric. It is also desirable to stiffen the fabric in the transverse direction to prevent undesired CD deformation in the fabric.

The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 90 illustrated in FIG. 9, both binder yarns of each pair have a float length of 3 between leaving the top layer and commencing to interlace with a bottom warp yarn, and a float length of 2 as they complete their interlacing with the bottom warp yarn and move back into the top layer. For example, the binder yarn I1 (dotted line) leaves the top layer adjacent transition top warp yarn 37 and passes between top and bottom warp yarn pairs 37-38, 39-40 and 1-2 (i.e., 3 pairs=float of 3) before interlacing with bottom warp yarn 4. I1 then passes between top and bottom warp yarn pairs 15-16 and 17-18 (i.e., 2 pairs=float of 2) after binding to bottom warp yarn 14 and before entering the top layer to bind with top warp yarn 19. I1, between binding to bottom warp yarn 4 and bottom warp yarn 14 floats over adjacent, bottom warp yarns 6, 8, 10 and 12 in the interior of the fabric 90 to provide a stiffening section in the fabric underlying one top segment.

The other binder yarn I2 of the pair I1/2 (solid line) leaves the top layer adjacent transition warp yarn 17 and passes between top and bottom warp yarn pairs 17-18, 19-20 and 21-22 (i.e., 3 pairs=float of 3) before interlacing with bottom warp yarn 24. I2 then passes between top and bottom warp yarn pairs 35-36 and 37-38 (i.e., 2 pairs=float of 2) after binding to bottom warp yarn 34 and before entering the top layer to bind with top warp yarn 39. I2, between binding to bottom warp yarn 24 and bottom warp yarn 34 floats over adjacent, bottom warp yarns 26, 28, 30 and 32 in the interior of the fabric 90 to provide a further stiffening section in the fabric underlying the other top segment provided by the interchanging binder yarns. Thus, the fabric 90, like the fabrics 70 and 80, is stiffened under each segment created by the interchanging binder yarn pairs to provide a highly stable structure.

Moreover, in the fabric 90 each of the interchanging binder yarn pairs, e.g., I1 and I2, have one internal float of 2 and one internal float of 3 within each repeat of the weave pattern. Thus the total float length within each weave repeat of the fabric 90 is ten (10) (2+3+2+3=10). Although other embodiments of this invention have a lower total float length, a total float length of 10 is considered to be very acceptable within this invention. This low float length minimizes void volume within the fabric, which, in turn, minimizes undesired water retention properties of the fabric 90 relative to fabrics having a higher total float length.

Still referring to FIG. 9, it should be noted that, like fabric 20, the interlacing of each binder yarn pair with a bottom warp yarn in fabric 90 is "locked," which may provide the same benefits as discussed earlier with respect to the fabrics 20 and 80. The meaning of "locked" was described earlier in this application and will not be repeated herein for purposes of brevity. By way of example, the interlacing of interchanging binder yarn I1 with bottom warp yarns 4 and 14 is locked because the weave patterns of adjacent, non-interchanging bottom weft yarn B1, on one side of I1 and I2, and adjacent, non-interchanging bottom weft yarn B2, on the other side of I1 and I2, provide interlacings with bottom warp yarns 2 and 6, respectively, which are the two warp yarns immediately adjacent bottom warp yarn 4 that is bound by I1; and with bottom warp yarns 12 and 16, respectively, which are the two warp yarns immediately adjacent bottom warp yarn 14 that also is bound by I1. Moreover, this same relationship is achieved with respect to the bottom warp yarns bound by I2 and the binding of immediately adjacent bottom warp yarns by B1 and B2, respectively. This same binding relationship exists throughout the entire fabric 90, to thereby provide a completely locked structure.

Referring to FIG. 10, a ninth embodiment of a fabric in accordance with this invention is shown at 100. The fabric 100, like the fabrics 80 and 90, is a 40 shaft repeat. FIG. 10 shows the full weave paths for all paper side wefts (T1, T2, T3 . . . T10), wear side wefts (B1, B2, B3 . . . B10), and interchanging binder weft pairs (I1/2, I3/4, I5/6 . . . I19/20) for the fabric 100. Thus, the fabric 100, like fabric 90 but unlike the fabric 80, provides a full weft path with ten (10) top weft yarns, ten (10) bottom weft yarns and ten (10) pairs of interchanging binder yarns.

Specifically, the fabric 100 has a forty (40) shaft repeat, including a twenty (20) warp top layer (1, 3, 5, . . . 39) having a paper side surface within each repeat, a twenty (20) warp machine side layer (2, 4, 6, . . . 40) having a bottom wear side surface within each repeat and a plurality of pairs of first and second intrinsic interchanging weft binder yarns (I1/2 through I19/20).

As illustrated in the weft path weave patterns depicted in FIG. 10, the top layer of fabric 100 includes top warp yarns 1, 3, 5 . . . 39 within each repeat interwoven with top, i.e., paper side, weft yarns T1, T2 . . . T10 and top segments of the interlacing binder pairs I1/2, I3/4, I5/6 . . . I19/20 to form a plain weave.

The machine side, i.e., wear side, layer of the fabric 100 includes bottom warp yarns 2, 4, 6 . . . 40 within each repeat, interwoven with bottom, i.e., wear side weft yarns B1, B2 . . . B20. Moreover, the adjacent, non-interchanging wear side weft yarns of the fabric 100 have a three (3) step relationship. That is, B1 binds to bottom warp yarns 8, 12, 28 and 32, and B2 then steps three (3) bottom warp yarns to bind with bottom warp yarns 14, 18, 34 and 38. This same three (3) step relationship continues for all of the non-interchanging wear side weft yarns.

Still referring to FIG. 10, the bottom weave pattern of the non-interchanging weft yarns of the fabric 100 has two (2) repeats within the 20 bottom warp yarns within each weave repeat. Specifically, each non-interchanging bottom weft yarn floats under seven (7) consecutive bottom warp yarns and then interlaces with bottom warp yarns to form two (2) interior knuckles before repeating the weave pattern. This arrangement exists for all of the non-interchanging bottom weft yarns. As an example, B1, after floating under the seven (7) consecutive bottom warp yarns 14, 16, 18, 20, 22, 24 and 26 interlaces with bottom warp yarns 28, 30, 32 to form two interior knuckles with bottom warp yarns 28 and 32. The pattern then repeats. Consequently, in the fabric 100, 20% of the wear side warp yarns within each weave repeat are wear side warp-weft interlacings (i.e., 4 out of 20) to establish a wear side MD-CD interlacing percentage (WIP) of 20.

In the 40 shaft fabric 100 shown in FIG. 10 all paper side weft paths are made in plain weave, or so-called 2 shaft weave repeat. Therefore, there are 10 paper side layer repeats of the plain weave in the 20 paper side warp yarns within each 40 shaft repeat of the fabric 100. By contrast all wear side weft paths are made in 10 shaft repeats. Therefore, there are 2 repeats of the 10 shaft weave in the 20 wear side warp yarns within each 40 shaft repeat of the fabric 100. Consequently the ratio of paper side to wear side weave repeats for the fabric 100, which is the earlier described PWR value, is equal to 5 (i.e., 10/2).

In the fabric 100 illustrated in FIG. 10, like in the fabrics 20, 30, 40, 50, 60, 70, 80 and 90, the pairs of intrinsic, interchanging weft binder yarns I1/2 through I19/20 account for 50% of the cross-machine-direction weft pattern in the paper side layer; being located between each pair of top weft yarns, e.g., T1, T2. That is, every other weft yarn path in the paper side layer is provided by an intrinsic, interchanging weft binder yarn pair. As will be explained in detail hereinafter the interchanging weft binder yarn pairs in fabric 100 provide a binder stiffening section underlying each segment formed by the interchanging binder yarn pairs, in a manner similar to that in fabric 90. In addition to providing a stiffening function, the provision of stiffening sections in the fabric 100 reduces the total float length within each repeat of the interchanging yarn pairs, as compared to omitting such stiffening sections, as also will be discussed in detail hereinafter.

As is shown in FIG. 10, each pair of intrinsic, interchanging weft binder yarns I1/2 through I19/20 includes two segments in the paper side layer within each repeat of the weave pattern in the composite fabric. The two segments of the intrinsic interchanging weft binder yarns in the top layer provide an unbroken weft path in the paper side surface, with each succeeding segment being separated in the paper side surface of the top layer by a top layer transitional warp yarn, e.g., top warp yarns 11 and 31 in the binder pair I1/2 and top warp yarns 7 and 27 in the binder pair I3/I4 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat, i.e., 2 in fabric 100.

Referring to FIG. 10A, a diagram of the top layer transitional points shows the transitional points by the designation "x," which are the uppermost surface of the transitional warp yarns. The 20 warp yarns within each repeat of the upper layer are designated by the 20 vertical columns of the diagram and the full repeat provided by the 10 pairs of interchanging binder yarns is indicated by the ten (10) horizontal rows of the diagram.

As illustrated in FIG. 10, a first yarn I1 of the interchanging weft binder pair I1/2 of fabric 100, which is depicted as a dotted line, provides a first segment in the paper side layer. That segment comprises paper side warp yarns 13, 15, 17, 19, 21, 23, 25, 27, 29 & transitional warp yarn 11, i.e., a total of 10 warp yarns including the transitional warp yarn 17, providing five (5) paper side knuckles. Therefore, a segment length of 10 is provided by the binder yarn I1. The binder yarn I1 cooperates with the binder yarn I2 to provide a continuous weft path in the paper side fabric layer, which, as illustrated, is a plain weave.

The binder yarn I2, which is shown in solid representation, provides a second segment in the paper side layer by interlacing with paper side warp yarns 33, 35, 37, 39, 1, 3, 5, 7, 9 & transitional warp yarn 31; i.e., a total of 10 warp yarns including the transitional warp yarn 37, providing five (5) paper side knuckles. Therefore, a segment length of 10 is provided by the binder yarn I2. Thus, the two interchanging binder yarns I1 and I2 in the fabric 100 each cooperate to provide a segment length of 10 and 5 paper side knuckles. Thus, three is no reversing of binders in adjacent pairs based on a different path length of the two segments within each repeat. However, as explained earlier, reversing of binders in adjacent pairs could still be carried out to allow for a desired distribution of different yarn materials or diameters even where the segment lengths are equal and wear side interlacings also are equal.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 100 has the following values: WIP=20; PWR=5; IPP=10; ITP=5; IWR=1.0 and WKR=1.0.

As stated earlier herein, it is desirable in the fabrics of this invention to minimize the length of internal floats of the interchanging binder yarns to thereby minimize void volume within the fabric, which minimizes undesired water retention properties of the fabric. It is also desirable to stiffen the fabric in the transverse direction to prevent undesired CD deformation in the fabric.

The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 100 illustrated in FIG. 10, it should be evident that both binder yarns of each pair have a float length of 2 between leaving the top layer and commencing to interlace with a bottom warp yarn, and a float length of 3 as they complete their interlacing with the bottom warp yarn and move back into the top layer. The manner of determining the float length has been discussed in detail with respect to each of the previously described embodiments of the invention, and therefore no further explanation or examples are necessary to a person skilled in the art. Suffice it to state that I1 (dotted representation), between binding to bottom warp yarns 36 and 6 floats over adjacent, bottom warp yarns 38, 40, 2 and 4 in the interior of the fabric 100 to provide a stiffening section in the fabric underlying one top segment and 12 (solid representation), between binding to bottom warp yarns 16 and 26 floats over adjacent, bottom warp yarns 18, 20, 22 and 24 to provide a stiffening section in the fabric underlying the other top segment.

Thus, the fabric 100, like the fabrics 70, 80 and 90, is stiffened under each segment created by the interchanging binder yarn pairs to provide a highly stable structure.

Moreover, in the fabric 100 each of the interchanging binder yarn pairs, e.g., I1 and I2, have one internal float of 2 and one internal float of 3 within each repeat of the weave pattern. Thus the total float length within each weave repeat of the fabric 100 is ten (10) (2+3+2+3=10). Although other embodiments of this invention have a lower total float length, a total float length of 10 is considered to be very acceptable within this invention. This low float length minimizes void volume within the fabric, which, in turn, minimizes undesired water retention properties of the fabric 100 relative to fabrics having a higher total float length.

Still referring to FIG. 10, it should be noted that fabric 100 is "unlocked." The meaning of "unlocked" was described earlier in this application and will not be repeated herein for purposes of brevity. Moreover, the manner of making this determination has been discussed in detail in connection with the other embodiments described previously herein, and likewise will not be repeated herein. Suffice it say, that none of the interlacings between the interchanging binder yarns and the bottom warp yarns is locked.

Referring to FIG. 11, a tenth embodiment of a fabric in accordance with this invention is shown at 110. The fabric 110, unlike the previous fabrics of this invention, is a 48 shaft repeat. FIG. 11 shows all of the cross-machine direction weft yarns in one-half of the full weave repeat. In particular, FIG. 11 shows paper side wefts (T1, T2, T3 . . . T24), wear side wefts (B1, B2, B3 . . . B24), and interchanging binder weft pairs (I1/2, I3/4, I5/6 . . . I23/24) for the fabric 110. Thus, the fabric 110, provides a full weft path with forty-eight (48) top weft yarns, forty-eight (48) bottom weft yarns and twenty-four (24) pairs of interchanging binder yarns. Unlike, the previous embodiments, every third weft path is provided by an interchanging binder pair. In all of the previous embodiments every other weft path was provided by an interchanging binder pair.

Specifically, the fabric 110 has a forty-eight (48) shaft repeat, including a twenty four (24) warp top layer (1, 3, 5, . . . 47) having a paper side surface within each repeat, a twenty four (24) warp machine side layer (2, 4, 6, . . . 48) having a bottom wear side surface within each repeat and a plurality of pairs of first and second intrinsic interchanging weft binder yarns (I1/2 through I47/48; only I1/2 through I23/24 being illustrated in FIG. 11).

As illustrated in the weft path weave patterns depicted in FIG. 11, in one half of the complete weft pattern repeat for the top layer of fabric 110, top warp yarns 1, 3, 5 . . . 47 within each repeat interweave with top, i.e., paper side, weft yarns T1, T2 . . . T24 and top segments of the interlacing binder pairs I1/2, I3/4, I5/6 . . . I23/24 to form a plain weave.

The machine side, i.e., wear side, layer of the fabric 110 includes bottom warp yarns 2, 4, 6 . . . 48 within each repeat, interwoven with bottom, i.e., wear side weft, yarns B1, B2 . . . B24 in one-half of the complete weft repeat pattern. Moreover, the adjacent, non-interchanging wear side weft yarns of the fabric 110 alternate between a three (3) step relationship and a two (2) step relationship. That is, B1 binds to bottom warp yarns 8, 20, 32 and 44, and B2 then steps three (3) bottom warp yarns to bind with bottom warp yarns 14, 26, 38 and 2. B3 then steps two (2) relative to B2 and binds with bottom warp yarns 18, 30, 42 and 6. This same three (3) step, two (2) step relationship continues for all of the non-interchanging wear side weft yarns in the fabric 110.

Still referring to FIG. 11, the bottom weave pattern of the non-interchanging weft yarns of the fabric 110 is a 6-shaft repeat; thereby providing four (4) repeats within the 24 bottom warp yarns of each weave repeat. Specifically, each non-interchanging bottom weft yarn floats under five (5) consecutive bottom warp yarns and then interlaces with a single bottom warp yarn to form an interior knuckle before repeating the weave pattern. This arrangement exists for all of the non-interchanging bottom weft yarns. As an example, B1, after floating under the five (5) consecutive bottom warp yarns 46, 48, 2, 4 and 6 interlaces with bottom warp yarn 8 to form an interior knuckle. The pattern then repeats. Consequently, in the fabric 110, 20% of the wear side warp yarns within each weave repeat are wear side warp-weft interlacings (i.e., 4 out of 24) to establish a wear side MD-CD interlacing percentage (WIP) of 16.7.

In the 48 shaft fabric 110 shown in FIG. 11 all paper side weft paths are made in plain weave, or so-called 2 shaft weave repeat. Therefore, there are 12 paper side layer repeats of the plain weave in the 24 paper side warp yarns within each 48 shaft repeat of the fabric 110. By contrast all wear side weft paths are made in 6 shaft repeats. Therefore, there are 4 repeats of the 6 shaft weave in the 24 wear side warp yarns within each 48 shaft repeat of the fabric 110. Consequently the ratio of paper side to wear side weave repeats for the fabric 110, which is the earlier described PWR value, is equal to 3 (i.e., 12/4).

As will be explained in detail hereinafter, the interchanging weft binder yarn pairs in fabric 110 provide a binder stiffening section underlying each segment formed by the interchanging binder yarn pairs, in a manner similar to that in fabric 90 and 100. In addition to providing a stiffening function, the provision of stiffening sections in the fabric 110 reduces the total float length within each repeat of the interchanging yarn pairs, as compared to omitting such stiffening sections, as also will be discussed in detail hereinafter.

As is shown in FIG. 11, each pair of intrinsic, interchanging weft binder yarns I1/2 through I23/24 includes two segments in the paper side layer within each repeat of the weave pattern in the composite fabric. The two segments of the intrinsic interchanging weft binder yarns in the top layer provide an unbroken weft path in the paper side surface, with each succeeding segment being separated in the paper side surface of the top layer by a top layer transitional warp yarn, e.g., top warp yarns 3 and 27 in the binder pair I1/2 and top warp yarns 13 and 37 in the binder pair 13/14 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. However, as stated earlier herein, for purposes of description, or definition, in this application the reference to "transitional points" refers to the uppermost surface of the top layer in a section of that layer vertically aligned with the crossover points between the interchanging yarns. In the illustrated embodiments of this invention, this uppermost surface is the upper surface region of the transitional warp yarns. Moreover the number of transition points or transitional warp yarns within each repeat of the weave pattern is equal to the number of segments within the repeat, i.e., 2 in fabric 110.

Referring to FIG. 11A, a diagram of the top layer transitional points shows the transitional points by the designation "x," which are the uppermost surface of the transitional warp yarns. The 24 warp yarns within each repeat of the upper layer are designated by the 24 vertical columns of the diagram and the twelve (12) horizontal rows of the diagram illustrate the 12 pairs of interchanging yarns in one-half of the complete weft yarn weave repeat.

As illustrated in FIG. 11, a first yarn I1 of the interchanging weft binder pair I1/2 of fabric 110, which is depicted as a dotted line, provides a first segment in the paper side layer. That segment comprises paper side warp yarns 5, 7, 9, 11, 13, 15, 17, 19, 21, 23, 25 & transitional warp yarn 3, i.e., a total of 12 warp yarns including the transitional warp yarn 3, providing six (6) paper side knuckles. Therefore, a segment length of I2 is provided by the binder yarn I1. The binder yarn I1 cooperates with the binder yarn I2 to provide a continuous weft path in the paper side fabric layer, which, as illustrated, is a plain weave.

The binder yarn I2, which is shown in solid representation, provides a second segment in the paper side layer by interlacing with paper side warp yarns 29, 31, 33, 35, 37, 39, 41, 43, 45, 47, 1 & transitional warp yarn 27; i.e., a total of 12 warp yarns including the transitional warp yarn 27, providing six (6) paper side knuckles. Therefore, a segment length of 12 is provided by the binder yarn I2. Thus, the two interchanging binder yarns I1 and I2 in the fabric 110 each cooperate to provide a segment length of 12 and 6 paper side knuckles. Thus, there is no reversing of binders in adjacent pairs based on a different path length of the two segments within each repeat. However, as explained earlier, reversing of binders in adjacent pairs could still be carried out to allow for a desired distribution of different yarn materials or diameters even where the segment lengths are equal and wear side interlacings also are equal.

As noted previously in connection with the description of the prior art fabric 10 illustrated in FIG. 1, a variety of values can be employed to identify the occurrence of binder interchange points in the fabric paper side, e.g., IPP, ITP, IWR and WKR. The manner of determining each of these latter values has been explained in detail earlier in this application, and for purposes of brevity will not be repeated herein. Suffice it to state that the fabric 110 has the following values: WIP=16.7; PWR=3.0; IPP=8.3; ITP=4.2; IWR=0.5 and WKR=0.5.

As stated earlier herein, it is desirable in the fabrics of this invention to minimize the length of internal floats of the interchanging binder yarns to thereby minimize void volume within the fabric, which minimizes undesired water retention properties of the fabric. It is also desirable to stiffen the fabric in the transverse direction to prevent undesired CD deformation in the fabric.

The description of internal float length was included earlier in this application, and for purposes of brevity will not be repeated in detail herein. Suffice it to state that the internal float length is the number of pairs of top and bottom warp yarns that each binder yarn floats between as it exits the top layer adjacent a transitional warp yarn and first binds to, or interlaces with a bottom warp yarn, and also the number of pairs of top and bottom warp yarns that each binder yarn floats between after completing its interlacing with one or more bottom warp yarns and moving back into the top layer. In the fabric 110 illustrated in FIG. 11, it should be evident that both binder yarns of each pair have a float length of 3 between leaving the top layer and commencing to interlace with a bottom warp yarn, and a float length of 3 as they complete their interlacing with the bottom warp yarn and move back into the top layer. The manner of determining the float length has been discussed in detail with respect to each of the previously described embodiments of the invention, and therefore no further explanation or examples are necessary to a person skilled in the art. Suffice it to state that I1 (dotted representation), between binding to bottom warp yarns 34 and 46 floats over adjacent, bottom warp yarns 36, 38, 40, 42 and 44 in the interior of the fabric 110 to provide a stiffening section in the fabric underlying one top segment and I2 (solid representation), between binding to bottom warp yarns 10 and 22 floats over adjacent, bottom warp yarns 12, 14, 16, 18 and 20 to provide a stiffening section in the fabric underlying the other top segment.

Thus, the fabric 110, like the fabrics 70, 80, 90 and 100, is stiffened under each segment created by the interchanging binder yarn pairs to provide a highly stable structure.

Moreover, in the fabric 110 each of the interchanging binder yarn pairs, e.g., I1 and I2, have two internal floats 3 within each repeat of the weave pattern. Thus the total float length within each weave repeat of the fabric 110 is twelve (12) (4×3=12). Although other embodiments of this invention have a lower total float length, a total float length of 12 is considered to be very acceptable within this invention. This low float length minimizes void volume within the fabric, which, in turn, minimizes undesired water retention properties of the fabric 110 relative to fabrics having a higher total float length.

Still referring to FIG. 11, it should be noted that fabric 110 is "unlocked." The meaning of "unlocked" was described earlier in this application and will not be repeated herein for purposes of brevity. Moreover, the manner of making this determination has been discussed in detail in connection with the other embodiments described previously herein, and likewise will not be repeated herein. Suffice it say, that none of the interlacings between the interchanging binder yarns and the bottom warp yarns is locked.

Referring to FIG. 12, a further (eleventh) embodiment of a fabric in accordance with this invention is shown at 120. Unlike the previous embodiments, the fabric 120 is a 100 shaft repeat. FIG. 12 shows only part of the complete weft path in the fabric, and actually shows only three weft paths. The first weft path is provided by non-interchanging top weft yarn T1 and non-interchanging bottom weft yarn B1. The second weft path is provided by interchanging binder pairs I1/2, and the third weft path is provided by non-interchanging top weft yarn T2 and non-interchanging bottom weft yarn B2. The reason why additional weft paths are not illustrated is because there are a wide variety of variations that can be made in this fabric, due to the substantial weave repeat of 100 warp yarns. For example, alternate weft paths can be provided by the interchanging binder pairs, in which case 50% of the weft paths will be provided by interchanging binder pairs. However, if desired, a different arrangement of interchanging binder pairs can be included.

As illustrated in FIG. 12, the top weft yarns T1, T2, etc. cooperate with the top weft segments provided by the interchanging binder pairs to provide a plain weave pattern, in the identical manner described earlier in connection with all of the other embodiments of this invention. In fact, as illustrated the interchanging binder yarn pair I1/2 provides two top segments; one including 20 top warp yarns and the other including 30 top warp yarns. Thus, if this arrangement is provided for the remaining interchanging binder yarn pairs, the segments can be reversed, if desired. The reversing of the insertion order has been described in detail earlier in this application in connection with the various embodiments have interchanging binder yarn pairs providing segments of different lengths within each weave repeat.

Still referring to FIG. 12, it should be noted that the non-interchanging bottom weft yarns B1, B2, etc. have a 5-shaft repeat; passing under 4 bottom warp yarns and over one bottom warp yarn in each repeat Thus, there are 10 repeats of the 5 shaft repeat in the fifty (50) bottom warp yarns within each 100 warp yarn repeat of the fabric 120. The number of repeats in the top layer provided by the non-interchanging top weft yarns T1, T2, etc. is 25, i.e., the plain weave has a two shaft repeat over the 50 top warp yarns in the 100 warp yarn repeat of the fabric 120.

It should be noted that the interchanging binder yarn shown in dotted representation provides three (3) stiffening sections under the top segment provided by the other interchanging binder yarn, and the other (solid) interchanging binder yarn provides five (5) stiffening sections under the top segment provided by the interchanging binder yarn depicted in dotted lines. Thus, this fabric provides an extremely stable construction.

It also should be noted that each of the interchanging binder yarns has a float of three (3) when it leaves the top layer and first binds to a warp yarn in the bottom layer, and a float of two (2) when it leaves the bottom layer and first binds to a warp yarn in the top layer. Thus, the total float length of the interchanging binder yarn pairs is ten (10), which is a highly advantageous structure.

As can be easily recognized, the fabric 120 has the following values: WIP=20.0; PWR=2.5; IPP=4.0; ITP=2.0; IWR=0.2 and WKR=0.2.

Figure 13:
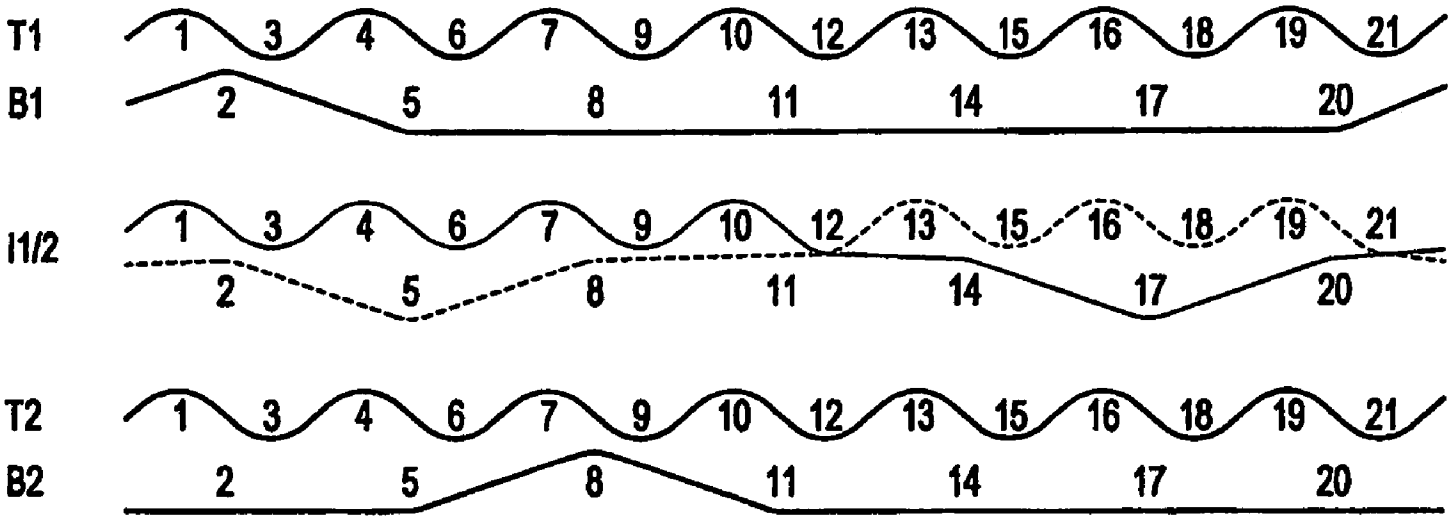
FIG. 13 is a partial cross sectional view of a 21 shaft triple-layer fabric of the current invention showing the weave paths of two pairs of paper side and wear side wefts, and one pair of interchanging binder wefts.

Referring to FIG. 13 an additional embodiment of this invention is shown at 130. FIG. 13 represents only three weft paths in the fabric. The important feature in this embodiment is that the ratio of top-to-bottom warp yarns is 2:1, as opposed to the 1:1 ratio of all of the previously described embodiments. It should be understood that other ratio's can be employed, provided that the fabric includes more than 12 top warp yarns within each repeat, as defined earlier. It should be noted that the fabric 130 has 14 paper side warp yarns and 7 wear side warp yarns; thereby providing the 2:1 ratio of top warp yarns to bottom warp yarns.

As in all of the other embodiments the top weft yarns and interchanging binder yarns cooperate to form a plain weave pattern in the top layer. Also, the interchanging binder yarn pair provides two (2) segments within the weave repeat, as in all of the previously disclosed embodiments. In the illustrated embodiment that interchanging binder yarn pairs do not provide stiffening sections as in some of the prior embodiments.

As can be seen in FIG. 13, the non-interchanging bottom weft yarns, e.g., B1, B2, each have a 7-shaft repeat, passing under 6 consecutive bottom warp yarns and then moving over one of the bottom warp yarns to provide an internal knuckle. The non-interchanging top weft yarns, e.g., T1, T2 forms a plain weave pattern, including 7 repeats of the plain weave pattern within each full repeat of the fabric 120. Other details of this weave pattern are readily apparent from FIG. 13.

It should be noted that many modifications can be made within the scope of the invention. For example the type (e.g., material), diameter and shape of the yarns can be varied. A number of variations can be made in the weave patterns. For example, it is not required that the top weave pattern be the plain weave pattern depicted in all of the embodiments. Also, the order of insertion of the yarns of the interchanging binder yarn pairs can be varied, and it is not a requirement of the invention that alternate pairs of interchanging yarns be reversed, even when the segment lengths provided by the interchanging binder yarns are different. In addition, although specific weave repeats have been illustrated, other weave repeats can be employed in accordance with the broadest aspects of this invention. The ratio of top-to-bottom effective weft paths also can be varied, e.g., 1:1; 2:1 (as shown in most embodiments) 3:2 (as shown in one embodiment; 4:3, etc. In addition, although the illustrated embodiments of this invention have the same number of top and bottom warp yarns within each repeat, i.e., a 1:1 ratio of top-to-bottom warp yarns, it is within the scope of this invention to include a different number of warp yarns in the top and bottom layers, respectively. For example, a 2:1 relationship can be provided between the number of warp yarns in the top layer and the number of warp yarns in the bottom layer, e.g., 28 top warp yarns and 14 bottom warp yarns within each repeat; thereby providing a 42 warp yarn repeat.

The invention claimed is:

1. Paper making composite forming fabric comprising paper side weft and warp yarns, wear side warp yarns and binder yarns, the paper side wefts and the binder yarns being interwoven with the paper side warp yarns, the binder yarns being interwoven with the wear side warps, a total number of paper side and wear side warp yarns per weave repeat is greater than 24, an internal binder float length is between 2 and 4, the fabric having fewer than 0.20 binder yarn pair interchanges for the number of paper side warp yarns in each weave repeat and fewer than 0.10 binder yarn pair interchanges for the total of machine direction yarn in each weave repeat.

2. Paper making composite forming fabric according to claim 1, wherein the total number of paper side and wear side warp yarns per repeat is one of 28, 32, 40, 48, and 100.

3. Paper making composite forming fabric according to claim 1, wherein the fabric further comprises wear side weft yarns which are interwoven with the wear side warp yarns.

4. Paper making composite forming fabric according to claim 1, wherein the binder yams are disposed in pairs and form an integral part of the paper side weave pattern.

5. Paper making composite forming fabric according to claim 1, wherein the number of paper side warp yarns and the number of wear side warp yarns is the same.

6. Paper making composite forming fabric according to claim 1, wherein at least one binder yarn is defining a stiffening section, wherein the binder yarn floats under at least two consecutive warp yarns of a fabric layer and binds on each end of the stiffening section with a warp yarn of the same layer.

7. Paper making composite forming fabric according to claim 1, wherein a binder knuckle on the wear side fabric is bordered on both sides by adjacent wear side warp yarns interlacing with wear side weft yarns.

8. Paper making composite forming fabric according to claim 1, wherein interchange points percentage, which is the number of binder interchanges divided by the number of paper side warp yarns multiplied by 100, is less than 15.

9. Paper making composite forming fabric according to claim 1, wherein paper side to wear side weave repeat ratio, which is the number of repeats on the paper side per weave repeat divided by the number of repeats on the wear side per weave repeat, is greater than 3.

10. Paper making composite forming fabric according to claim 1, wherein binder interchange points as percentage of the total number of MD yarns per weave repeat is less than 8.3.

11. Paper making composite forming fabric according to claim 1, wherein wear side fabric MD-CD yam interlacing divided by the number of wear side warp yarns per weave repeat multiplied with 100 is less than 15.

12. Paper making composite forming fabric according to claim 1, wherein the fabric is manufactured by using at least one of a Jacquard and a dobby mechanism.

13. Paper making composite forming fabric according to claim 1, wherein the warp yams are not drawn-in sequentially from a first frame to a last frame of a weaving loom.

14. Paper making composite forming fabric according to claim 1, wherein for a weave repeat using N frames, warp yarns 1 to N/2 are drawn-in in sequence from frame 1 to frame N/2 and warp yarns N/2+1 to N are drawn-in reversed order from frame N to N/2+1.

15. Paper making composite forming fabric according to claim 1, wherein interchange points percentage, which is the number of binder interchanges divided by the number of paper side warp yarns multiplied by 100, is between 14.3 and 4.

16. Paper making composite forming fabric according to claim 1, wherein the total number of paper side and wear side warp yams per repeat is one of 40, 48 and 100.

* * * * *

UNITED STATES PATENT AND TRADEMARK OFFICE

CERTIFICATE OF CORRECTION

PATENT NO. : 7,571,746 B2
APPLICATION NO. : 10/557266
DATED : August 11, 2009
INVENTOR(S) : Stewart Lister Hay et al.

It is certified that error appears in the above-identified patent and that said Letters Patent is hereby corrected as shown below:

COLUMN 58
At line 53, please delete "yams", and substitute therefore --yarns--.

COLUMN 59
At line 15, please delete "yam", and substitute therefore --yarn--.

COLUMN 60
At line 16, please delete "yams", and substitute therefore --yarns--.

COLUMN 60
At line 17, please add the missing claim 17 --Paper making composite forming fabric according to claim 1, wherein the binder yarn pair interchanges for the total of machine direction yarns in each weave repeat is 0.02--

Signed and Sealed this

Fifth Day of October, 2010

David J. Kappos

David J. Kappos
*Director of the United States Patent and Trademark Office*